US009460694B2

(12) United States Patent
Minamitaka

(10) Patent No.: US 9,460,694 B2
(45) Date of Patent: Oct. 4, 2016

(54) AUTOMATIC COMPOSITION APPARATUS, AUTOMATIC COMPOSITION METHOD AND STORAGE MEDIUM

(71) Applicant: CASIO COMPUTER CO., LTD., Shibuya-ku, Tokyo (JP)

(72) Inventor: Junichi Minamitaka, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/855,048

(22) Filed: Sep. 15, 2015

(65) Prior Publication Data

US 2016/0148605 A1 May 26, 2016

(30) Foreign Application Priority Data

Nov. 20, 2014 (JP) ..... 2014-235235

(51) Int. Cl.

*A63H 5/00* (2006.01)
*G04B 13/00* (2006.01)
*G10H 7/00* (2006.01)
*G10H 1/00* (2006.01)

(52) U.S. Cl.

CPC ..... *G10H 1/0025* (2013.01); *G10H 2210/111* (2013.01); *G10H 2210/141* (2013.01); *G10H 2220/015* (2013.01); *G10H 2240/131* (2013.01)

(58) Field of Classification Search

CPC ..... G10H 1/0025; G10H 2210/141; G10H 2240/131; G10H 2210/111; G10H 2220/015
USPC ..... 84/609
See application file for complete search history.

(56) References Cited

U.S. PATENT DOCUMENTS 4,926,737 A * 5/1990 Minamitaka ..... G10H 1/0025 84/611
4,982,643 A * 1/1991 Minamitaka ..... G10H 1/0025 706/902
5,155,286 A * 10/1992 Saito ..... G10H 1/0008 84/611
5,182,414 A * 1/1993 Takahashi ..... G10H 1/0041 84/634
5,451,709 A * 9/1995 Minamitaka ..... G10H 1/0025 84/609
5,939,654 A * 8/1999 Anada ..... G09B 15/002 434/307 A
6,395,970 B2 5/2002 Aoki
6,403,870 B2 6/2002 Aoki
2002/0007720 A1* 1/2002 Aoki ..... G10H 1/0025 84/609
2002/0007721 A1* 1/2002 Aoki ..... G10H 1/0025 84/613
2002/0011145 A1* 1/2002 Aoki ..... G10H 1/0025 84/609

FOREIGN PATENT DOCUMENTS

JP 10105169 A 4/1998
JP 2002032078 A 1/2002
JP 2002032079 A 1/2002
JP 2002032080 A 1/2002

* cited by examiner

*Primary Examiner* — Jeffrey Donels
(74) *Attorney, Agent, or Firm* — Holtz, Holtz & Volek PC

(57) ABSTRACT

An automatic composition apparatus includes a processing unit. The processing unit performs a receiving process of receiving a phrase including a plurality of note data items as a received motif and receiving a type of the phrase, a retrieving process of retrieving a phrase set from a phrase set database and a melody generating process of generating a melody based on the retrieved phrase set. The phrase set includes phrases having the same type as the received type and having relatively high matching levels for the received motif. The phrase set database stores a plurality of phrase sets each of which is a combination of a plurality of phrases of different types.

11 Claims, 31 Drawing Sheets

| | | | | | | | |
|---|---|---|---|---|---|---|---|
| No. 0 | | | | | | | |
| CHORD PROGRESSION | | | | | | | |
| CHORD | C | | Am | | Dm | | G7 |
| KEY AND SCALE | Cmajor | | | | | | |
| No. 1 | | | | | | | |
| CHORD PROGRESSION | | | | | | | |
| CHORD | Am | | F | | Dm | | G7 |
| KEY AND SCALE | Cmajor | | | | | | |
| No. 2 | | | | | | | |
| CHORD PROGRESSION | | | | | | | |
| CHORD | G | | B7 | | Em | | D7 |
| KEY AND SCALE | Gmajor | | Emminor | | Gmajor | | |

FIG. 4A

| |
|---|
| No. 0 NOTE DATA ITEM |
| No. 1 NOTE DATA ITEM |
| . |
| . |
| . |
| END |

FIG. 4B

| |
|---|
| TIME |
| LENGTH |
| STRENGTH |
| PITCH |

FIG. 5A

| |
|---|
| No. 0 CHORD PROGRESSION DATA ITEM/MIDI DATA ITEM FOR ACCOMPANIMENT/MUSIC STRUCTURE DATA ITEM |
| No. 1 CHORD PROGRESSION DATA ITEM/MIDI DATA ITEM FOR ACCOMPANIMENT/MUSIC STRUCTURE DATA ITEM |
| · |
| · |
| · |
| END |

FIG. 5B

| |
|---|
| No. 0 CHORD DATA ITEM |
| No. 1 CHORD DATA ITEM |
| · |
| · |
| · |
| END |

FIG. 5C

| |
|---|
| TIME |
| KEY |
| SCALE |

FIG. 5D

| |
|---|
| TIME |
| ROOT |
| TYPE |

FIG. 6

| Measure | PartName[M] | iPartID[M] | ExistMelody[M] | iPartTime[M] |
|---|---|---|---|---|
| 0 | Null | 0 | 0 | |
| 1 | Intro | 1 | 0 | |
| 2 | Intro | 1 | 0 | |
| 3 | A | 11 | 1 | |
| 4 | A | 11 | 1 | |
| 5 | A | 11 | 1 | |
| 6 | A | 11 | 1 | |
| 7 | A | 11 | 1 | |
| 8 | A | 11 | 1 | |
| 9 | A | 11 | 1 | |
| 10 | A | 11 | 1 | |
| 11 | B | 12 | 1 | |
| 12 | B | 12 | 1 | |
| 13 | B | 12 | 1 | |
| 14 | B | 12 | 1 | |
| 15 | B | 12 | 1 | |
| 16 | B | 12 | 1 | |
| 17 | B | 12 | 1 | |
| 18 | B | 12 | 1 | |
| 19 | C | 13 | 1 | |
| 20 | C | 13 | 1 | |
| 21 | C | 13 | 1 | |
| 22 | C | 13 | 1 | |
| 23 | C | 13 | 1 | |
| 24 | C | 13 | 1 | |
| 25 | C | 13 | 1 | |
| 26 | C | 13 | 1 | |
| 27 | C | 13 | 1 | |
| 28 | A | 11 | 1 | |
| 29 | A | 11 | 1 | |
| 30 | A | 11 | 1 | |
| 31 | A | 11 | 1 | |
| 32 | A | 11 | 1 | |
| 33 | A | 11 | 1 | |
| 34 | A | 11 | 1 | |
| 35 | Ending | 3 | 0 | |

FIG. 7A

| 11 | 10 | 9 | 8 | 7 | 6 | 5 | 4 | 3 | 2 | 1 | 0 | SCALE NOTE (BIT LOCATION) |
|---|---|---|---|---|---|---|---|---|---|---|---|---|
| 0 | 0 | 0 | 0 | 1 | 0 | 0 | 1 | 0 | 0 | 0 | 1 | MAJ |
| 0 | 0 | 0 | 0 | 1 | 0 | 0 | 0 | 1 | 0 | 0 | 1 | MIN |
| 0 | 1 | 0 | 0 | 1 | 0 | 0 | 1 | 0 | 0 | 0 | 1 | 7TH |
| 1 | 0 | 0 | 0 | 1 | 0 | 0 | 1 | 0 | 0 | 0 | 1 | M7 |

FIG. 7B

| 11 | 10 | 9 | 8 | 7 | 6 | 5 | 4 | 3 | 2 | 1 | 0 | SCALE NOTE (BIT LOCATION) |
|---|---|---|---|---|---|---|---|---|---|---|---|---|
| 0 | 0 | 1 | 0 | 0 | 1 | 0 | 0 | 0 | 1 | 0 | 0 | MAJ |
| 0 | 0 | 0 | 0 | 0 | 0 | 1 | 0 | 0 | 1 | 0 | 0 | MIN |
| 0 | 0 | 1 | 1 | 0 | 0 | 0 | 0 | 1 | 1 | 1 | 0 | 7TH |
| 0 | 0 | 1 | 0 | 0 | 1 | 0 | 0 | 0 | 1 | 0 | 0 | M7 |

FIG. 7C

| 11 | 10 | 9 | 8 | 7 | 6 | 5 | 4 | 3 | 2 | 1 | 0 | SCALE NOTE (BIT LOCATION) |
|---|---|---|---|---|---|---|---|---|---|---|---|---|
| 1 | 0 | 1 | 0 | 1 | 0 | 1 | 1 | 0 | 1 | 0 | 1 | DIATONIC |
| 0 | 1 | 1 | 0 | 1 | 0 | 1 | 0 | 1 | 1 | 0 | 1 | DORIAN |

FIG. 8

| | | | | | | | | | | | | | | | | | | | | |
|---|---|---|---|---|---|---|---|---|---|---|---|---|---|---|---|---|---|---|---|---|
| (a) NOTE TYPE | PITCH OF NOTE | E4 | | D4 | | E4 | | F4 | | G4 | | C5 | | B4 | | G4 | | E4 | | A4 |
| | No. 0 CHORD PROGRESSION | C | | A | | C | | S | | C | | C | | A | | A | | C | | C |
| | No. 1 CHORD PROGRESSION | C | | A | | C | | S | | A | | C | | A | | A | | A | | C |
| | No. 2 CHORD PROGRESSION | A | | C | | A | | V | | C | | A | | C | | S | | S | | A |
| (b) ADJACENT TONE | PITCH OF NOTE | E4 | | D4 | | E4 | | F4 | | G4 | | C5 | | B4 | | G4 | | E4 | | A4 |
| | ADJACENT TONE | | -2 | | 2 | | 1 | | 2 | | 6 | | -4 | | -1 | | 5 | | -3 | |
| (c) ARRAY VARIABLE DATA ITEM incon[i] OF NOTE TYPES AND ADJACENT TONES | No. 0 CHORD PROGRESSION | C | -2 | A | 2 | C | 1 | S | 2 | C | 6 | C | -1 | A | -4 | A | -3 | C | 5 | C |
| | No. 1 CHORD PROGRESSION | C | -2 | A | 2 | A | 1 | S | 2 | A | 6 | C | -1 | A | -4 | A | -3 | A | 5 | C |
| | No. 2 CHORD PROGRESSION | A | -2 | C | 2 | A | 1 | V | 2 | C | 6 | A | -1 | C | -4 | S | -3 | S | 5 | A |
| | ARRAY NUMBER | 0 | 1 | 2 | 3 | 4 | 5 | 6 | 7 | 8 | 9 | 10 | 11 | 12 | 13 | 14 | 15 | 16 | 17 | 18 |

FIG. 9

| | | j | No. 0 NOTE TYPE | No. 0 ADJACENT TONE | No. 1 NOTE TYPE | No. 1 ADJACENT TONE | No. 2 NOTE TYPE | No. 2 ADJACENT TONE | No. 3 NOTE TYPE | EVALUATION POINT |
|---|---|---|---|---|---|---|---|---|---|---|
| THREE-NOTE | CHORD TONE | 0 | ci_ChordTone | 99 | ci_ChordTone | 99 | ci_ChordTone | 0 | ci_NullNoteType | 100 |
| | NEIGHBORING NOTE | 1 | ci_ChordTone | -1 | ci_AvailableNote | 1 | ci_ChordTone | 0 | ci_NullNoteType | 100 |
| | NEIGHBORING NOTE | 2 | ci_ChordTone | -2 | ci_AvailableNote | 2 | ci_ChordTone | 0 | ci_NullNoteType | 90 |
| | PASSING NOTE | 3 | ci_ChordTone | 1 | ci_ScaleNote | 2 | ci_ChordTone | 0 | ci_NullNoteType | 80 |
| | PASSING NOTE | 4 | ci_ChordTone | 2 | ci_AvailableNote | 2 | ci_ChordTone | 0 | ci_NullNoteType | 100 |
| | APPOGGIATURA | 5 | ci_ChordTone | 99 | ci_AvailableNote | -1 | ci_ChordTone | 0 | ci_NullNoteType | 95 |
| | APPOGGIATURA | 6 | ci_ChordTone | 99 | ci_AvailableNote | -2 | ci_ChordTone | 0 | ci_NullNoteType | 95 |
| | ESCAPE NOTE | 7 | ci_ChordTone | 1 | ci_AvailableNote | 99 | ci_ChordTone | 0 | ci_NullNoteType | 60 |
| | ESCAPE NOTE | 8 | ci_ChordTone | 2 | ci_AvailableNote | 99 | ci_ChordTone | 0 | ci_NullNoteType | 80 |
| FOUR-NOTE | CHORD TONE | 9 | ci_ChordTone | 99 | ci_ChordTone | 99 | ci_ChordTone | 99 | ci_ChordTone | 100 |
| | NEIGHBORING NOTE | 10 | ci_ChordTone | 2 | ci_AvailableNote | -3 | ci_AvailableNote | 1 | ci_ChordTone | 90 |
| | NEIGHBORING NOTE | 11 | ci_ChordTone | 1 | ci_AvailableNote | -3 | ci_AvailableNote | 2 | ci_ChordTone | 80 |
| | PASSING NOTE | 12 | ci_ChordTone | 2 | ci_AvailableNote | 2 | ci_AvailableNote | 2 | ci_ChordTone | 95 |
| | PASSING NOTE | 13 | ci_ChordTone | 2 | ci_AvailableNote | 1 | ci_AvailableNote | 2 | ci_ChordTone | 95 |
| | PASSING NOTE | 14 | ci_ChordTone | -2 | ci_AvailableNote | -2 | ci_AvailableNote | -2 | ci_ChordTone | 95 |
| | PASSING NOTE | 15 | ci_ChordTone | -2 | ci_AvailableNote | -1 | ci_AvailableNote | -2 | ci_ChordTone | 95 |
| | APPOGGIATURA | 16 | ci_ChordTone | 99 | ci_AvailableNote | -3 | ci_AvailableNote | 1 | ci_ChordTone | 70 |
| | APPOGGIATURA | 17 | ci_ChordTone | 99 | ci_AvailableNote | -3 | ci_AvailableNote | 2 | ci_ChordTone | 80 |

VARIABLE NAME : ci_NoteConnect[j][0] ci_NoteConnect[j][1] ci_NoteConnect[j][2] ci_NoteConnect[j][3] ci_NoteConnect[J][4] ci_NoteConnect[j][5] ci_NoteConnect[j][6] ci_NoteConnect[j][7]

FIRST NOTE
SECOND NOTE
THIRD NOTE
FOURTH NOTE
FIFTH NOTE
SIXTH NOTE
SEVENTH NOTE
EIGHTH NOTE
NINTH NOTE
TENTH NOTE
i = 0
i = 1
i = 2
i = 3
i = 4
i = 5
i = 6
i = 7
E D E F G C B G E A
No. 0 CHORD PROGRESSION
C -2 A 2 C 1 S 2 C 6 C -1 A -4 A -3 C 5 C
<- No2:90 ->
<- No.3: 80 ->
No. 1 CHORD PROGRESSION
C -2 A 2 A 1 S 2 C 6 C -1 A -4 A -3 A 5 C
No. 2 CHORD PROGRESSION
A -2 C 2 A 1 V 2 C 6 A -1 C -4 S -3 S 5 A
<- No5: 95 ->

FIG. 11A

| |
|---|
| No. 0 PHRASE SET |
| No. 1 PHRASE SET |
| |
| . |
| . |
| END |

FIG. 11B

| |
|---|
| A MELODY DATA ITEM |
| B MELODY DATA ITEM |
| C MELODY (REFRAIN MELODY) DATA ITEM |
| FIRST ENDING DATA ITEM |
| SECOND ENDING DATA ITEM |

FIG. 11C

| |
|---|
| No. 0 NOTE DATA ITEM |
| No. 1 NOTE DATA ITEM |
| . |
| . |
| . |
| END |

FIG. 11D

| |
|---|
| TIME |
| LENGTH |
| STRENGTH |
| PITCH |

FIG. 15A

| VARIABLE NAME | MEANING |
|---|---|
| n, i, j, k | VARIABLE DATA FOR CONTROLLING REPETITIVE PROCESS |
| MAX_CHORD_PROG | CONSTANT DATA REPRESENTING THE NUMBER OF CHORD PROGRESSION DATA ITEMS |
| iJunleSelect | VARIABLE DATA FOR SELECTING MUSIC GENRE |
| iChordAttribute[n][0] | ARRAY VARIABLE DATA REPRESENTING MUSIC GENRE OF No. n CHORD PROGRESSION |
| iConceptSelect | VARIABLE DATA FOR SELECTING MUSIC CONCEPT |
| iChordAttribute[n][1] | ARRAY VARIABLE DATA REPRESENTING MUSIC CONCEPT OF No. n CHORD PROGRESSION |
| iKeyShift | VARIABLE DATA REPRESENTING KEY SHIFT VALUE |
| PITCH_CLASS_N | CONSTANT DATA REPRESENTING THE NUMBER OF KEY SHIFTS |
| doValue | VARIABLE DATA REPRESENTING MATCHING LEVEL |
| doMaxValue | VARIABLE DATA REPRESENTING MAXIMUM OF MATCHING LEVEL |
| iBestUpdate | VARIABLE DATA INDICATING BEST CHORD PROGRESSION IN n-TH TIME |
| iBestKeyShift[n] | KEY SHIFT VALUE OF BEST CHORD PROGRESSION IN n-TH TIME |
| iBestChordProg[n] | THE NUMBER OF BEST CHORD PROGRESSION IN n-TH TIME |
| iCDesignCnt | VARIABLE DATA REPRESENTING INFORMATION NUMBER IN CHORD PROGRESSION |
| cdesign[iCDesignCnt] | ICDesignCnt-TH CHORD DESIGN DATA |
| cdesign[iCDesignCnt]->iTime | TIME INFORMATION OF CHORD DESIGN DATA |
| cdesign[iCDesignCnt]->iRoot | CHORD ROOT INFORMATION OF CHORD DESIGN DATA |
| cdesign[iCDesignCnt]->iType | CHORD TYPE INFORMATION OF CHORD DESIGN DATA |
| cdesign[iCDesignCnt]->iKey | KEY INFORMATION OF CHORD DESIGN DATA |
| cdesign[iCDesignCnt]->iScale | SCALE INFORMATION OF CHORD DESIGN DATA |
| mt | POINTER VARIABLE DATA INDICATING META-EVENT |
| root, type, scale, key | VARIABLE DATA REPRESENTING CHORD ROOT, CHORD TYPE, SCALE, AND KEY |

(CONT.)

(FIG. 15A CONTINUED)

| | |
|---|---|
| sTime | VARIABLE DATA REPRESENTING MEASURE START TIME |
| iNoteCnt | VARIABLE DATA REPRESENTING NOTE NUMBER OF TONE SEQUENCE |
| me, me->iTime | POINTER VARIABLE DATA INDICATING NOTE AND TIME ITEM THEREOF |
| notes[iNoteCnt] | NOTE POINTER ARRAY VARIABLE DATA |
| iPit | NOTE PITCH ITEM VALUE |
| ipit[i] | PITCH INFORMATION SEQUENCE ARRAY VARIABLE DATA |
| incon[i x 2], incon[i x 2 - 1] | ARRAY VARIABLE DATA OF NOTE TYPES AND ADJACENT TONES OF i-TH NOTE |
| pcs1 | VARIABLE DATA WHICH STORES CHORD TONE PITCH CLASS SET |
| pcs2 | VARIABLE DATA WHICH STORES TENSION TONE PITCH CLASS SET |
| pcs3 | VARIABLE DATA WHICH STORES SCALE TONE PITCH CLASS SET |
| pc1, pc2 | VARIABLE DATA REPRESENTING CANDIDATE PITCH CLASSES Nos. 1 AND 2 |
| ci_ChordTone | CONSTANT DATA REPRESENTING CHORD TONE |
| ci_AvailableNote | CONSTANT DATA REPRESENTING AVAILABLE NOTE |
| ci_ScaleNote | CONSTANT DATA REPRESENTING SCALE NOTE |
| ci_TensionNote | CONSTANT DATA REPRESENTING TENSION NOTE |
| ci_AvoidNote | CONSTANT DATA REPRESENTING AVOID NOTE |
| iTotalValue | VARIABLE DATA REPRESENTING TOTAL EVALUATION POINTS |
| iValue | VARIABLE DATA REPRESENTING EVALUATION POINTS |
| iMaxValue | VARIABLE DATA REPRESENTING MAXIMUM EVALUATION POINTS |
| ci_NoteConnect[j][k x 2]<br>ci_NoteConnect[i][k x 2 - 1] | k-TH ELEMENT OF j–TH NOTE CONNECTION RULE |

FIG. 15B

| VARIABLE NAME | MEANING |
|---|---|
| iMelodyA[0] ~ iMelodyA [ iLengthA-1] | PITCH SEQUENCE ARRAY VARIABLE DATA OF PHRASES RETAINED IN MOTIF DB |
| iMelodyB[0] ~ iMelodyB [ iLengthB-1] | PITCH SEQUENCE OF INPUT MOTIF |
| iLengthA | PITCH SEQUENCE LENGTH VARIABLE DATA OF PHRASES RETAINED IN MOTIF DB |
| iLengthB | PITCH SEQUENCE LENGTH VARIABLE DATA OF INPUT MOTIF |
| doDistance | VARIABLE DATA REPRESENTING DISTANCE EVALUATION VALUE |
| doMin | VARIABLE DATA REPRESENTING MINIMUM DISTANCE EVALUATION VALUE |
| iBestMochief | VARIABLE DATA REPRESENTING BEST PHRASE SET |
| MAX_NOTE_CANDIDATE | THE NUMBER OF DIFFERENT PITCH CANDIDATES FOR CERTAIN NOTE |
| iWnum | THE NUMBER OF DIFFERENT PITCH CANDIDATES FOR EVERY NOTE OF TONE SEQUENCE |
| ipitd [ ] | DIFFERENT PITCH CANDIDATE FOR CERTAIN NOTE (DIFFERENCE) |
| ipitdev | VARIABLE DATA REPRESENTING PITCH CORRECTION VALUE |
| iCnt | VARIABLE DATA FOR COUNTING DIFFERENT PITCH CANDIDATES |
| iMaxValue | VARIABLE DATA REPRESENTING BEST MATCHING LEVEL |
| iMaxCnt | VARIABLE DATA REPRESENTING BEST COUNTER |

AUTOMATIC COMPOSITION APPARATUS, AUTOMATIC COMPOSITION METHOD AND STORAGE MEDIUM

CROSS-REFERENCE TO RELATED APPLICATION

This application is based upon and claims the benefit of priority from the prior Japanese Patent Application No. 2014-235235, filed on Nov. 20, 2014, and the entire contents of which are incorporated herein by reference.

BACKGROUND OF THE INVENTION

1. Field of the Invention

The present invention relates to an automatic composition apparatus, an automatic composition method and a storage medium.

2. Description of the Related Art

There is known a technology for automatically compose music based on a motif melody consisting of a plurality of note data items. In the related art, for example, the following technology is known (for example, a technology disclosed in JP-A-2002-032080). If a certain chord progression is selected from a database retaining chord progressions of a specific key, and a motif is input in a certain key, a motif key is detected from the input motif. Based on the detected motif key, data on the chord progression is transposed into the motif key. Then, in a melody generating block, based on the input motif and the chord progression after the transposition into the motif key, a melody is generated in the motif key. Also, the motif is transposed into the specific key based on the detected motif key, and a melody of the specific key is generated based on the chord progression of the specific key and the transposed motif, and then is transposed into a melody of the motif key.

Also, in the related art, the following technology is known (for example, a technology disclosed in JP-A-H10-105169). Notes having lengths equal to or greater than that of a quarter note are extracted from musical performance data for karaoke and guide melody data which are music data, and the distributions of frequencies of the pitch names (C to B) of the extracted notes are aggregated. The frequency distributions are compared to a major judgment scale and a minor judgment scale. Then, the data is judged to have a key in which the tonic note (scale note) exists at a place where the highest coincidence in distribution shape is attained. Subsequently, based on the result of the key judgment and the guide melody data, harmony data is generated. Then, based on the harmony data, a harmony voice signal is produced.

However, the above described technologies according to the related art are examples in which some essences are extracted from a motif and are modified. In general, motif melodies are similar to refrain melodies. Therefore, some times, motif melodies and refrain melodies have common features. However, motif melodies and refrain melodies often do not have common features. That is, motifs and melodies are often generated according to independent creative intentions, respectively. Therefore, if refrain melodies are automatically generated based on motifs by constraint, like in the technologies according to the related art, it is often impossible to obtain melodies natural in general meaning.

Meanwhile, in the related art, it is also known a technology for inputting both a motif and a refrain melody, thereby automatically generating a piece of music. However, since the input method and the like are complicated, this technology is not appropriate as a method for enabling beginners to easily enjoy music composition.

SUMMARY OF THE INVENTION

An object of the present invention is to make it possible to automatically generate a melody natural in the contrast between a motif and a refrain melody.

According to an aspect, an automatic composition apparatus includes a processing unit. The processing unit performs a receiving process of receiving a phrase including a plurality of note data items as a received motif and receiving a type of the phrase, a retrieving process of retrieving a phrase set from a phrase set database and a melody generating process of generating a melody based on the retrieved phrase set. The phrase set includes phrases having the same type as the received type and having relatively high matching levels for the received motif. The phrase set database stores a plurality of phrase sets each of which is a combination of a plurality of phrases of different types.

BRIEF DESCRIPTION OF THE DRAWING

FIGS. 4A and 4B are views illustrating an example of the data configuration of the input motif.

FIGS. 5A, 5B, 5C and 5D are views illustrating an example of the data configuration of an accompaniment/chord-progression DB.

FIG. 6 is a view illustrating an example of the data configuration of music structure data which is included in one record.

FIGS. 7A, 7B and 7C are views illustrating an example of the data configuration of a standard pitch class set table.

FIG. 8 is an explanatory view related to note types, adjacent tones, and array variable data of the note types and the adjacent tones.

FIG. 9 is a view illustrating examples of the data configurations of note connection rules.

FIGS. 11A, 11B, 11C and 11D are views illustrating an example of the data configuration of a phrase set DB.

FIG. 15A is a view illustrating a list of various variable data, various array variable data, and various constant data.

FIG. 15B is another view illustrating the list of various variable data, various array variable data, and various constant data.

DETAILED DESCRIPTION OF THE PREPARED EMBODIMENT

Figure 1:
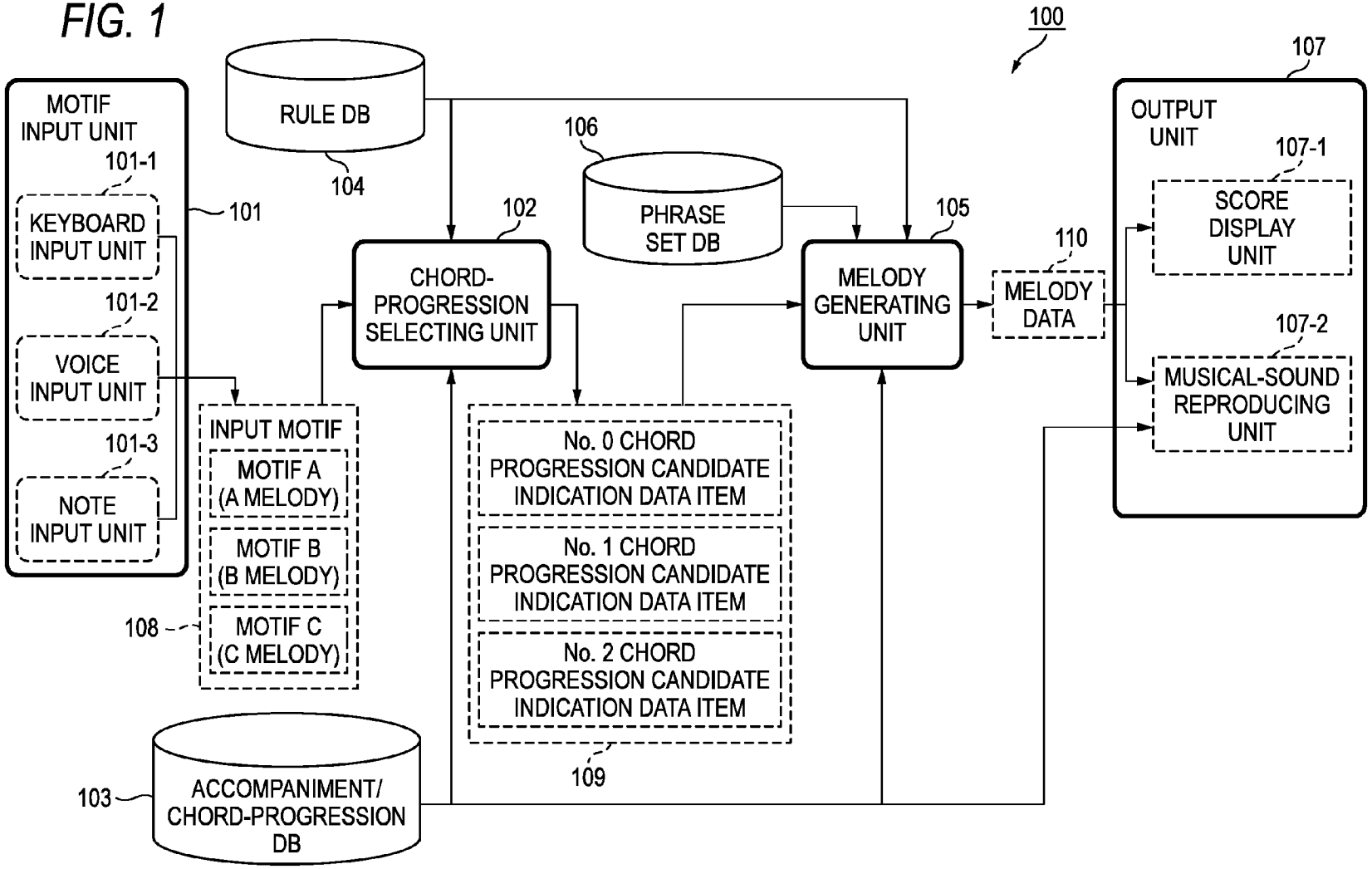
FIG. 1 is a block diagram illustrating an embodiment of an automatic composition apparatus.

Hereinafter, an embodiment of the present invention will be described in detail with reference to the accompanying drawings. FIG. 1 is a block diagram illustrating an embodiment of an automatic composition apparatus 100. The automatic composition apparatus 100 includes a motif input unit 101, a chord-progression selecting unit 102, an accompaniment/chord-progression database (hereinafter, referred to as "DB") 103, a rule DB 104, a melody generating unit 105, a phrase set DB 106, and an output unit 107.

The motif input unit 101 receives any one of characteristic melody parts to define a tune, such as an A melody, a B melody, and a C melody (a refrain melody), as an input motif 108, from a user. The input motif 108 is any one of a motif A which is the motif of an A melody, a motif B which is the motif of a B melody, and a motif C which is the motif of a C melody, and has, for example, the length of two measures of the beginning of each melody part. The motif input unit 101 includes, for example, one or more means of a keyboard input unit 101-1 for receiving a melody through a keyboard from the user, a voice input unit 101-2 for receiving a melody which the user sings, through a microphone, and a note input unit 101-3 for receiving data on notes constituting a melody through a keyboard or the like from the user. Also, the input unit 101 includes independent operation units for receiving motif types such as "A MELODY", "B MELODY", "C MELODY (REFRAIN MELODY)", and so on.

With respect to each of a plurality of chord progression data items retained in the accompaniment/chord-progression DB 103, the chord-progression selecting unit 102 calculates the matching level representing how much the corresponding chord progression data item is suitable for the input motif 108 input from the motif input unit 101 while referring to the rule DB 104, and outputs, for example, Nos. 0, 1, and 2 chord progression candidate indication data items (each of which is referred to as "CHORD PROGRESSION CANDIDATE" in FIG. 1) 109 indicating chord progression data items of the top three matching levels, respectively.

The melody generating unit 105 prompts, for example, the user to select one of three chord progression candidates corresponding to Nos. 0, 1, and 2 chord progression candidate indication data items 109 output from the chord-progression selecting unit 102. Alternatively, the melody generating unit 105 may automatically select a chord progression candidate corresponding to any one of Nos. 0, 1, and 2 chord progression candidate indication data items 109, in turns. As a result, the melody generating unit 105 reads a music structure data item corresponding to the selected chord progression candidate, from the accompaniment/chord-progression DB 103. With respect to each of the phrases of measures represented by the read music structure data item, the melody generating unit 105 automatically generates a melody of the corresponding phrase with reference to the input motif 108, phrase sets registered in the phrase set DB 106, and the rule DB 104. The melody generating unit 105 performs an automatic melody generation process with respect to every measure of the whole music, and outputs the automatically generated melody data 110.

The output unit 107 includes a score display unit 107-1 which displays a melody score based on the melody data 110 automatically generated by the melody generating unit 105, and a musical-sound reproducing unit 107-2 which performs reproducing of a melody and accompaniment based on the melody data 110 and MIDI (Musical Instrument Digital Interface) data for accompaniment acquired from the accompaniment/chord-progression DB 103.

Figure 2:
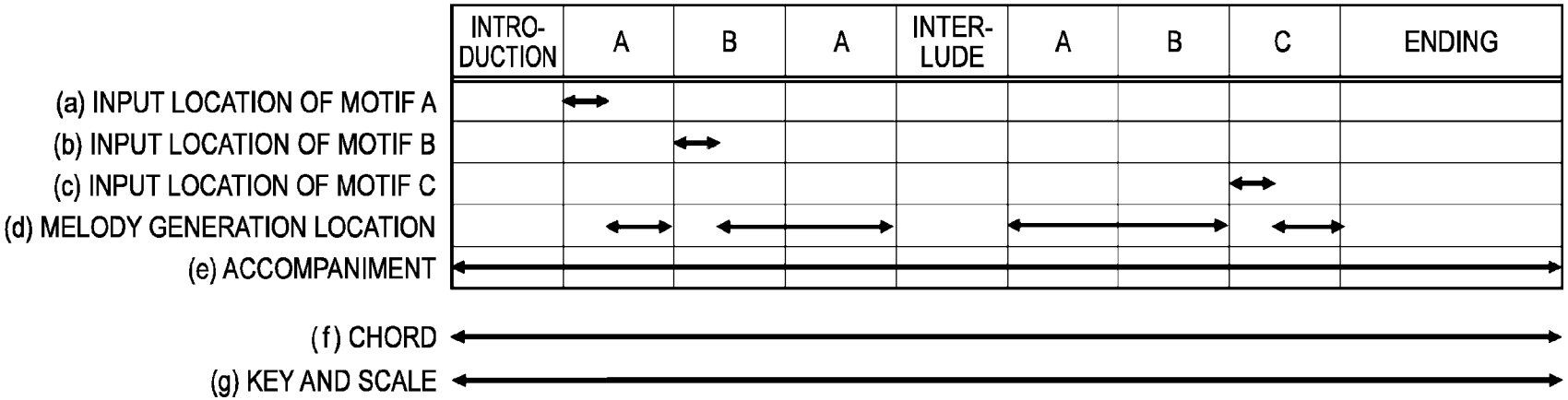
FIG. 2 is a view illustrating an example of the structure of a piece of music which is automatically composed according to the embodiment.

Subsequently, the outline of an operation of the automatic composition apparatus 100 having the functional configuration of FIG. 1 will be described. FIG. 2 is a view illustrating an example of the structure of a piece of music which is automatically composed in the present embodiment. A piece of music is composed of phrases such as an introduction, an A melody, a B melody, an interlude, a C melody (a refrain melody), and an ending. The introduction is a prelude part which precedes a melody and is composed of only accompaniment. The A melody generally means a phrase next to the introduction, and is generally a calm melody. The B melody means a phrase next to the A melody, and is likely to become a tune more exciting than the A melody. The C melody is likely to be a phase next to the B melody. In Japanese music, the C melody is likely to be a refrain melody. On the contrary to the introduction, the ending means the ending phase of the piece of music. The interlude is, for example, a phrase for only musical instrument performance without any melody between two sections of the piece of music. In the music structure example shown in FIG. 2, a piece of music is composed in the order of an introduction, an A melody, a B melody, another A melody, an interlude, another A melody, another B melody, a C melody, and an ending.

In the present embodiment, the user can input, for example, the melody of two measures of the beginning of, for example, an A melody appearing for the first time in a piece of music, as a motif A (which is an example of the input motif 108 of FIG. 1) of Part (a) of FIG. 2, from the motif input unit 101 (see FIG. 1). Alternatively, the user can input, for example, the melody of two measures of the beginning of, for example, a B melody appearing for the first time in a piece of music, as a motif B (which is another example of the input motif 108 of FIG. 1) of Part (b) of FIG. 2, from the motif input unit 101 (see FIG. 1). Alternatively, the user can input, for example, the melody of two measures of the beginning of, for example, a C melody appearing for the first time in a piece of music, as a motif C (which is another example of the input motif 108 of FIG. 1) of Part (c) of FIG. 2, from the motif input unit 101 (see FIG. 1).

Figures 3A, 3B:
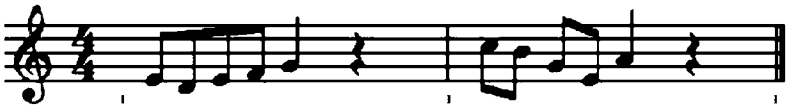
FIGS. 3A and 3B are views illustrating an example of an operation of checking the matching levels of chord progression data items for an input motif 108.

FIG. 3A is a view illustrating an example of notes of the input motif 108 which is input in the above described way. As described above, as the input motif 108, for example, a melody of two measures is designated.

With respect to this input, the chord-progression selecting unit 102 (see FIG. 1) extracts, for example, the top three chord progression data items each of which is composed of a chord, a key, and a scale appropriate for the input, from the chord progression data items registered in the accompaniment/chord-progression DB 103. Chords, keys, and scales which constitute chord progression data items are set over the whole piece of music as shown in Parts (f) and (g) of FIG. 2.

FIG. 3B is a view illustrating examples of Nos. 0, 1, and 2 chord progressions (chords, keys, and scales) which are represented by the top three chord progression data items.

The melody generating unit 105 of FIG. 1 automatically generates melodies corresponding to phase parts of Part (d) of FIG. 2 other than the phase part of any one of Part (a), (b), or (c) of FIG. 2 received by the input motif 108, based on those information items, and outputs the generated melodies together with the melody of the input motif 108, as the melody data 110. Then, the output unit 107 of FIG. 1 performs score display or sound emission corresponding to the automatically generated melody data 110. Also, with respect to accompaniment, MIDI data items for accompaniment registered in the accompaniment/chord-progression DB 103 in association with a finally selected chord progression are sequentially read. Based on the read MIDI data items, accompaniment is performed over the whole piece of music as shown in Part (e) of FIG. 2.

FIG. 4 is a view illustrating an example of the data configuration of the input motif 108 which the motif input unit 101 of FIG. 1 generates based on the user's input. As shown in FIG. 4A, the input motif 108 is composed of a plurality of note data items having Nos. 0, 1, . . . , and an end code is stored finally. The individual note data items are data items which correspond to, for example, the notes of two measures constituting, for example, the input motif 108 exemplified in FIG. 3A, respectively, and instructs production of a melody sound which becomes a motif. As shown in FIG. 4B, one note data item is composed of "TIME" data which represents the sound production timing of a note corresponding to that note data item, for example, by an elapsed time from the beginning of the input motif 108, "LENGTH" data representing the length of the note, "STRENGTH" data representing the strength of the note, and "PITCH" data representing the pitch of the note. Theses data represent one note of the input motif 108 corresponding to two measures and exemplified in FIG. 3A.

FIG. 5 is a view illustrating an example of the data configuration of the accompaniment/chord-progression DB 103 of FIG. 1. As shown in FIG. 5A, in a chord progression DB, a plurality of records such as No. 0 record and No. 1 record each of which (one row of FIG. 5A) is composed of a chord progression data item, a MIDI data item for accompaniment, and a music structure data item is stored, and an end code is finally stored.

In one record, the chord progression data item represents a chord progression corresponding to a melody of a piece of music. The chord progression DB shown in FIG. 5A retains, for example, fifty records, that is, chord progression data items corresponding to fifty pieces of music. As shown in FIG. 5B, the chord progression data item of one record (corresponding to one piece of music) is composed of a plurality of chord data items such as No. 0 chord data item and No. 1 chord data item and an end code which is stored finally. In a chord data item, there are a data item (FIG. 5C) which designates a key and a scale at a certain timing, and a data item (FIG. 5D) which designates a chord at a certain timing (see FIG. 3B). Each data item which designates a key and a scale is composed of "TIME" data representing the start timing of the corresponding key and scale, "KEY" data, and "SCALE" data, as shown in FIG. 5C. Each data item which designates a chord is composed of "TIME" data representing the start timing of the corresponding chord, "ROOT" data representing the root of the chord, and "TYPE" data representing the type of the chord, as shown in FIG. 5D. Each chord progression data item is stored, for example, as meta data of the MIDI standard.

The music structure data item of one record (corresponding to one piece of music) of the accompaniment/chord-progression DB 103 shown in FIG. 5A has a data configuration shown as an example in FIG. 6. The music structure data item forms one record (one row of FIG. 6) for each measure of one piece of music. In one record of the music structure data item, information representing the type of a phrase corresponding to the corresponding measure and whether there is any melody in the corresponding phrase is stored.

In the music structure data item shown in FIG. 6, in a "Measure" item, a value representing what number of measure data of a corresponding record corresponds to is registered. Hereinafter, a record in which the value of the "Measure" item is M will be referred to as No. M record, and a measure which the corresponding record represents will be referred to as No. (M+1) measure. For example, in a case where the value of the "Measure" item is 0, a corresponding record is No. 0 record/No. 1 measure, and in a case where the value of the "Measure" item is 1, a corresponding record is No. 1 record/No. 2 measure.

In the music structure data item shown in FIG. 6, in a "PartName[M]" item and a "iPartID[M]" item (wherein "M" is the value of the "Measure" item), data representing the type of the phrase of No. M record/No. (M+1) measure and an identification value corresponding to that type are registered, respectively. For example, the values "Null" and "0" of the "PartName[M]" item and the "iPartID[M]" item of No. 0 record (No. 1 measure) represent that the corresponding measure is soundless. The values "Intro" and "1" of the "PartName[M]" item and the "iPartID[M]" item of each of Nos. 1 and 2 records (Nos. 2 and 3 measures) represent that the corresponding measure is an introduction phrase. The values "A" and "11" of the "PartName[M]" item and the "iPartID[M]" item of each of Nos. 3 to 10 records and Nos. 28 to 34 records (Nos. 4 to 11 measures and Nos. 29 to 35 thirty fifth measures) represent that the corresponding measure is an A melody phrase. The values "B" and "12" of the "PartName[M]" item and the "iPartID[M]" item of each of Nos. 11 to 18 records (Nos. 12 to 19 measures) represent that the corresponding measure is a B melody phrase. The values "C" and "13" of the "PartName[M]" item and the "iPartID [M]" item of each of Nos. 19 to 27 records (Nos. 20 to 28 measures) represent that the corresponding measure is a C melody phrase. The values "Ending" and "3" of the "PartName[M]" item and the "iPartID[M]" item of No. 35 record (No. 36 measure) represent that the corresponding measure is an ending phrase.

Also, in the music structure data item shown in FIG. 6, in an "ExistMelody[M]" item (wherein "M" is the value of the "Measure" item), a value representing whether any melody exists in the phrase of No. M record (No. (M+1) measure) is registered. If a melody exists, a value "1" is registered; whereas if any melody does not exist, a value "0" is registered. For example, in the "ExistMelody[M]" item of each phrase where the "PartName[M]" item (wherein "M" is 0, 1, 2, or 35) (No. 0, 1, 2, or 35 record (No. 1, 2, 3, or 36 measure)) is "Null", "Intro", or "Ending", a value "0" representing that any melody does not exist is registered. In a case where the "PartName[M]" item is "Null", a corresponding phrase is soundless, and in a case where the "PartName[M]" item is "Intro" or "Ending", only accompaniment exists.

Also, in the music structure data item shown in FIG. 6, in the "iPartTime[M]" item (wherein "M" is the value of the "Measure" item), data on the measure start time of No. (M+1) measure corresponding to the No. M record is registered. Although sections of FIG. 6 for the "iPartTime [M]" item are blank, in each record, an actual time value is stored.

The music structure data item shown in FIG. 6 and described above is stored as meta data of the MIDI standard.

As described above with reference to FIG. 2, the user can input, for example, the melodies of Nos. 3 and 4 records (Nos. 4 and 5 measures) which are two measures of the beginning of, for example, the A melody appearing for the first time in the music structure data item of FIG. 6, as the motif A (see FIG. 2), from the motif input unit 101 (see FIG. 1). Alternatively, the user can input, for example, the melodies of Nos. 11 and 12 records (Nos. 12 and 13 measures) which are two measures of the beginning of, for example, the B melody appearing for the first time in the music structure data item of FIG. 6, as the motif B (see Part (b) of FIG. 2), from the motif input unit 101. Alternatively, the user can input, for example, the melodies of Nos. 19 and 20 records (Nos. 20 and 21 measures) which are two measures of the beginning of, for example, the C melody appearing for the first time in the music structure data item of FIG. 6, as the motif C (see Part (c) of FIG. 2), from the motif input unit 101.

With respect to each of the chord progression data items (hereinafter, referred to as evaluation target chord progression data items) retained in the accompaniment/chord-progression DB 103, the chord-progression selecting unit 102 calculates the matching level representing how much the corresponding evaluation target chord progression data item is suitable for the input motif 108 input from the motif input unit 101.

In the present embodiment, the chord-progression selecting unit calculates the matching level of each evaluation target chord progression data item for the input motif 108, using the available note scale concept of music theory. An available note scale represents notes available for melodies, as a scale, in a case where chord progressions are given. Examples of the types of notes (hereinafter, referred to as "note types") constituting an available note scale include "CHORD TONE", "AVAILABLE NOTE", "SCALE NOTE", "TENSION NOTE", and "AVOID NOTE". A chord tone is a chord constituent note which becomes a scale source, and is a note type in which it is preferable to use one note as a melody. An available note is a note type which is generally usable in melodies. A scale note is a scale constituent note and is a note type which needs to be carefully handled because if the corresponding note is applied as a long sound or the like, it clashes with an original chord sound. A tension note is a note which is superimposed on a chord sound and is used as a tension of a chord, and is a note type in which a tension increases, a feeling of tension of a sound or a sound becomes richer. An avoid note is a note which is not harmonic with a chord, and is a note type in which it is preferable to avoid use of the corresponding note or to use the corresponding note as a short note. In the present embodiment, with respect to each note (each note of FIG. 3A) constituting the input motif 108, based on the key, the scale, the chord root, and the chord type included in a chord progression data item which is an evaluation target corresponding to the sound production timing of the corresponding note, the note type in a chord progression corresponding to the corresponding note is calculated.

In order to obtain the note type of each note (each note of FIG. 3A) constituting the input motif 108 as described above, in the present embodiment, a standard pitch class set table is used. FIG. 7 is a view illustrating an example of the data configuration of the standard pitch class set table. The standard pitch class set table is located in a memory area of the chord-progression selecting unit 102 (for example, in a ROM 1402 of FIG. 4 to be described below). The standard pitch class set table is composed of a chord tone table exemplified in FIG. 7A, a tension note table exemplified in FIG. 7B, and a scale note table exemplified in FIG. 7C.

In the table of FIGS. 7A, 7B and 7C, a pitch class set corresponding to one row thereof is composed of total twelve bit data items which each are set to a value "0" or "1" with respect to scale constituent notes which are No. 0 note (No. 0 bit) (the right end of the row of the drawing) to No. 11 note (No. 11 bit) (the left end of the row of the drawing) constituting a chromatic scale corresponding to one octave in a case where a chord or a scale root is set as No. 0 note (No. 0 bit) which is a scale constituent note. In one pitch class set, a scale constituent note having the value "1" represents that the corresponding note is included in the constituent elements of the pitch class set, and a scale constituent note having the value "0" represents that the corresponding note is not included in the constituent elements of the pitch class set.

The pitch class set (hereinafter, referred to as the "chord tone pitch class set") corresponding to each row of the chord tone table of FIG. 7A stores what scale constituent note is a chord constituent note of a chord type written at the right end of the corresponding pitch class set set, with respect to the corresponding chord type, in a case where a corresponding chord root is given as the scale constituent note which is No. 0 note (No. 0 bit). For example, in the first row of the chord tone table exemplified in FIG. 7A, a chord tone pitch class set "000010010001" represents that the scale constituent notes of No. 0 note (No. 0 bit), No. 4 note (No. 4 bit), and No. 7 note (No. 7 bit) are chord constituent notes of a chord type "MAJ".

With respect to each note (hereinafter, referred to as a "current note") constituting the input motif 108, the chord-progression selecting unit 102 of FIG. 1 calculates what tone (hereinafter, referred to as "chord tone") the pitch of the current note has with respect to the chord root of an evaluation target chord progression data item corresponding to the sound production timing of the current note. In this case, the chord-progression selecting unit 102 performs a calculation of mapping the pitch of the current note to any one of the scale constituent notes from No. 0 note to No. 11 note included in one octave in a case where the chord root described in the evaluation target chord progression data item corresponding to the sound production timing of the current note is set as the scale constituent note of No. 0 note, thereby calculating the note of the mapped location (any one of No. 0 note to No. 11 note) as the above described chord tone. Thereafter, the chord-progression selecting unit 102 determines whether the calculated chord tone is included in the chord constituent notes of the chord tone pitch class set on the chord tone table exemplified in FIG. 7A and corresponding to the chord type described in the chord progression data item which is the evaluation target corresponding to the above described sound production timing.

Each pitch class set (hereinafter, referred to as a "tension note pitch class set") corresponding to one row of the tension note table of FIG. 7B stores what scale constituent note is a tension for a chord type described at the right end of the corresponding row, with respect to the corresponding chord type, in a case where a corresponding chord root is set to the scale constituent note of No. 0 note (No. 0 bit). For example, in the first row of the tension note table exemplified in FIG. 7B, a tension note pitch class set "001001000100" represents that No. 2 note (No. 2 bit), No. 6 note (No. 6 bit), and No. 9 note (No. 9 bit) are tensions for the chord type "MAJ" (wherein the chord root is "C").

The chord-progression selecting unit 102 of FIG. 1 determines whether a chord tone for the chord root of the pitch of the current note described above is included in tension notes of the tension note pitch class set of the tension note table exemplified in FIG. 7B and corresponding to the chord type in the chord progression data item which is the evaluation target corresponding to the sound production timing of the current note.

Each pitch class set (hereinafter, referred to as a "scale note pitch class set") corresponding to one row of the scale note table of FIG. 7C stores what scale constituent note is a scale constituent note corresponding to a scale described at the right end thereof, with respect to the corresponding scale, in a case where a corresponding scale root is set to the scale constituent note of No. 0 note (No. 0 bit). For example, in the first row of the scale note table exemplified in FIG. 7C, a scale note pitch class set "101010110101" represents that No. 0 note (No. 0 bit), No. 2 note (No. 2 bit), No. 4 note (No. 4 bit), No. 5 note (No. 5 bit), No. 7 note (No. 7 bit), No. 9 note (No. 9 bit), and No. 11 note (No. 11 bit) are scale constituent notes of a scale "DIATONIC".

The chord-progression selecting unit 102 of FIG. 1 calculates what tone (hereinafter, referred to as "key tone" the pitch of the current note has with respect to a key described in the chord progression data item which is the evaluation target corresponding to the sound production timing of the current note. In this case, similarly to the case of the chord tone calculation, the chord-progression selecting unit 102 performs a calculation of mapping the pitch of the current note to any one of the scale constituent notes from No. 0 note to No. 11 note included in one octave in a case where the key described in the chord progression data item which is the evaluation target corresponding to the sound production timing of the current note is set to the scale constituent note of No. 0 note, thereby calculating a note of the mapped location (any one of No. 0 note to No. 11 note) as the above described key tone. Thereafter, the chord-progression selecting unit 102 determines whether the calculated key tone is included in the scale constituent notes of the scale note pitch class set on the scale note table exemplified in FIG. 7C and corresponding to the chord type described in the chord progression data item which is the evaluation target corresponding to the above described sound production timing.

In the above described way, the chord-progression selecting unit 102 determines whether any chord tone is included in the chord constituent notes of the chord tone pitch class set corresponding to the chord type described in the chord progression data item which is the evaluation target corresponding to the sound production timing of the current note of the input motif 108. Also, the chord-progression selecting unit 102 determines whether any chord tone is included in the tension notes of the tension note pitch class set of the tension note table exemplified in FIG. 7B and corresponding to the above described chord type. Further, the chord-progression selecting unit 102 determines whether any key tone is included in the scale constituent notes of the scale note pitch class set of the scale note table exemplified in FIG. 7C and corresponding to the scale described in the chord progression data item which is the evaluation target. Thereafter, based on those determinations, the chord-progression selecting unit 102 obtains information on which of a chord tone, an available note, a scale note, a tension note, and an avoid note the current note corresponds to, that is, note type information. Details of the note-type acquiring process will be described below with reference to FIG. 22.

Part (a) of FIG. 8 is a view illustrating examples of note types which the chord-progression selecting unit 102 obtains with respect to examples Nos. 0, 1, and 2 chord progression data items which are evaluation targets read from the accompaniment/chord-progression DB 103 of FIG. 1 and exemplified in FIG. 3B, for the pitch (a gray part of Part (a) of FIG. 8) of each note of the input motif 108 exemplified in FIG. 3A. In Part (a) of FIG. 8, "C", "A", "S", and "V" are values representing the note types of a chord tone, an available note, a scale note, and an avoid note, respectively. Also, although not shown, "T" is a value representing the note type of a tension note. Also, in Part (a) of FIG. 8, in order for notation simplification, each of the values representing the note types is denoted by one alphabet. However, as the individual note type values which are actually stored, for example, "ci_ChordTone" (equivalent to the notation "C") can be used as a constant value representing a chord tone, "ci_AvailableNote" (equivalent to the notation "A") can be used as a constant value representing an available note, "ci_ScaleNote" (equivalent to the notation "S") can be used as a constant value representing a scale note, "ci_TensionNote" (equivalent to the notation "T") can be used as a constant value representing a tension note, and "ci_AvoidNote" (equivalent to the notation "V") can be used as a constant value representing an avoid note (see FIG. 15A to be described below).

Subsequently, with respect to each of the pitches of the individual notes of the input motif 108, the chord-progression selecting unit 102 calculates semitones (hereinafter, referred to as adjacent tones between the corresponding pitch and an adjacent pitch. Adjacent tones of Part (b) of FIG. 8 are examples of calculation results of tones between the pitches of the individual notes of the input motif 108 (a gray part of Part (b) of FIG. 8).

With respect to each chord progression data item which is an evaluation target, the chord-progression selecting unit 102 generates an array variable data item (which is hereinafter denoted by "incon[i]" wherein "i" is an array number) alternately containing note types and adjacent tones calculated as described. Part (c) of FIG. 8 is a view illustrating examples of array variable data items incon[i] calculated with respect to examples of Nos. 0, 1, and 2 chord progression data items which are three evaluation targets read from the accompaniment/chord-progression DB 103 of FIG. 1 and exemplified in FIG. 3B. In Nos. 0, 1, and 2 array variable data items incon[i] of Part (c) of FIG. 8, in individual elements whose array numbers i are even numbers 0, 2, 4, 6, 8, 10, 12, 14, 16, or 18, the note types of Nos. 0, 1, and 2 chord progressions of Part (a) of FIG. 8 are copied sequentially from the beginning. Also, in the array variable data items incon[i] of Nos. 0, 1, and 2 chord progressions, in individual elements whose array numbers i are odd numbers 1, 3, 5, 7, 9, 11, 13, 15, or 17, the adjacent tones of Part (b) of FIG. 8 are subsequently copied.

Subsequently, with respect to an array variable data item incon[i] (wherein, "i" is 0, 1, 2, 3 . . . ) containing the note types of the individual notes of the input motif 108 and the adjacent tones calculated in the above described way for a chord progression data item which is a current evaluation target, the chord-progression selecting unit 102 performs a note-connectivity checking process of evaluating a rule of combination of note types and adjacent tones (hereinafter, this rule will be referred to as the note connection rule), sequentially from the array number "0", for example, for every four sets. In this note-connectivity checking process, the chord-progression selecting unit 102 refers to note connection rules retained in the rule DB 104 of FIG. 1.

FIG. 9 is a view illustrating an example of the data configuration of the note connection rules stored in the rule DB 104. The note connection rules include three-note rules and four-note rules, which are given names, for example, "chord tone" "neighboring note", "passing tone", "appoggiatura", "escape note", and the like. Also, each note connection rule is given an evaluation point for evaluating how much the corresponding rule is appropriate for forming a melody. Further, in the present embodiment, array variable data items including "ci_NoteConnect[j][2k]" ($0 \le k \le 3$) and "ci_NoteConnect[j][2k+1]" ($0 \le k \le 2$) as variables representing note connection rules. Here, a variable data item [j] indicates No. j (No. j row in FIG. 9) note connection rule data item of the rule DB 104. Also, a variable data item [k] takes any one of values 0 to 3. Further, in items ci_NoteConnect[j][2k], that is, ci_NoteConnect[j][0], ci_NoteConnect[j][2], ci_NoteConnect[j][4], and ci_NoteConnect[j][6], the note types (Nos. 0 to 3 note types) of Nos. 1 to 4 notes of the j-th note connection rule are stored, respectively. Also, No. 0 to 8 note connection rules in which No. 4 notes (No. 3 note types) are "ci_NullNoteType" represent that the note types of No. 4 notes do not exist, and the corresponding note connection rules each are substantially composed of three notes. Also, in items ci_NoteConnect[j][2k+1], that is, ci_NoteConnect[j][1], ci_NoteConnect[j][3], and ci_NoteConnect[j][5], the adjacent tone of the first note (No. 0) and the second note (No. 1) of the j-th note connection rule, the adjacent tone of the second note (No. 1) and the third note (No. 2), and the adjacent tone of the third note (No. 2) and the fourth note (No. 3) are stored, respectively. The numerical values of the adjacent tones represent semitones, and a positive value represents that a tone rises, and a negative value represents that a tone lowers. Also, a value "99" represents that a tone can have any value, and a value "0" represents that a tone does not change. Also, since No. 0 to 8 note connection rules in which No. 4 notes (No. 3 note types) are "ci_NullNoteType" represent that the note types of No. 4 notes do not exist (their values are "ci_NullNoteType" as described above, the value of an item "ci_NoteConnect[j][5]" where the adjacent tone of the third note (No. 2) and the fourth note (No. 3) becomes "0". In the final item "ci_NoteConnect[j][7]", the evaluation point of the j-th note connection rule is stored.

As note connection rules having the above described data configuration, eighteen rules having j values 0 to 17 as exemplified in FIG. 9 are registered in advance in the rule DB 104 of FIG. 1.

The chord-progression selecting unit 102 performs the note-connectivity checking process using the note connection rules having the above described configuration. Sequentially from the beginning note of the input motif 108 corresponding to two measures and exemplified in FIG. 10A, with respect to every four notes as shown by "i" values of 0 to 6 in FIG. 10B, the chord-progression selecting unit 102 compares a set of note types and adjacent tones stored in associated with the corresponding notes in the array variable data item incon[i] with a set of note types and adjacent tones of a set of note connection rules selected subsequently from a rule having a j value "0" from the note connection rules having j values "0" to "17", thereby they coincide with each other.

Figures 10A, 10B, 10C:
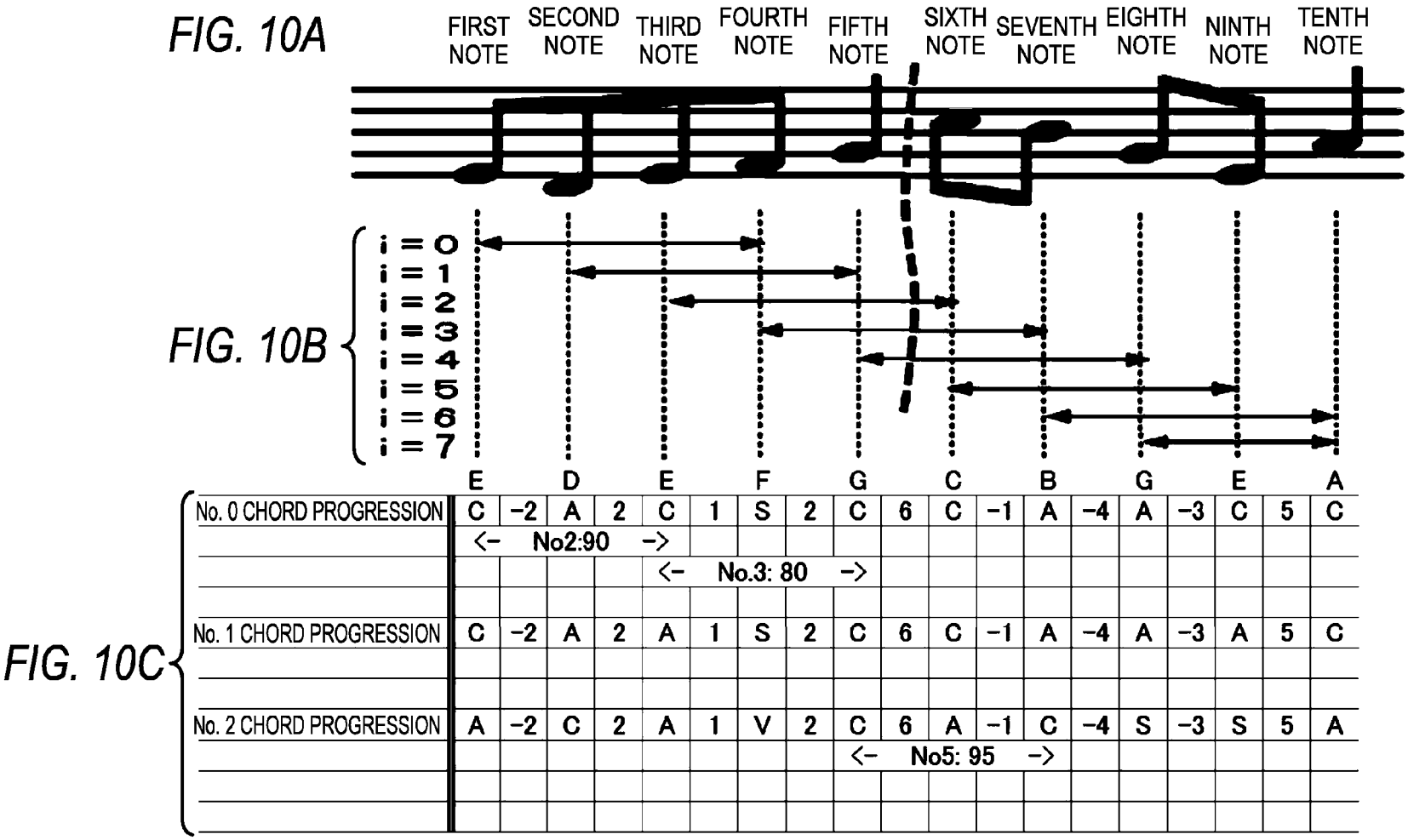
FIGS. 10A, 10B and 10C are explanatory views illustrating an operation of a chord-progression selecting unit 102.

For example, in a case of i=0 shown in FIG. 10B, as shown by an arrow directed toward the right, the chord-progression selecting unit 102 compares a set of the note types and adjacent tones of the first to fourth notes (the first to fourth tones of the drawing) of the input motif 108 with each of four sets of note types and adjacent tones of each note connection rule whose j value is 0, 1, 2, 3 . . . and which is exemplified in FIG. 9, thereby determining whether they coincide with each other.

First, in the note connection rule having a j value "0" and exemplified in FIG. 9, all of Nos. 0, 1, and 2 note types become a chord tone "ci_ChordTone". With respect to this, for example, in a case where a chord progression data item which is an evaluation target is No. 0 chord progression exemplified in FIG. 3B, an array variable data item incon[i] of note types and adjacent tones corresponding to the input motif 108 of FIG. 10A corresponding to FIG. 3A becomes a data item shown on the right side of No. 0 chord progression of FIG. 10C. Therefore, the note types of the first, second, third, and fourth notes of the input motif 108 becomes "CHORD TONE" (C), "AVAILABLE NOTE" (A), and "CHORD TONE" (C), and thus do not coincide with the note connection rule having the j value "0". In this case, the evaluation point of the note connection rule having the j value "0" is not added.

Subsequently, in the note connection rule having the j value "1" and exemplified in FIG. 9, Nos. 0, 1, and 2 note types become "CHORD TONE" (ci_ChordTone), "AVAILABLE NOTE" (ci_AvailableNote), and "CHORD TONE" (ci_ChordTone). With respect to this, for example, in a case where a chord progression data item which is an evaluation target is No. 0 chord progression exemplified in FIG. 3B, the note types of the note connection rule having the j value "1" coincides with the note types of the first, second, third, and fourth notes of the input motif 108 obtained from the array variable data item incon[i] of note types and adjacent tones shown on the right side of No. 0 chord progression of FIG. 10C. However, the adjacent tone of the first note (No. 0) and the second note (No. 1) of the note connection rule having the j value "1" is "4", and the adjacent tone of the second note (No. 1) and the third note (No. 2) is "1", and these do not coincide with the adjacent tone "−2" of the first note and the second note of the input motif 108 and the adjacent tone "2" of the second note and the third note obtained from the array variable data item incon[i] of the note types and the adjacent tones shown on the right side of No. 0 chord progression of FIG. 10C. Therefore, even in a case where the j value is 1, similarly to the case where the j value is 0, the evaluation point of the note connection rule is not added.

Subsequently, in the note connection rule having the j value "2" and exemplified in FIG. 9, Nos. 0, 1, and 2 note types become "CHORD TONE" (ci_ChordTone), "AVAILABLE NOTE" (ci_AvailableNote), and "CHORD TONE" (ci_ChordTone). With respect to this, for example, in a case where a chord progression data item which is an evaluation target is No. 0 chord progression exemplified in FIG. 3B, the note types of the note connection rule having the j value "1" coincides with the note types of the first, second, third, and fourth notes of the input motif 108 obtained from the array variable data item incon[i] of note types and adjacent tones shown on the right side of No. 0 chord progression of FIG. 10C. Also, the adjacent tone of the first note (No. 0) and the second note (No. 1) of the note connection rule having the j value "1" is "−2", and the adjacent tone of the second note (No. 1) and the third note (No. 2) is "2", and these coincide with the adjacent tone of the first note and the second note and the adjacent tone of the second note and the third note obtained from the array variable data item incon[i] of the note types and the adjacent tones shown on the right side of No. 0 chord progression of FIG. 10C. Further, since the fourth note (No. 3 note type) of the note connection rule having the j value "2" has the value "ci_NullNoteType" representing that there is no note type, the fourth note of the input motif 108 may not be compared. From the above, it can be seen that the first, second, and third notes of the input motif 108 in a case where an evaluation target is No. 0 chord progression data item are appropriate for the note connection rule having the j value "2" and shown in FIG. 9, and 90 points which are the evaluation points (ci_NoteConnect[2][7]) of the note connection rule having the j value "2" are added to total evaluation points corresponding to No. 0 chord progression data item which is an evaluation target. An expression "←No2:90→" written with respect to No. 0 chord progression in FIG. 10C corresponds to that adding process.

If a note connection rule is seen in the above described way, with respect to the subsequent note connection rules of the corresponding note connection rule, evaluation on the set of the note types and the adjacent tones of the first, second, third, and fourth notes of the input motif 108 in the case of i=0 in FIG. 10B is not performed.

If evaluation on the set of the note types and the adjacent tones of the first, second, third, and fourth notes of the input motif 108 in the case of i=0 shown in FIG. 10B finishes, notes which are evaluation targets on the input motif 108 are advanced by one, thereby becoming the state of i=1 shown in FIG. 10B, and the chord-progression selecting unit 102 compares the set of note types and adjacent tones of the second, third, fourth, and fifth notes of the input motif 108 with a set of four note types and adjacent tones of each note connection rule having the j value 0, 1, 2, 3, . . . and exemplified in FIG. 9, thereby determining whether they coincide with each other. As a result, the set of the note types and the adjacent tones of the second, third, fourth, and fifth notes of the input motif 108 corresponding to No. 0 chord progression data item which is an evaluation target and is shown in FIG. 10C does not coincide with any note connection rule, and evaluation points for the set of the note types and the adjacent tones of the second, third, fourth, and fifth notes of the input motif 108 in the case of i=1 shown in FIG. 10B is 0 point, and thus addition to the total evaluation points corresponding to No. 0 chord progression data item which is an evaluation target is not performed.

If evaluation on the set of the note types and the adjacent tones of the second, third, fourth, and fifth notes of the input motif 108 in the case of i=1 shown in FIG. 10B finishes, notes which are evaluation targets on the input motif 108 are further advanced by one, thereby becoming the state of i=2 shown in FIG. 10B, and the chord-progression selecting unit 102 compares the set of note types and adjacent tones of the third, fourth, fifth, and sixth notes of the input motif 108 with a set of four note types and adjacent tones of each note connection rule having the j value 0, 1, 2, 3, . . . and exemplified in FIG. 9, thereby determining whether they coincide with each other. As a result, it can be seen that the note connection rule having the j value "3" and shown in FIG. 9 is appropriate for the set of the note types and the adjacent tones of the third, fourth, fifth, and sixth notes of the input motif 108 corresponding to No. 0 chord progression data item which is an evaluation target and is shown in FIG. 10C, and 80 points which are evaluation points (ci_NoteConnect[3][7]) of the note connection rule having the j value "3" are added to the total evaluation points corresponding to No. 0 chord progression data item which is an evaluation target. An expression "←3:80→" written with respect to No. 0 chord progression in FIG. 10C corresponds to that adding process. As a result, the total evaluation points become 170 points (which is the sum of 90 points and 80 points).

Thereafter, the same process is performed up to evaluation on the set of the note types and the adjacent tones of the eighth, ninth, and tenth notes of the input motif 108 in a case of i=7 shown in FIG. 10B. Also, in the present embodiment, although evaluation is performed every four notes in principle, only in the final case of i=7, with respect to three notes of the input motif 108, three-note connection rules which have j values "0" to "8" of FIG. 9 and in which No. 3 note type is "ci_NullNoteType" are compared.

If the evaluating process on each note of the input motif 108 corresponding to No. 0 chord progression data item which is an evaluation target and is shown in FIG. 10C finishes, the total evaluation points calculated at that moment in association with No. 0 chord progression data item which is an evaluation target becomes the matching level of No. 0 chord progression data item, which is an evaluation target, for the input motif 108.

For example, in a case where a chord progression data item which is an evaluation target is No. 1 or 2 chord progression exemplified in FIG. 3B, the array variable data item incon[i] of the note types and the adjacent tones corresponding to the input motif 108 of FIG. 10A corresponding to FIG. 3A becomes a data item shown on the right side of No. 1 or 2 chord progression in FIG. 10C as described above with reference to FIG. 8. With respect to those array variable data items incon[i], the same evaluating process as that in the case of No. 0 chord progression described above is performed. For example, in a case of No. 1 chord progression, since there is no part appropriate for the note connection rules of FIG. 9 as shown in FIG. 10C, the total evaluation points thereof becomes 0 point, and this becomes the matching level of No. 1 chord progression for the input motif 108. Also, in a case of No. 2 chord progression, it can be seen that the note connection rule having the j value "5" and shown in FIG. 9 is appropriate for the set of the note types and the adjacent tones of the fifth, sixth, and seventh of the input motif 108, and 95 points which are evaluation points "ci_NoteConnect[5][7]" of the note connection rule having the j value "5" is added to the total evaluation points corresponding to No. 2 chord progression data item which is an evaluation target, and this becomes the matching level No. 2 chord progression for the input motif 108.

The chord-progression selecting unit 102 of FIG. 1 performs the process of calculating the matching level described above on the plurality of chord progression data items retained in the accompaniment/chord-progression DB 103, and outputs Nos. 0, 1, and 2 chord progression candidate indication data items 109 indicating chord progression data items of the top three matching levels, respectively. Also, in the above described process, since the keys of the input motif 108 and each chord progression data item retained in the accompaniment/chord-progression DB 103 do not necessarily coincide with each other, data items obtained by performing key shift each chord progression data item in 12 steps constituting one octave is compared with the input motif 108.

Subsequently, the outline of an operation of the melody generating unit 105 of FIG. 1 will be described. First, FIGS. 11A to 11D are views illustrating an example of the data configuration of the phrase set DB 106 of FIG. 1. As shown in FIG. 1, in the phrase set DB 106, records of a plurality of phrase set data items of No. 1, No. 2 . . . are stored, and finally, an end chord is stored.

A phrase set data item corresponding to one record is composed of a plurality of phrase data items, that is, an A melody data item, a B melody data item, a C melody (refrain melody) data item, a first ending data item, and a second ending data item, as shown in FIG. 11B.

Each of the phrase data items of FIG. 11B is configured by a plurality of note data items No. 1, No. 2 . . . , and contains an end chord at the end, as shown in FIG. 11C. Each note data item is a data item which corresponds to each of notes corresponding to one measure or more constituting each phrase and instructs sound production of the melody sound of each phrase. As shown in FIG. 11D, one note data item is composed of "TIME" data which represents the sound production timing of a note corresponding to that note data item, for example, by an elapsed time from the start of the phrase, "LENGTH" data representing the length of the note, "STRENGTH" data representing the strength of the note, and "PITCH" data representing the pitch of the note. These data represent each note constituting the phrase.

If a chord progression candidate is selected from three chord progression candidates corresponding to Nos. 0, 1, and 2 chord progression candidate indication data items 109 output from the chord-progression selecting unit 102, by user's designation or automatically, the melody generating unit 105 of FIG. 1 reads a music structure data item (see FIG. 6) corresponding to the selected chord progression candidate, from the accompaniment/chord-progression DB 103. With respect to each phrase of a measure represented by the read music structure data item, the melody generating unit 105 automatically generates a melody of the corresponding phrase with reference to the input motif 108, the phrase sets (see FIG. 11) registered in the phrase set DB 106, and the rule DB 104 (see FIG. 9).

In this case, the melody generating unit 105 determines whether the phrase of a measure represented by the music structure data item is a phrase of the input motif 108. In a case where the phase of the measure is the phrase of the input motif 108, the melody generating unit intactly outputs the melody of the input motif 108 as a part of the melody data 110.

In a case where the phrase of the measure represented by the music structure data item is not a phrase of the input motif 108 and is not the beginning phrase of the refrain melody, if a melody for the corresponding phrase has not been generated yet, the melody generating unit 105 extracts a phrase set corresponding to the input motif 108 from the phrase set DB 106, and copies the melody of a corresponding phrase included in the extracted phrase set. Meanwhile, if a melody for the corresponding phase has been generated, the melody generating unit copies the melody from the corresponding phase whose melody has been generated. Thereafter, the melody generating unit 105 performs a melody modifying process (to be described below) of modifying the copied melody, and a melody optimizing process (to be described below) of optimizing the pitch of each note constituting the modified melody, thereby automatically generating the melody of the phrase of the measure represented by the music structure data item, and outputs the generated melody as a part of the melody data 110. Details of the process of copying the melody from the phase having been already generated will be described with respect to a description of FIG. 25.

In a case where the phrase of the measure represented by the music structure data item is the beginning phrase of the refrain melody, if a beginning phrase for the corresponding refrain melody has not been generated, the melody generating unit 105 extracts a phrase set corresponding to the input motif 108 from the phrase set DB 106, and copies the melody of the beginning phrase of a corresponding refrain melody (C melody) included in the extracted phrase set, and performs the melody optimizing process of optimizing the pitch of each note constituting the copied melody, thereby automatically generating the melody of the beginning phrase of the refrain melody, and outputs the generated melody as a part of the melody data 110. Meanwhile, if the beginning phrase of the corresponding refrain melody has been generated, the melody generating unit copies a melody from the phrase having been generated, and outputs the copied melody as a part of the melody data 110.

FIG. 12 is an explanatory view illustrating the flows of the melody modifying process and the melody optimizing process. In a case where a melody has been already generated, the melody generating unit 105 copies the corresponding melody, and performs a pitch shifting process of raising the pitch of each note constituting the copied melody, for example, by two semitones, for example, as shown by a reference symbol "1201". Alternatively, the melody generating unit 105 performs a process of reversing the left and right (reproduction order) of the individual notes constituting the copied melody in the phrase, for example, as shown by a reference symbol "1202". The melody generating unit 105 further performs the melody optimizing process shown by a reference symbol "1203" or "1204" on the melody of the measure subjected to the melody modifying process as described above, thereby automatically generating the final melody.

Figure 13:
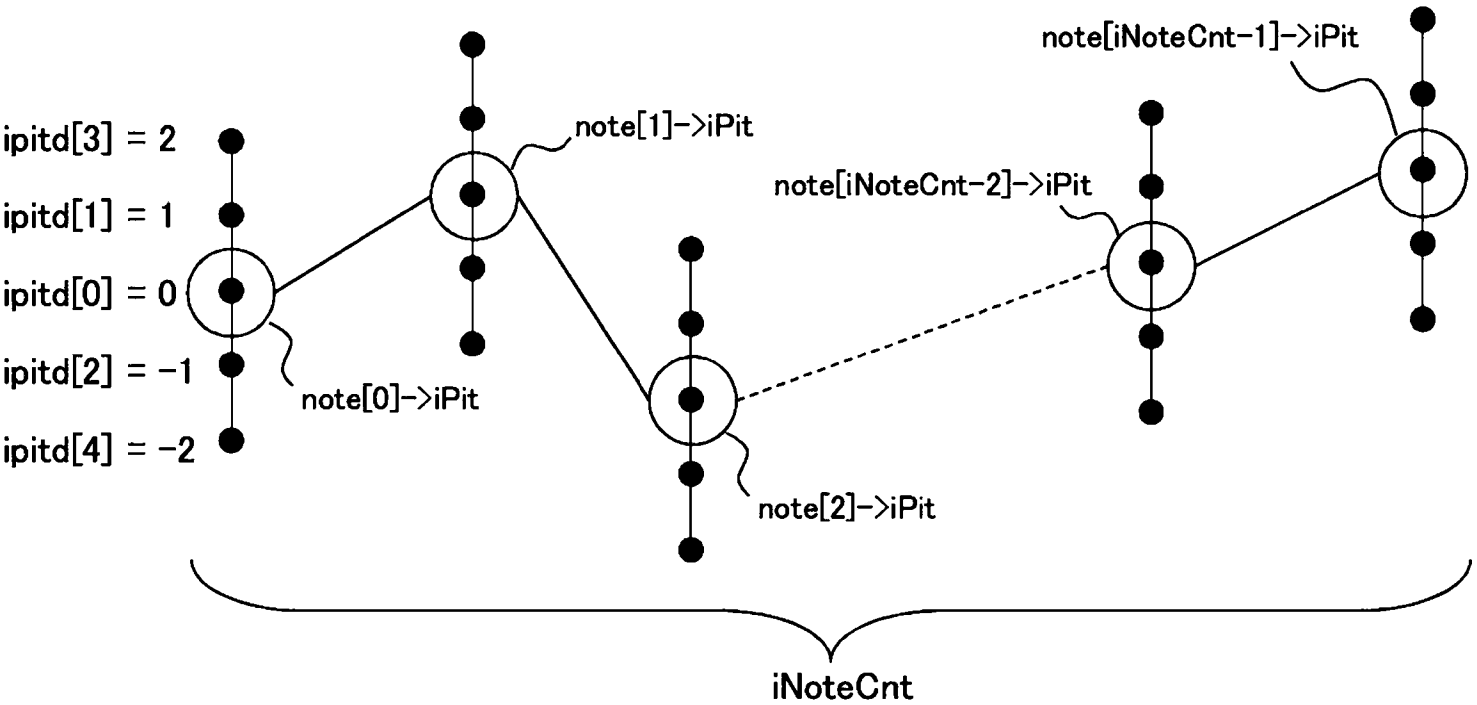
FIG. 13 is an explanatory view illustrating a detailed flow of the melody optimizing process.

FIG. 13 is an explanatory view illustrating the detailed flow of the melody optimizing process. Now, it is assumed that in a variable iNoteCnt, the number of the notes constituting the melody of the measure subjected to the melody modifying process has been stored, and in array data (note[0]→iPit, note[1]→iPit, note[2]→iPit, . . . , note[iNoteCnt-2]→iPit, and note[iNoteCnt-1]→iPit), data items on the pitches of the individual notes described above have been stored. The melody generating unit 105 first performs pitch shift on the pitch data "note[i]→iPit" ($0 \le i \le iNoteCnt-1$) of the individual notes by values of five steps such as ipitd[0]=0, ipitd[1]=1, ipitd[2]=−1, ipitd[3]=2, and ipitd[4]=−2, thereby generating the total $5^{iNoteCnt}$ number of pitch sequences. Thereafter, the melody generating unit 105 performs the same process as that described with reference to FIGS. 7 to 10 on each pitch sequence, thereby performing note type acquisition and adjacent tone calculation on a part corresponding to the measure of the chord progression data item extracted by the chord-progression selecting unit 102, and performing the note-connectivity checking process. As a result, the melody generating unit 105 corrects a pitch sequence having the highest matching level of the matching levels calculated with respect to the total $5^{iNoteCnt}$ number of pitch sequences, as the pitch data (note[i]→iPit wherein $0 \le i \le iNoteCnt-1$) of the individual notes of the corresponding phrase. The melody generating unit 105 outputs the data (note[i] wherein 0≤i≤iNoteCnt-1) of the individual notes of the corresponding phrase including the pitch sequence generated as described above, as the melody data 110.

Figure 14:
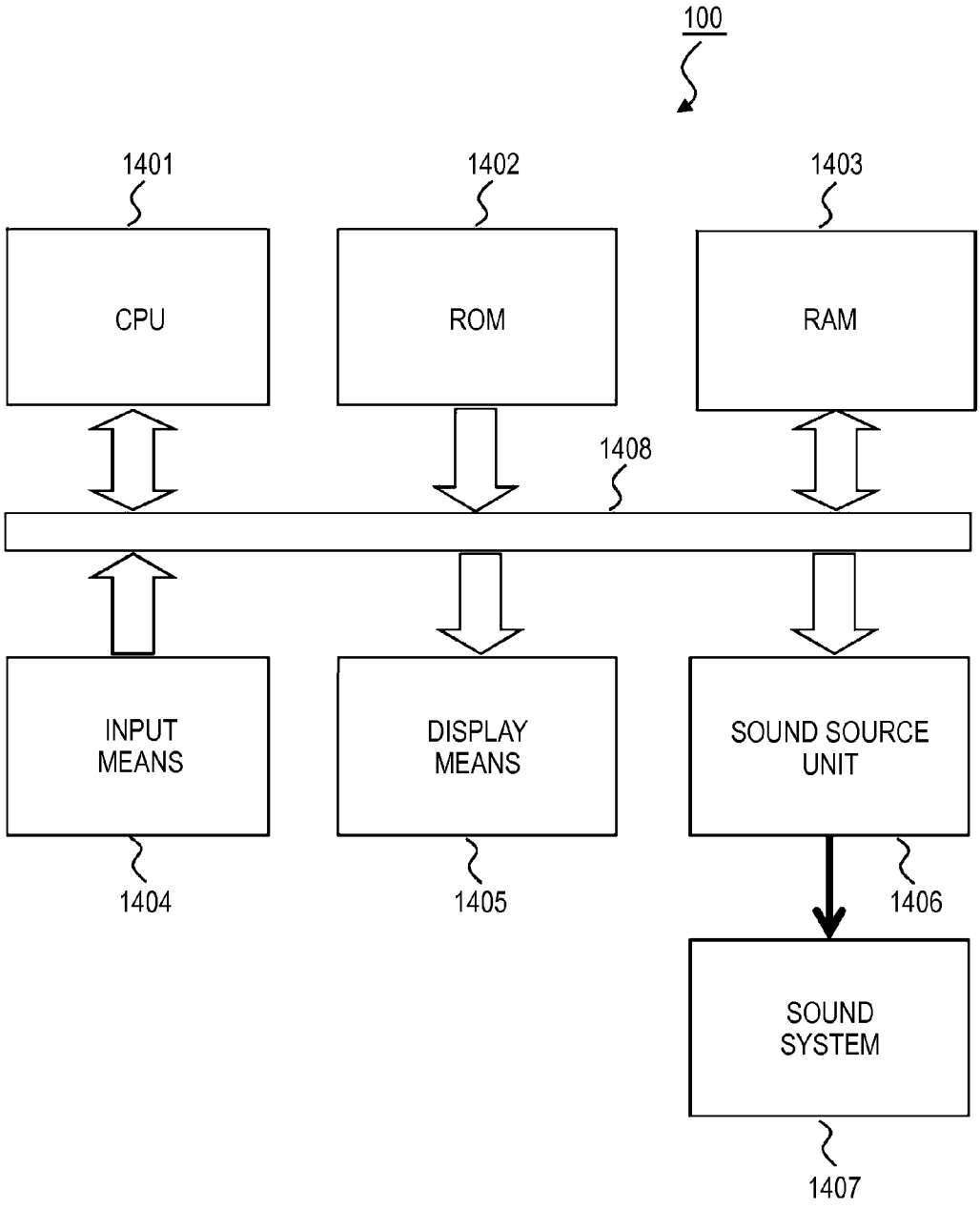
FIG. 14 is a view illustrating an example of the software configuration of the automatic composition apparatus.

The configuration and operation of the automatic composition apparatus 100 described above will be described in more detail below. FIG. 14 is a view illustrating an example of the hardware configuration of the automatic composition apparatus 100 of FIG. 1. The hardware configuration of the automatic composition apparatus 100 exemplified in FIG. 14 includes a CPU (central processing unit) 1401, a ROM (read only memory) 1402, a RAM (random access memory) 1403, an input unit 1404, a display unit 1405, and a sound source unit 1406 which are connected to one another by a system bus 1408. Also, the output of the sound source unit 1406 is input to a sound system 1407.

The CPU 1401 executes an automatic-music-composition control program stored in the ROM 1402 while using the RAM 1403 as a work memory, thereby performing a control operation corresponding to each of the functional parts 101 to 107 of FIG. 1.

In the ROM 1402, besides the above described automatic-music-composition control program, the accompaniment/chord-progression DB 103 (see FIGS. 5 and 6), the rule DB 104 (see FIG. 9), and the phrase set DB 106 (see FIG. 11) of FIG. 1, and the standard pitch class set table (see FIG. 7) are stored in advance.

The RAM 1403 temporarily stores the input motif 108 (see FIG. 4) input from the motif input unit 101, chord progression candidate data items 109 output by the chord-progression selecting unit 102, the melody data 110 output by the melody generating unit 105, etc. Besides, in the RAM 1403, various variable data items (to be described below) and so on are temporarily stored.

The input unit 1404 corresponds to the function of a part of the motif input unit 101 of FIG. 1, and corresponds to, for example, the keyboard input unit 101-1, the voice input unit 101-2, or the note input unit 101-3. In a case where the input unit 1404 includes the keyboard input unit 101-1, the input unit 1404 includes a playing keyboard, and a key matrix circuit which detects a key depression state of the corresponding playing keyboard and notifies the key depression state to the CPU 1401 through the system bus 1408. In a case where the input unit 1404 includes the voice input unit 101-2, the input unit 1404 includes a microphone for inputting a singing voice, and a digital signal processing circuit which converts a voice signal input from the corresponding microphone into a digital signal, and extracts pitch information of the singing voice, and notifies the pitch information to the CPU 1401 through the system bus 1408. Also, the extraction of the pitch information may be performed by the CPU 1401. In a case where the input unit 1404 includes the note input unit 101-3, the input unit 1404 includes a keyboard for inputting notes, and a key matrix circuit which detects a note input state of the corresponding keyboard and notifies the note input state to the CPU 1401 through the system bus 1408. The CPU 1401 corresponds to the function of a part of the motif input unit 101 of FIG. 1, and detects the input motif 108 based on the variety of information input from the input unit 1404 of FIG. 14, and stores the input motif 108 in the RAM 1403.

The display unit 1405 implements the function of the score display unit 107-1 of the output unit 107 of FIG. 1, together with a control operation of the CPU 1401. The CPU 1401 generates score data corresponding to the automatically composed melody data 110, and instructs the display unit 1405 to display the score data. The display unit 1405 is, for example, a liquid crystal display.

The sound source unit 1406 implements the function of the musical-sound reproducing unit 107-2 of FIG. 1, together with a control operation of the CPU 1401. The CPU 1401 generates sound production control data for reproducing a melody and accompaniment, based on the automatically generated melody data 110 and the MIDI data item for accompaniment read from the accompaniment/chord-progression DB 103, and supplies the sound production control data to the sound source unit 1406. The sound source unit 1406 generates a melody sound and an accompaniment sound, based on the sound production control data, and outputs the melody sound and the accompaniment sound to the sound system 1407. The sound system 1407 converts digital musical sound data on the melody sound and the accompaniment sound input from the sound source unit 1406 into an analog musical sound signal, and amplifies the analog musical sound signal by a built-in amplifier, and emits a musical sound from a built-in speaker.

FIGS. 15A and 15B are views illustrating a list of various variable data items, various array variable data items, and various constant data items which are stored in the ROM 1402 or the RAM 1403. These data items can be used in various processes to be described below.

Figure 16:
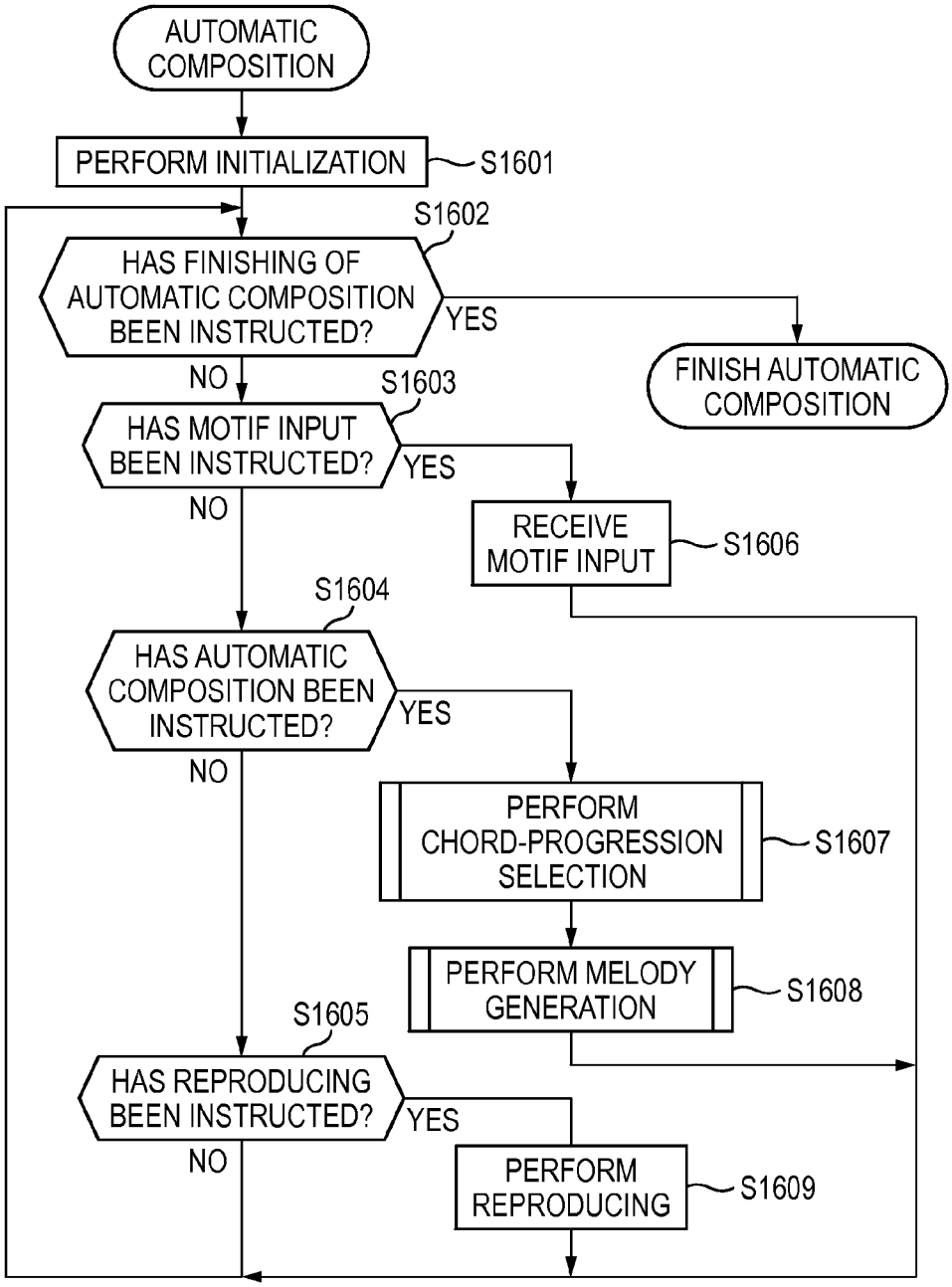
FIG. 16 is a flow chart illustrating an automatic composition process.

FIG. 16 is a flow chart illustrating an example of an automatic composition process according to the present embodiment. If the automatic composition apparatus 100 is powered on, the CPU 1401 starts to execute an automatic composition process program retained in the ROM 1402, whereby the automatic composition process starts.

First, in STEP S1601, the CPU 1401 performs initialization on the RAM 1403 and the sound source unit 1406. Thereafter, the CPU 1401 repeatedly performs a series of processes of STEPS S1602 to S1608.

In this repetitive process, first, in STEP S1602, the CPU 1401 determines whether the user has instructed finishing of the automatic composition process by pressing a power switch (not specifically shown). If finishing has not been instructed ("NO" in the determination of STEP S1602), the CPU 1401 continues the repeating process. Meanwhile, if finishing has been instructed ("YES" in the determination of STEP S1602), the CPU 1401 finishes the automatic composition process exemplified in the flow chart of FIG. 16.

In the case where the result of the determination of STEP S1602 is "NO", in STEP S1603, the CPU 1401 determines whether the user has instructed motif input from the input unit 1404. In a case where the user has instructed motif input (a case where the result of the determination of STEP S1603 is "YES"), in STEP S1606, the CPU 1401 receives motif input of the user from the input unit 1404, and stores the input motif 108 input from the input unit 1404, for example, in the data format of FIG. 4, in the RAM 1403. Thereafter, the CPU 1401 returns to the process of STEP S1602.

In a case where the user has not instructed motif input (a case where the result of the determination of STEP S1603 is "NO"), in STEP S1604, the CPU 1401 determines whether the user has instructed automatic composition by a switch (not specifically shown). In a case where the user has instructed automatic composition (a case where the result of the determination of STEP S1604 is "YES"), the CPU 1401 performs a chord-progression selecting process in STEP S1607, and subsequently performs a melody generating process in STEP S1608. The chord-progression selecting process of STEP S1607 implements the function of the chord-progression selecting unit 102 of FIG. 1. The melody generating process of STEP S1608 implements the function of the melody generating unit 105 of FIG. 1. Thereafter, the CPU 1401 returns to the process of STEP S1602.

In a case where the user has not instructed automatic composition (a case where the result of the determination of STEP S1604 is "NO"), in STEP S1605, the CPU 1401 determines whether the user has instructed reproducing of the automatically composed melody data 110 by a switch (not specifically shown). In a case where the user has instructed reproducing of the melody data 110 (a case where the result of the determination of STEP S1605 is "YES"), the CPU 1401 performs a reproducing process in STEP S1609. This process is the same as the operations of the note input unit 101-3 and the musical-sound reproducing unit 107-2 of the output unit 107 of FIG. 1 described above.

In the case where the user has not instructed automatic composition (the case where the result of the determination of STEP S1604 is "NO"), the CPU 1401 returns to the process of STEP S1602.

Figure 17:
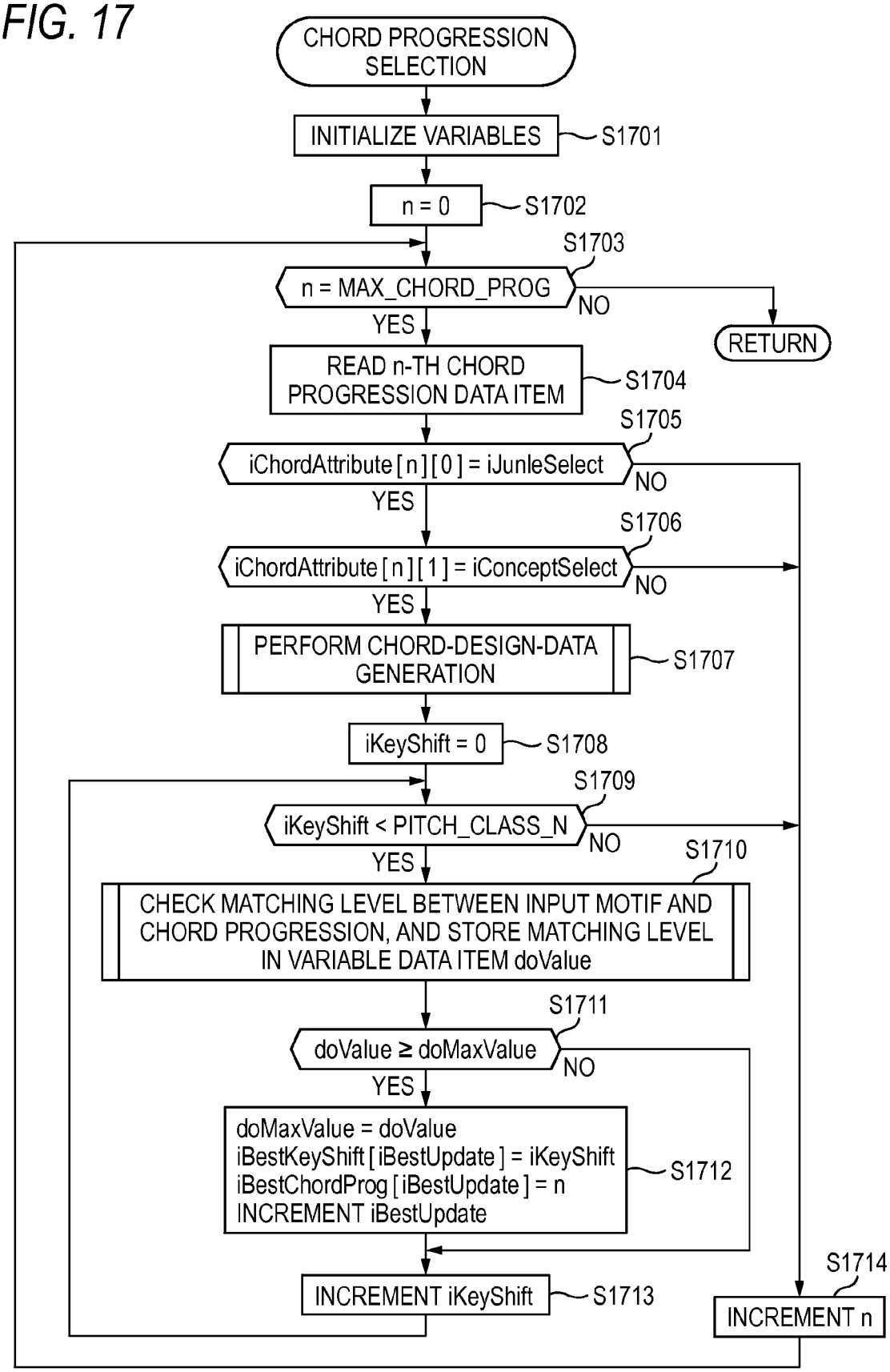
FIG. 17 is a flow chart illustrating a detailed example of a chord-progression selecting process.

FIG. 17 is a flow chart illustrating a detailed example of the chord-progression selecting process of STEP S1607 of FIG. 16.

First, in STEP S1701, the CPU 1401 initializes the variable data items and the array variable data items on the RAM 1403.

Subsequently, the CPU 1401 initializes a variable "n" on the RAM 1403 for controlling a repetitive process on the plurality of chord progression data items retained in the accompaniment/chord-progression DB 103, to "0". Thereafter, while incrementing the value of the variable "n", +1 by +1, the CPU performs a series of processes of STEPS S1704 to S1713, as long as it is determined in STEP S1703 that the value of the variable "n" is smaller than the value of a constant data item MAX_CHORD_PROG retained in the ROM 1402. The value of the constant data item MAX_CHORD_PROG is a constant data item representing the number of chord progression data items retained in the accompaniment/chord-progression DB 103. The CPU 1401 repeatedly performs the series of processes of STEPS S1704 to S1713, the same number of times as the number of records of the accompaniment/chord-progression DB 103 shown in FIG. 5, thereby performing the process of calculating the matching levels on the plurality of chord progression data items retained in the accompaniment/chord-progression DB 103, and outputs, for example, Nos. 0, 1, and 2 chord progression candidate indication data items 109 indicating chord progression data items of the top three matching levels for the input motif 108, respectively.

In the repetitive process of STEPS S1703 to S1713, first, in STEP S1703, the CPU 1401 determines whether the value of the variable "n" is smaller than the value of the constant data item MAX_CHORD_PROG.

If the result of the determination of STEP S1703 is "YES", in STEP S1704, the CPU 1401 loads No. n chord progression data item (see FIG. 5A) represented by the variable data item n, from the accompaniment/chord-progression DB 103 into a chord progression data area of the RAM 1403. The data format of No. n chord progression data item is, for example, the format shown in FIGS. 5B, 5C and 5D.

Subsequently, in STEP S1705, the CPU 1401 determines whether a value which represents the music genre of No. n chord progression data item and has been loaded from the accompaniment/chord-progression DB 103 into an array variable data element iChordAttribute[n][0] for No. n chord progression data item in the RAM 1403 is equal to a value which the user has set in advance by a switch (not specifically shown) and is retained in a variable data item iJunleSelect in the RAM 1403 and represents a music genre. If the result of the determination of STEP S1705 is "NO", since No. n chord progression data item is not suitable for the music genre which the user desires, the CPU 1401 does not select No. n chord progression data item, and proceeds to STEP S1714.

If the result of the determination of STEP S1705 is "YES", in STEP S1706, the CPU 1401 determines whether a value which represents the concept of No. n chord progression data item and has been loaded from the accompaniment/chord-progression DB 103 into an array variable data element iChordAttribute[n][1] for No. n chord progression data item in the RAM 1403 is equal to a value which the user has set in advance by a switch (not specifically shown) and is retained in a variable data item iConncept-Select in the RAM 1403 and represents a music concept. If the result of the determination of STEP S1706 is "NO", since No. n chord progression data item is not suitable for the music concept which the user desires, the CPU 1401 does not select No. n chord progression data item, and proceeds to STEP S1714.

If the result of the determination of STEP S1706 is "YES", in STEP S1707, the CPU 1401 performs a chord-design-data generating process. In this process, the CPU 1401 performs a process of storing chord progression information, sequentially designated according to No. n chord progression data item with time, in a chord design data item [k] (to be described below) which is an array variable data item retained in the RAM 1403.

Subsequently, in STEP S1708, the CPU 1401 stores an initial value "0" in a variable data item iKeyShift retained in the RAM 1403. This variable data item iKeyShift designates a key shift value in semitone units for No. n chord progression data item, in a range from the initial value "0" to a value smaller than a constant data item PITCH_CLASS_N retained in the ROM 1402 by 1, in a chromatic scale of one octave. The value of the constant data item PITCH_CLASS_N is generally 12 which is the number of semitones in one octave.

Subsequently, in STEP S1709, the CPU 1401 determines whether the value of the constant data item iKeyShift is smaller than the value of the constant data item PITCH_CLASS_N.

If the result of the determination of STEP S1709 is "YES", in STEP S1710, the CPU 1401 shifts the key of No. n chord progression data item by the key shift value represented by the variable data item iKeyShift, and then performs a process of checking the matching level on the input motif 108 and No. n chord progression. By this process, the matching level of No. n chord progression for the input motif 108 is obtained in a variable data item doValue retained in the RAM 1403.

Subsequently, in STEP S1711, the CPU 1401 determines whether the value of the variable data item doValue is larger than the value of a variable data item doMaxValue retained in the RAM 1403. The variable data item doMaxValue is a variable for storing the value of the highest matching level at that moment, and is initialized to a value "0" in STEP S1701.

If the result of the determination of STEP S1711 is "YES", the CPU 1401 replaces the value of the variable data item doMaxValue with the value of the variable data item doValue. Also, the CPU 1401 stores the current value of the variable data item iKeyShift in an array variable data item iBestKeyShift[iBestUpdate] retained in the RAM 1403. Further, the CPU 1401 stores the current value of the variable data item n representing a chord progression data item retained in the accompaniment/chord-progression DB 103, in an array variable data item iBestChordProg

[iBestUpdate] retained in the RAM 1403. Thereafter, the CPU 1401 increments a variable data item iBestUpdate retained in the RAM 1403, by +1 (these processes are performed in STEP S1712). The variable data item iBestUpdate is a data item which is initialized to a value "0" in STEP S1701, and is incremented whenever a chord progression data item having the highest matching level at that moment is found. As the value of the variable data item iBestUpdate increases, the matching level becomes higher. The array variable data item iBestKeyShift[iBestUpdate] holds a key shift value corresponding to a ranking represented by the variable data item iBestUpdate. The array variable data item iBestChordProg[iBestUpdate] holds the number of a chord progression corresponding to the ranking represented by the variable data item iBestUpdate and retained in the accompaniment/chord-progression DB 103.

If the result of the determination of STEP S1711 is "NO", in this time, the CPU 1401 does not select No. n chord progression data item as a chord progression data item for automatic composition relative to the input motif 108 by skipping the process of STEP S1712 described above.

Thereafter, in STEP S1713, the CPU 1401 increments the value of the variable data item iKeyShift by +1. Then, the CPU 1401 returns to the process of STEP S1709.

After the CPU 1401 repeatedly performs the processes of STEPS S1709 to S1713 while incrementing the value of the variable data item iKeyShift, if key shift value designation corresponding to one octave finishes, whereby the result of the determination of STEP S1709 becomes "NO", the CPU advances the process to STEP S1714. In STEP S1714, the CPU 1401 increments the variable data item n for selecting a chord progression data item retained in the accompaniment/chord-progression DB 103, by +1. Thereafter, the CPU 1401 returns to the process of STEP S1703.

After the CPU 1401 repeatedly performs the series of the processes of STEPS S1703 to S1714 while incrementing the value of the variable data item n, if the process on every chord progression data item retained in the accompaniment/chord-progression DB 103 finishes, whereby the result of the determination of STEP S1703 becomes "NO", the CPU finishes the process of the flow chart of FIG. 17, that is, the chord-progression selecting process of STEP S1607. As a result, in array variable data items iBestKeyShift [iBestUpdate-1] and iBestChordProg[iBestUpdate-1] having, as their element numbers, a value "iBestUpdate-1" smaller than the current value of the variable data item iBestUpdate by 1, a key shift value and the number of a chord progression data item having the highest matching level for the input motif 108 are stored. Also, in array variable data items iBestKeyShift[iBestUpdate-2] and iBestChordProg[iBestUpdate-2], a key shift value and the number of a chord progression data item having the second highest matching level for the input motif 108 are stored. Further, in array variable data items iBestKeyShift [iBestUpdate-3] and iBestChordProg[iBestUpdate-3], a key shift value and the number of a chord progression data item having the third highest matching level for the input motif 108 are stored. These data item sets correspond to Nos. 0, 1, and 2 chord progression candidate indication data items 109 of FIG. 1, sequentially from the top ranking.

Figure 18:
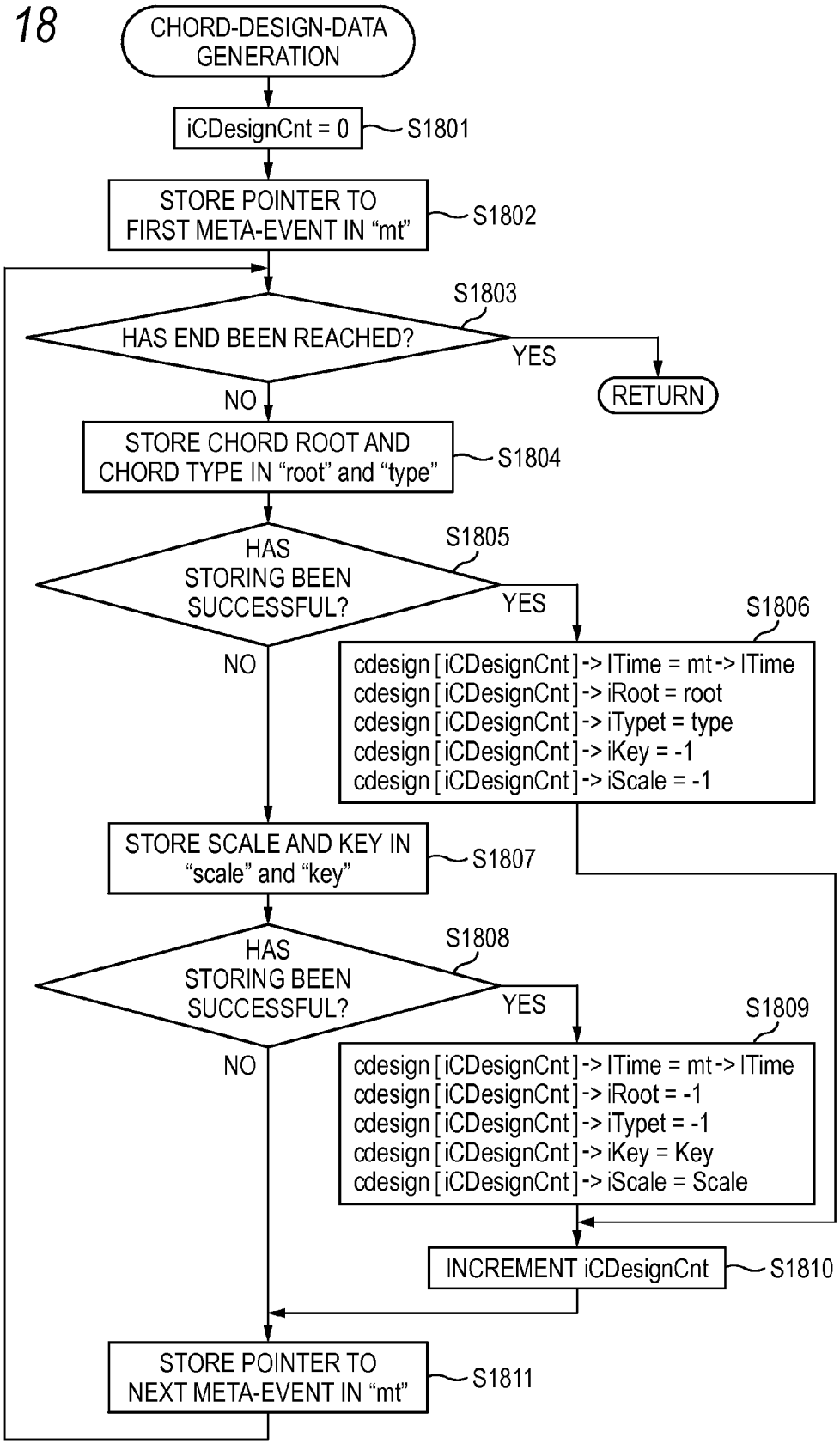
FIG. 18 is a flow chart illustrating a detailed example of a chord-design-data generating process.

FIG. 18 is a flow chart illustrating a detailed example of the chord-design-data generating process of STEP S1707 of FIG. 17.

First, in STEP 51801, the CPU 1401 sets a variable data item iCDesignCnt representing the number of a chord progression information item, to an initial value "0".

Subsequently, in STEP S1802, the CPU 1401 stores a pointer to the first meta-event (corresponding to No. 0 chord data item of FIG. 5B) loaded, for example, in the data format shown in FIGS. 5B, 5C and 5D, from the accompaniment/chord-progression DB 103 into the RAM 1403 in STEP S1704 of FIG. 17, in a pointer variable data item "mt" retained in the RAM 1403.

Subsequently, while sequentially storing pointers to the subsequent meta-events (Nos. 1, 2, . . . chord data items of FIG. 5B) in the pointer variable data item "mt" in STEP S1811, the CPU 1401 repeatedly performs a series of processes of STEPS S1803 to S1811 on each chord data item (see FIG. 5B) of No. n chord progression data item, until it is determined in STEP S1803 that the end ("END" of FIG. 5B) has been reached.

In the above-mentioned repetitive process, first, in STEP S1803, the CPU 1401 determines whether the pointer variable data item "mt" indicates the end.

If the result of the determination of STEP S1803 is "NO", in STEP S1804, the CPU 1401 attempts to extract a chord root and a chord type (see FIG. 5D) from a chord data item (FIG. 5B) indicated by the pointer variable data item "mt", and store them in variable data items "root" and "type" retained in the RAM 1403. Then, in STEP S1805, the CPU 1401 determines whether the storing process of STEP S1804 has been successful.

In a case where the storing process of STEP S1804 has been successful (a case where the result of the determination of STEP S1805 is "YES"), the CPU 1401 stores a time information item "mt→iTime" ("TIME" data of FIG. 5D) stored in a storage area indicated by the pointer variable data item "mt", in a time item cdesign[iCDesignCnt]→iTime of a chord design data item having the current value of the variable data item iCDesignCnt as its element number. Also, the CPU 1401 stores the chord root information stored in the variable data item "root" in STEP S1804, in a chord root item cdesign[iCDesignCnt]→iRoot of the chord design data item having the current value of the variable data item iCDesignCnt as its element number. Further, the CPU 1401 stores the chord type information stored in the variable data item "type" in STEP S1804, in a chord root item cdesign [iCDesignCnt]→iType of the chord design data item having the current value of the variable data item iCDesignCnt as its element number. Furthermore, the CPU 1401 stores an invalid value "−1" in a key item cdesign[iCDesign Cnt]→iKey and a scale item cdesign[iCDesignCnt]→iScale of the chord design data item having the current value of the variable data item iCDesignCnt as its element number (these processes are performed in STEP S1806). Thereafter, the CPU 1401 proceeds to the process of STEP 51810 in which the CPU increments the value of the variable data item iCDesignCnt by +1.

In a case where the storing process of STEP S1804 has not been successful (a case where the result of the determination of STEP S1805 is "NO"), in STEP S1807, the CPU 1401 attempts to extract a scale and a key (see FIG. 5C) from the chord data item (FIG. 5B) indicated by the pointer variable data item "mt", and store them in variable data items "scale" and "key" retained in the RAM 1403. Then, in STEP S1808, the CPU 1401 determines whether the storing process of STEP S1807 has been successful.

In a case where the storing process of STEP S1807 has been successful (a case where the result of the determination of STEP S1808 is "YES"), the CPU 1401 stores a time information item "mt→iTime" ("TIME" data of FIG. 5D) stored in a storage area indicated by the pointer variable data item "mt", in a time item cdesign[iCDesignCnt]→iTime of a chord design data item having the current value of the variable data item iCDesignCnt as its element number. Also, the CPU 1401 stores the key information stored in the variable data item "key" in STEP S1807, in a key item cdesign[iCDesignCnt]→iKey of the chord design data item having the current value of the variable data item iCDesignCnt as its element number. Further, the CPU 1401 stores the scale information stored in the variable data item "scale" in STEP S1807, in a scale item cdesign [iCDesignCnt]→iScale of the chord design data item having the current value of the variable data item iCDesignCnt as its element number. Furthermore, the CPU 1401 stores an invalid value "−1" in a chord root item cdesign [iCDesignCnt]→iRoot and a chord type item cdesign [iCDesignCnt]→iType of the chord design data item having the current value of the variable data item iCDesignCnt as its element number (these processes are performed in STEP S1809). Thereafter, the CPU 1401 proceeds to the process of STEP 51810 in which the CPU increments the value of the variable data item iCDesignCnt by +1.

After the CPU 1401 increments the value of the variable data item iCDesignCnt in STEP 51810, or in a case where the storing process of STEP S1807 has not been successful (a case where the result of the determination of STEP S1808 is "NO"), the CPU stores pointers to the subsequent meta-events (Nos. 1, 2, . . . chord data items of FIG. 5B) in the pointer variable data item "mt" in STEP S1811, and returns to the determining process of STEP S1803.

If the CPU 1401 reads the chord data items relative to No. n chord progression data item which is the current target up to the end (see FIG. 5B) as the result of the repetitive process of STEPS S1803 to S1811, the result of the determination of STEP S1803 becomes "YES". Therefore, the CPU finishes the process exemplified in the flow chart of FIG. 18, that is, the chord-design-data generating process of STEP S1707 of FIG. 17. At this moment, the number of chord information items constituting No. n chord progression data item is obtained in the variable data item iCDesignCnt, and chord information items are stored in the chord design data items cdesign[0] to cdesign[iCDesignCnt-1], respectively.

Figure 19:
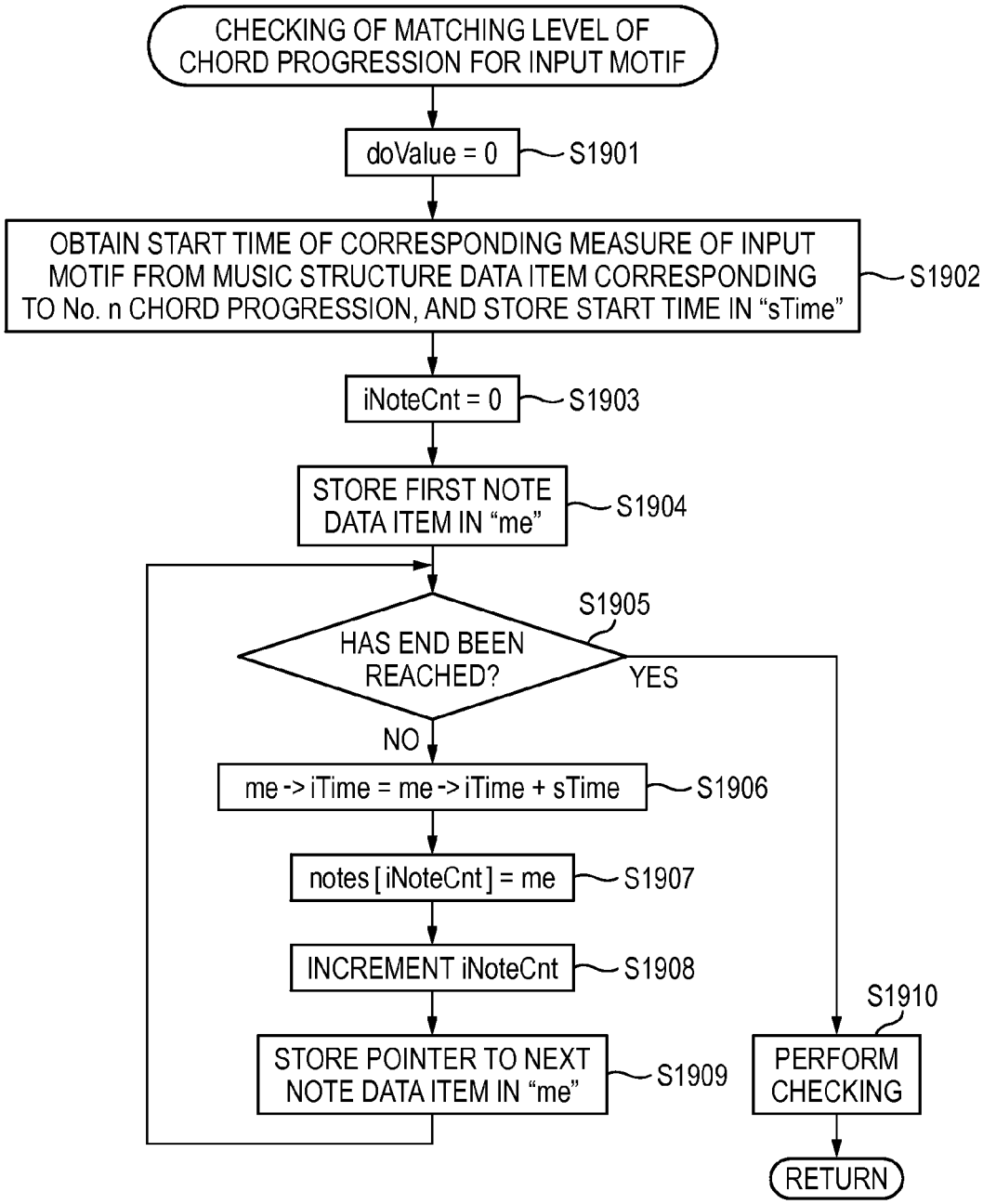
FIG. 19 is a flow chart illustrating a detailed example of a process of checking the matching level between an input motif and a chord progression.

FIG. 19 is a flow chart illustrating a detailed example of the process of STEP S1710 of FIG. 17 for checking the matching level of No. n chord progression for the input motif 108.

First, in STEP 51901, the CPU 1401 sets an initial value "0" in the variable data item doValue representing the matching level.

Subsequently, in STEP S1902, the CPU 1401 reads a measure start time data item iPartTime[M] retained in a beginning measure record having an item "PartTime[M]" (see FIG. 6) set to the same phrase type as a phrase type designated by the user during inputting of the input motif 108, from the accompaniment/chord-progression DB 103, with reference to No. n music structure data item (see FIG. 5A) corresponding to No. n chord progression data item loaded in STEP S1704, and stores the measure start time data item iPartTime[M] in a variable data item "sTime" retained in the RAM 1403.

Subsequently, in STEP 51903, the CPU 1401 sets the value of the variable data item iNoteCnt indicating the order of the notes constituting the input motif 108, to an initial value "0".

Subsequently, in STEP S1904, the CPU 1401 stores a pointer to the first note data item (corresponding to No. 0 note data item of FIG. 4A) of the input motif 108 input in the data format of FIG. 4 to the RAM 1403 in STEP S1606 of FIG. 16, in a pointer variable data item "me" retained in the RAM 1403.

Subsequently, while sequentially storing pointers to the subsequent note data items (Nos. 1, 2 . . . note data items of FIG. 4A) of the input motif 108 in the pointer variable data item "me" in STEP S1909, the CPU 1401 repeatedly performs a series of processes of STEPS S1905 to S1909 on each note data item (see FIG. 4A) of the input motif 108, until it is determined in STEP S1905 that the end ("END" of FIG. 4B) has been reached.

In the above-mentioned repetitive process, first, in STEP S1905, the CPU 1401 determines whether the pointer variable data item "me" indicates the end.

If the result of the determination of STEP S1905 is "NO", in STEP S1906, with reference to the "TIME" data "me→iTime" of the note data item (FIG. 4B) indicated by the pointer variable data item "me", the CPU 1401 adds the measure start time "sTime" obtained with respect to the corresponding measure of the input motif 108 in STEP S1902, to the value of the "TIME" data "me→iTime", and newly overwrites the "TIME" data "me→iTime" with the obtained result. Since the "TIME" data of each note data item constituting the input motif 108 is a time from the beginning of the input motif 108 composed of two measures, in order to convert the "TIME" data into a time from the beginning of the piece of music, the measure start time "sTime" obtained with respect to the corresponding measure of the input motif 108 from the music structure data item in STEP S1902 is added.

Subsequently, in STEP S1907, the CPU 1401 stores the value of the pointer variable data item "me" in a note pointer array variable data item note[iNoteCnt] which is an array variable data item having the current value of the variable data item iNoteCnt as its element value.

Thereafter, in STEP S1908, the CPU 1401 increases the value of the variable data item iNoteCnt by +1. Subsequently, the CPU 1401 stores pointers to the subsequent note data items (Nos. 1, 2 . . . note data items of FIG. 4A) of the input motif 108, in the pointer variable data item "me", in STEP S1909, and returns to the determining process of STEP S1905.

If the CPU 1401 reads the note data items of the input motif 108 up to the end (see FIG. 4A) as the result of the repetitive process of STEPS S1905 to S1909, the result of the determination of STEP S1905 becomes "YES". Therefore, the CPU proceeds to the checking process of STEP S1910. In this checking process, the process of calculating the matching level of No. n chord progression for the input motif 108 is performed, and the calculation result is obtained in the variable doValue. Thereafter, the CPU finishes the process exemplified in the flow chart of FIG. 19, that is, the process of STEP S1710 of FIG. 17 for checking the matching level of No. n chord progression for the input motif 108. At this time, the number of the notes (corresponding to the number of notes of FIG. 3A) constituting the input motif 108 is stored in the variable data item iNoteCnt, and pointers to the note data items are obtained in note pointer array variable data items note[0] to note[iNoteCnt-1], respectively.

Figure 20:
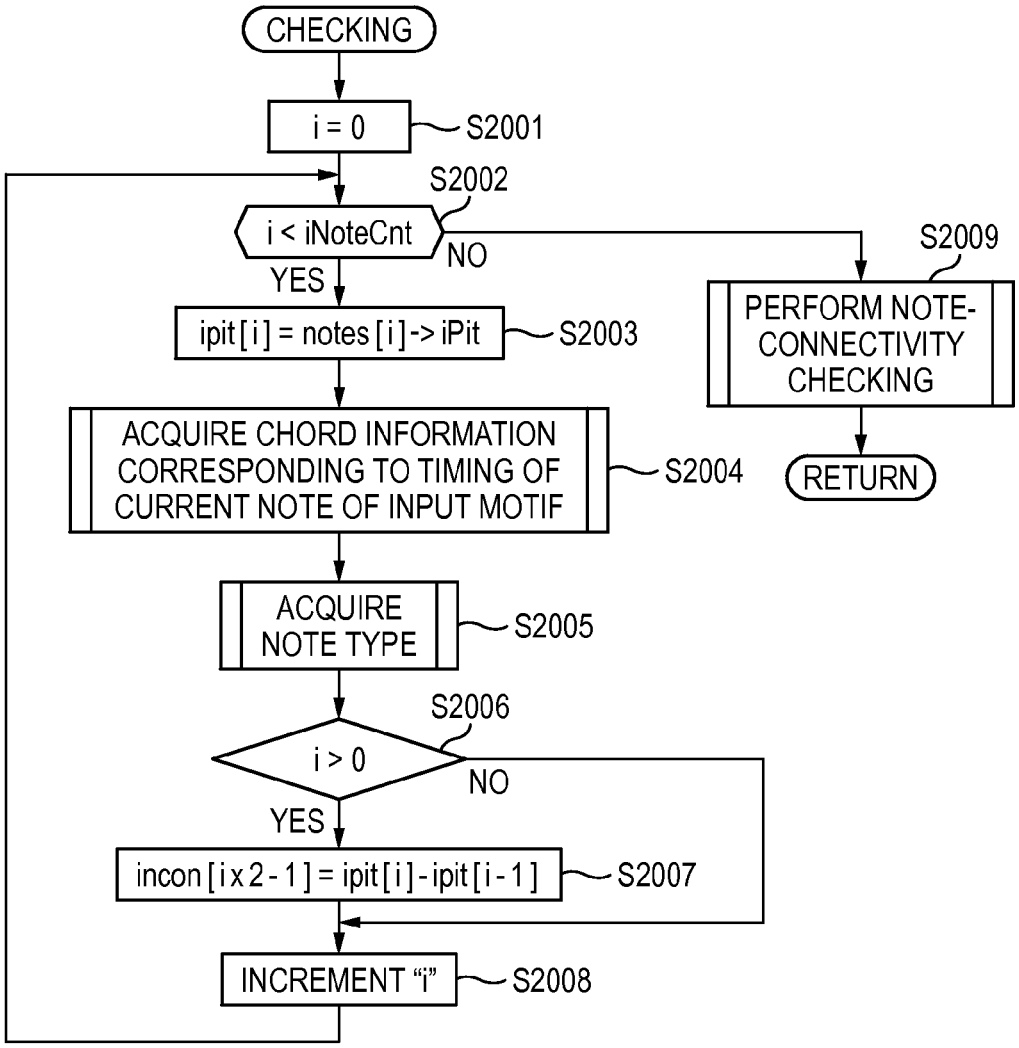
FIG. 20 is a flow chart illustrating a detailed example of the checking process.

FIG. 20 is a flow chart illustrating a detailed example of the checking process of STEP S1910 of FIG. 19.

First, in STEP S2001, the CPU 1401 stores an initial value "0" in a variable "i" which is retained in the RAM 1403 and is for counting the number of notes of the input motif 108. Thereafter, while incrementing the value of the variable "i", +1 by +1, in STEP S2008, the CPU performs a series of processes of STEPS S2002 to S2008, as long as it is determined in STEP S2002 that the value of the variable "i" is smaller than the value of the variable data item iNoteCnt representing the number of notes of the input motif 108 and finally obtained in the process of FIG. 19.

In the repetitive process of STEPS S2002 to S2008, first, in STEP S2002, the CPU 1401 determines whether the value of the variable "i" is smaller than the value of the variable data item iNoteCnt.

If the result of the determination of STEP S2002 is "YES", in STEP S2003, the CPU 1401 reads a pitch item value "note[i]→iPit" (indicating the value of the "PITCH" item of FIG. 4B) from a note pointer array variable data item note[i] corresponding to the i-th process target note indicated by the variable data item "i", and stores the read value in an array variable data item ipit[i] retained in the RAM 1403 and representing a pitch information sequence and having the value of the variable data item "i" as its element value.

Subsequently, in STEP S2004, the CPU 1401 performs a process of obtaining a chord information item corresponding to the timing of the current process target note of the input motif 108. In this process, the chord root, chord type, scale, and key of a chord which should be designated at the sound production timing of the current process target note of the input motif 108 are obtained in the variable data items "root", "type", "scale", and "key".

Subsequently, in STEP S2005, the CPU 1401 performs a note-type acquiring process. In this process, a note type of a pitch "ipit[i]" corresponding to the i-th note of the input motif 108 which is the current process target and related to No. n chord progression data item which is the current evaluation target is obtained in an array variable data item incon[i×2] (an even-numbered element) of note types and adjacent tones retained in the RAM 1403 and described above with reference to FIG. 8.

Subsequently, in STEP S2006, the CPU 1401 determines whether the value of the variable "i" is larger than 0, that is, whether the process target note is a note other than the beginning note.

In a case where the result of the determination of STEP S2006 is "YES", in STEP S2007, the CPU 1401 subtracts pitch information "ipit[i−1]" corresponding to the (i−1)-th process target note, from the pitch information "ipit[i]" corresponding to the i-th process target note indicated by the variable data item "i", thereby obtaining an adjacent tone described above with reference to FIG. 8 in an array variable data item incon[i×2−1] (an odd-numbered element) of note types and adjacent tones.

In a case where the result of the determination of STEP S2006 is "NO" (a case where the process target note is the beginning note), the CPU 1401 skips the process of STEP S2007.

Thereafter, the CPU 1401 increments the value of the variable "i" by +1 in STEP S2008, and proceeds to a process on the next note of the input motif 108, and returns to the determining process of STEP S2002.

After the CPU 1401 repeatedly performs the series of STEPS S2002 to S2008 while incrementing the value of the variable data item "i", if the process on every note data item constituting the input motif 108 finishes, the result of the determination of STEP S2002 becomes "NO". Then, the CPU proceeds to the note-connectivity checking process of STEP S2009. At this time, sets of note types and adjacent tones described above with reference to FIG. 8 are obtained in the array variable data items incon[i×2] (0≤i≤iNoteCnt-1) and incon[i×2−1] (1≤i≤iNoteCnt-1). Then, the CPU 1401 performs the note-connectivity checking process of STEP S2009 based on those data items, thereby obtaining the matching level of No. n chord progression data item, which is an evaluation target, for the input motif 108, as the variable data item doValue. Thereafter, the CPU 1401 finishes the process exemplified in the flow chart of FIG. 20, that is, the checking process of STEP S1910 of FIG. 19.

Figure 21:
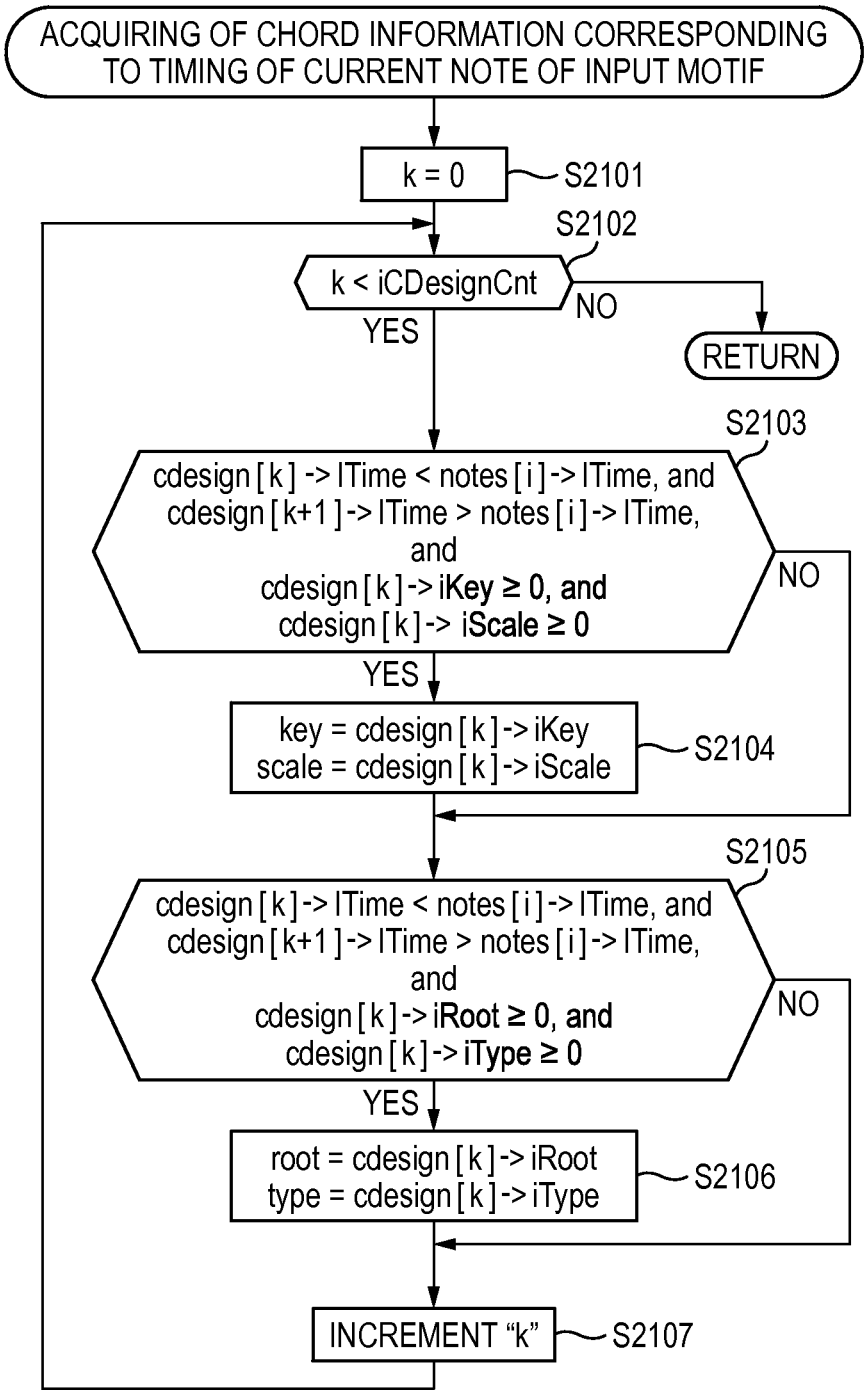
FIG. 21 is a view illustrating a detailed example of a process of acquiring chord information corresponding to the timing of a current note of the input motif.

FIG. 21 is a flow chart illustrating a detailed example of the process of STEP S2004 of FIG. 20 to acquire a chord information item corresponding to the timing of the current note of the input motif 108.

First, in STEP S2101, the CPU 1401 stores an initial value "0" in a variable "k" which is retained in the RAM 1403 and is for counting the number of information items of a chord design data item. Thereafter, while incrementing the value of the variable "k", +1 by +1, in STEP S2107, the CPU performs a series of processes of STEPS S2102 to S2107, as long as it is determined in STEP S2102 that the value of the variable "k" is smaller than the value of the variable data item iCDesignCnt representing the number of chord information items constituting No. n chord progression data item which is the current evaluation target and finally obtained in the process of FIG. 18.

In the repetitive process of S2102 to S2107, first, in STEP S2102, the CPU 1401 determines whether the value of the variable "k" is smaller than the value of the variable data item iCDesignCnt.

If the result of the determination of STEP S2102 is "YES", in STEP S2103, the CPU 1401 determines whether a time item value "note[i]→iTime" indicated by a note pointer array variable data item of a note which is the current process target is larger than the value of the time item "cdesign[k]→iTime" of the k-th chord design data item indicated by the variable "k" and is smaller than the value of a time item "cdesign[k+1]→iTime" of the (k+1)-th chord design data item, and each value of the key item "cdesign[k]→iKey" and scale item "cdesign[k]→iScale" of the k-th chord design data item has been set to a significant value equal to or larger than 0 (see STEPS S1806 and S1808 of FIG. 18).

If the result of the determination of STEP S2103 is "YES", it is possible to determine that a chord information item according to the k-th chord design data item cdesign[k] has been designated at the sound production timing of the note "note[i]" which is the current process target of the input motif 108. Therefore, in STEP 52104, the CPU 1401 stores the values of the key item "cdesign[k]→iKey" and the scale item "cdesign[k]→iScale" of the k-th chord design data item in the variable data items "key" and "scale", respectively.

If the result of the determination of STEP S2103 is "NO", the CPU 1401 skips the process of STEP 52104.

Subsequently, in STEP 52105, the CPU 1401 determines whether a time item value "note[i]→iTime" indicated by a note pointer array variable data item of a note which is the current process target is larger than the value of the time item "cdesign[k]→iTime" of the k-th chord design data item indicated by the variable "k" and is smaller than the value of a time item "cdesign[k+1]→iTime" of the (k+1)-th chord design data item, and each value of the chord root item "cdesign[k]→iRoot" and the chord type item "cdesign[k]→iType" of the k-th chord design data item has been set to a significant value equal to or larger than 0 (see STEPS S1806 and S1808 of FIG. 18).

If the result of the determination of STEP 52105 is "YES", it is possible to determine that a chord information item according to the k-th chord design data item cdesign[k] has been designated at the sound production timing of the note "note[i]" which is the current process target of the input motif 108. Therefore, in STEP 52106, the CPU 1401 stores the values of the root item "cdesign[k]→iRoot" and the type item "cdesign[k]→iType" of the k-th chord design data item in the variable data items "root" and "type", respectively.

If the result of the determination of STEP 52105 is "NO", the CPU 1401 skips the process of STEP 52106.

After the above described process, the CPU 1401 increments the value of the variable "k" by +1 in STEP S2107, and proceeds to a process on the next chord design data item cdesign[k], and returns to the determining process of STEP S2102.

After the CPU 1401 repeatedly performs the series of STEPS S2102 to S2107 while incrementing the value of the variable data item "k", if the process on every chord design data items finishes, the result of the determination of STEP S2102 becomes "NO". Then, the CPU finishes the process exemplified in the flow chart of FIG. 21, that is, the process of STEP S2004 of FIG. 20. As a result, chord information items corresponding to the sound production timing of the current process target note of the input motif 108 are obtained in the variable data items "root" and "type" and the variable data items "scale" and "key".

Figure 22:
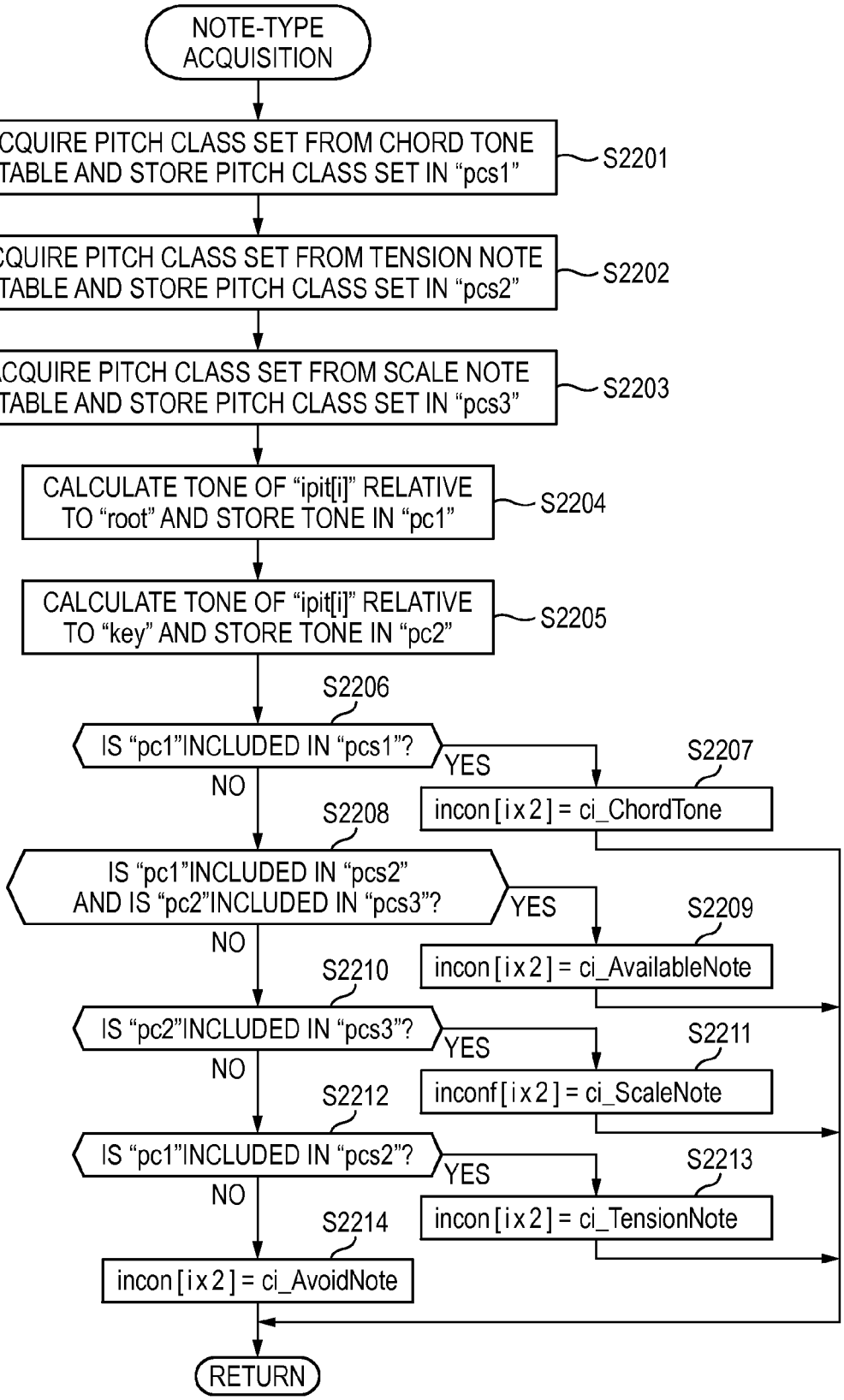
FIG. 22 is a view illustrating a detailed example of a note-type acquiring process.

FIG. 22 is a flow chart illustrating a detailed example of the note-type acquiring process of STEP S2005 of FIG. 20. This process is a process of acquiring the note type of the current note "notes[i]" of the input motif 108 according to a pitch "ipit[i]" which has been set in STEP S2003 of FIG. 20 and corresponds to the current note notes[i] of the input motif 108, and a key "key", a scale "scale", a chord root "root", and a chord type "type" constituting the chord progression which has been calculated in STEP S2004 of FIG. 20 and corresponds to the sound production timing of the current note "notes[i]" of the input motif 108.

First, in STEP 52201, the CPU 1401 acquires a chord tone pitch class set corresponding to the chord type "type" calculated in STEP S2004 of FIG. 20, from a chord tone table included in the standard pitch class set table stored in the ROM 1402 and having the data configuration exemplified in FIG. 7A, and stores the acquired chord tone pitch class set in a variable data item "pcs1" retained in the RAM 1403. Hereinafter, the value of the variable data item "pcs1" will be referred to as the chord tone pitch class set "pcs1".

Subsequently, in STEP 52202, the CPU 1401 acquires a tension tone pitch class set corresponding to the above-mentioned chord type "type", from a tension tone table included in the standard pitch class set table stored in the ROM 1402 and having the data configuration exemplified in FIG. 7B, and stores the acquired tension tone pitch class set in a variable data item "pcs2" retained in the RAM 1403. Hereinafter, the value of the variable data item "pcs2" will be referred to as the tension tone pitch class set "pcs2".

Subsequently, in STEP 52203, the CPU 1401 acquires a scale tone pitch class set corresponding to the scale "scale" obtained in STEP S2004 of FIG. 20, from a scale tone table included in the standard pitch class set table stored in the ROM 1402 and having the data configuration exemplified in FIG. 7C, and stores the acquired scale tone pitch class set in a variable data item "pcs3" retained in the RAM 1403. Hereinafter, the value of the variable data item "pcs3" will be referred to as the scale tone pitch class set "pcs3".

Subsequently, in STEP 52204, the CPU 1401 calculates the tone of the pitch "ipit[i]", obtained in STEP S2003 of FIG. 20 with respect to the note "notes[i]" of the current process target of the input motif 108, relative to the chord root "root" in a case of mapping the pitch "ipit[i]" to any one of the zeroth to eleventh scale constituent notes of one octave in a case of setting the chord root "root" as the zeroth scale constituent note, by the following expression, and stores the calculated tone in a variable data item "pc1" retained in the RAM 1403. Hereinafter, the value of the variable data item "pc1" will be referred to as the input motif pitch class "pc1".

$$pc1=(ipit[i]-root+12)\bmod 12 \quad (1)$$

Also, "mod 12" means the remainder obtained by dividing a value corresponding to the parentheses on the left of "mod 12" by 12.

Similarly, in STEP 52205, the CPU 1401 calculates the tone of the pitch "ipit[i]", obtained in STEP S2004 of FIG. 20 with respect to the current note "notes[i]" of the input motif 108, relative to the key "key" in a case of mapping the pitch "ipit[i]" to any one of the zeroth to eleventh scale constituent notes of one octave in a case of setting the key "key" as the zeroth scale constituent note, by the following expression, and stores the calculated tone in a variable data item "pc2" retained in the RAM 1403. Hereinafter, the value of the variable data item "pc2" will be referred to as the input motif pitch class "pc2".

$$pc2=(ipit[i]-key+12)\bmod 12 \quad (2)$$

Subsequently, in STEP 52206, the CPU 1401 determines whether the input motif pitch class "pc1" is included in the chord tone pitch class set "pcs1". This determination calculation process is implemented as a calculation process of taking the logical AND of the pc1-th power of 2 ($2^{pc1}$) and each pitch of the chord tone pitch class set "pcs1" (see FIG. 7A) and determining whether the obtained result is equal to $2^{pc1}$.

If the result of the determination of STEP 52206 is "YES", in STEP 52207, the CPU 1401 determines that the note type is "CHORD TONE", and reads the value of the constant data item ci_ChordTone representing "CHORD TONE", from the ROM 1402, and stores the read value in the location incon[i×2] of the note type element of the array of note types and adjacent tones. Thereafter, the CPU 1401 finishes the process exemplified in the flow chart of FIG. 22, that is, the note-type acquiring process of STEP S2005 of FIG. 20.

If the result of the determination of the STEP 52206 is "NO", in STEP 52208, the CPU 1401 determines whether the input motif pitch class "pc1" is included in the tension tone pitch class set "pcs2" and the input motif pitch class "pc2" is included in the scale tone pitch class set "pcs3". This determination calculation process is implemented as a calculation process of taking the logical AND of the pc1-th power of 2 ($2^{pc1}$) and each pitch of the tension tone pitch class set "pcs2" (see FIG. 7B), and determining whether the obtained result is equal to $2^{pc1}$, and taking the logical AND of the pc2-th power of 2 ($2^{pc2}$) and each pitch of the scale tone pitch class set "pcs3" (see FIG. 7C), and determining whether the obtained result is equal to $2^{pc2}$.

If the result of the determination of STEP 52208 is "YES", in STEP 52209, the CPU 1401 determines that the note type is "AVAILABLE NOTE", and reads the value of a constant data item ci_AvailableNote representing "AVAILABLE NOTE", from the ROM 1402, and stores the read value in the location incon[i×2] of the note type element of the array of note types and adjacent tones. Thereafter, the CPU 1401 finishes the process exemplified in the flow chart of FIG. 22, that is, the note-type acquiring process of STEP S2005 of FIG. 20.

If the result of the determination of the STEP 52208 is "NO", in STEP 52210, the CPU 1401 determines whether the input motif pitch class "pc2" is included in the scale tone pitch class set "pcs3". This determination calculation process is implemented as a calculation process of taking the logical AND of the pc2-th power of 2 ($2^{pc2}$) and each pitch of the scale tone pitch class set "pcs3" (see FIG. 7C) and determining whether the obtained result is equal to $2^{pc2}$.

If the result of the determination of STEP 52210 is "YES", in STEP 52211, the CPU 1401 determines that the note type is "SCALE NOTE", and reads the value of a constant data item ci_ScaleNote representing "SCALE NOTE", from the ROM 1402, and stores the read value in the location incon[i×2] of the note type element of the array of note types and adjacent tones. Thereafter, the CPU 1401 finishes the process exemplified in the flow chart of FIG. 22, that is, the note-type acquiring process of STEP S2005 of FIG. 20.

If the result of the determination of the STEP 52210 is "NO", in STEP 52212, the CPU 1401 determines whether the input motif pitch class "pc1" is included in the tension tone pitch class set "pcs2". This determination calculation process is implemented as a calculation process of taking the logical AND of the pc1-th power of 2 ($2^{pc1}$) and each pitch of the tension tone pitch class set "pcs2" (see FIG. 7B) and determining whether the obtained result is equal to $2^{pc1}$.

If the result of the determination of STEP 52212 is "YES", in STEP 52213, the CPU 1401 determines that the note type is "TENSION NOTE", and reads the value of a constant data item ci_TensionNote representing "TENSION NOTE", from the ROM 1402, and stores the read value in the location incon[i×2] of the note type element of the array of note types and adjacent tones. Thereafter, the CPU 1401 finishes the process exemplified in the flow chart of FIG. 22, that is, the note-type acquiring process of STEP S2005 of FIG. 20.

Finally, if the result of the determination of STEP 52212 is "NO", in STEP 52214, the CPU 1401 determines that the note type is "AVOID NOTE", and reads the value of a constant data item ci_AvoiNote representing "AVOID NOTE", from the ROM 1402, and stores the read value in the location incon[i×2] of the note type element of the array of note types and adjacent tones. Thereafter, the CPU 1401 finishes the process exemplified in the flow chart of FIG. 22, that is, the note-type acquiring process of STEP S2005 of FIG. 20.

By the note-type acquiring process of STEP S2005 of FIG. 20 exemplified in the flow chart of FIG. 22 described above, the note type of the current note "notes[i]" of the input motif 108 is acquired in the location incon[i×2] (see FIG. 7B) of the note type element of the array of note types and adjacent tones.

Figure 23:
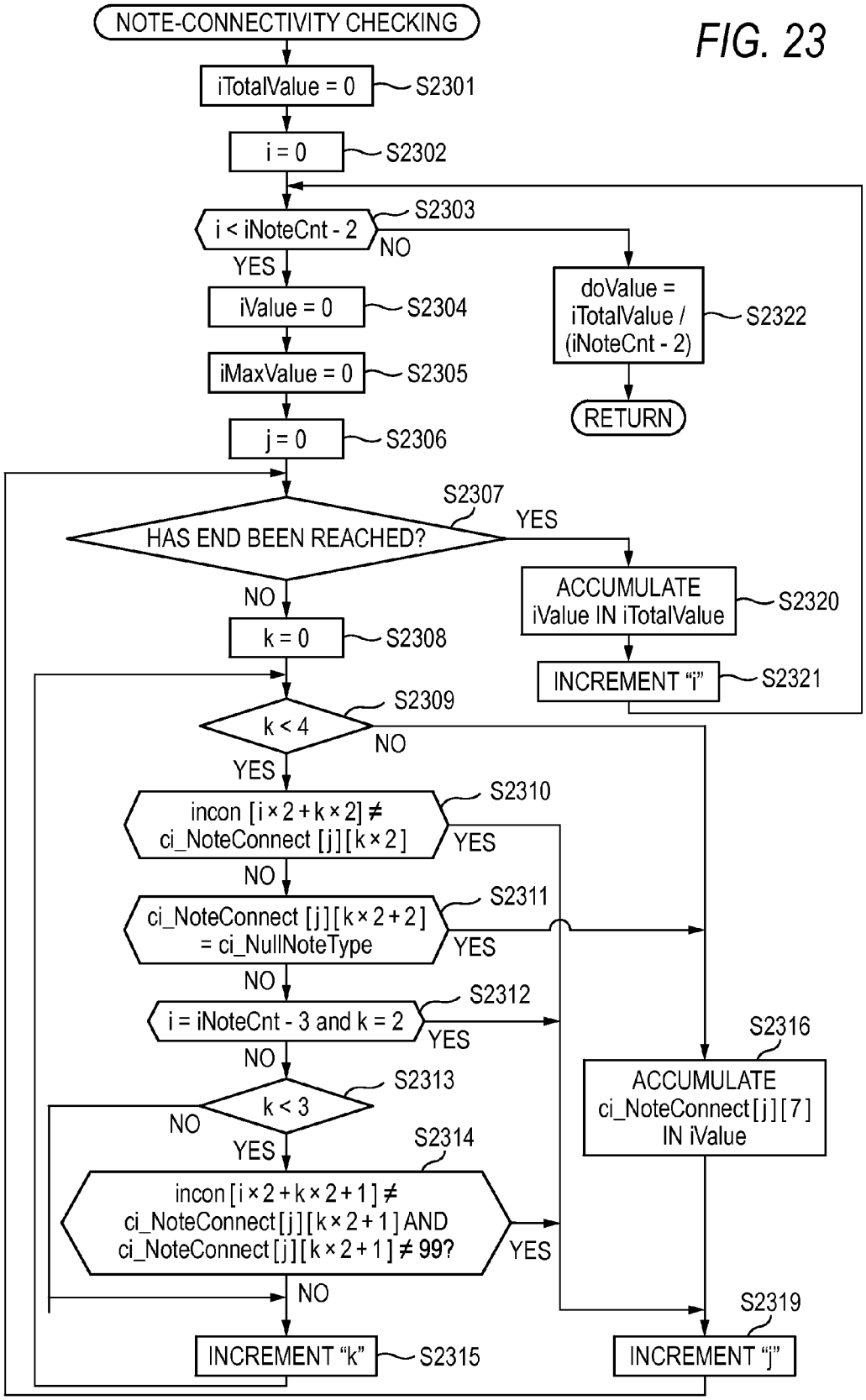
FIG. 23 is a view illustrating a detailed example of a note-connectivity checking process.

FIG. 23 is a flow chart illustrating a detailed example of the note-connectivity checking process of FIG. 20. This process implements the process described above with reference to FIG. 10.

First, in STEP S2301, the CPU 1401 stores an initial value "0" in a variable data item iTotalValue retained in the RAM 1403. This data item holds the total evaluation points for calculating the matching level of No. n chord progression data item (see STEP S1704 of FIG. 17), which is the current evaluation target, for the input motif 108.

Subsequently, in STEP S2302, the CPU 1401 stores an initial value "0" in the variable data item "i". Thereafter, while incrementing the variable data item "i", +1 by +1, in STEP S2321, the CPU repeatedly performs a series of processes of STEPS S2303 to S2321, as long as the result of the determination of STEP S2303 is "YES", that is, it is determined that the value of the variable data item "i" is smaller than a value obtained by subtracting 2 from the value of the variable data item iNoteCnt. This repetitive process corresponds to the repetitive process on each note of the input motif 108 of FIG. 10B from i=0 to i=7.

In a series of processes of STEPS S2304 to S2320 which is performed on each i-th note of the input motif 108, first, in STEP S2304, the CPU 1401 stores an initial value "0" in a variable data item iValue retained in the RAM 1403. Subsequently, in STEP S2306, the CPU 1401 stores an initial value "0" in a variable data item "j". Thereafter, while incrementing the variable data item "j", +1 by +1, in STEP S2318, the CPU 1401 repeatedly performs a series of processes of STEPS S2307 to S2319, until the result of the determination of STEP S2307 becomes "YES", that is, the value of the variable data item "j" reaches its end value. This repetitive process corresponds to the repetitive process of checking each note connection rule of FIG. 9 determined by the value of the variable data item "j" for each i-th note.

In a series of processes of STEP S2308 to S2316 to check the j-th note connection rule for each i-th note of the input motif 108, in STEP S2308, the CPU 1401 stores an initial value "0" in a variable data item "k" retained in the RAM 1403. Subsequently, while incrementing the variable data item "k", +1 by +1, in STEP S2315, the CPU repeatedly performs a series of processes of STEPS S2309 to S2315. By this repetitive process, it is determined whether four note types incon[i×2], incon[i×2+2], incon[i×2+4], and incon[i×2+6] corresponding to four consecutive notes from the i-th note of the input motif 108 coincide with four note types ci_NoteConnect[j][0], ci_NoteConnect[j][2], ci_NoteConnect[j][4], and ci_NoteConnect[j][6] included in the j-th note connection rule exemplified in FIG. 9, respectively. Also, it is determined whether three adjacent tones incon[i×2+1], incon[i×2+3], and incon[i×2+5] relative to the four consecutive notes from the i-th note of the input motif 108 coincide with three adjacent tones ci_NoteConnect[j][1], ci_NoteConnect[j][3], and ci_NoteConnect[j][5] included in the j-th note connection rule exemplified in FIG. 9, respectively.

After a process of repeatedly performing the series of the processes of STEPS S2309 to S2315 four times while incrementing the value of the variable data item "k" from 0 to 3 is performed as the process of comparing four consecutive notes from the i-th note of the input motif 108 with the j-th note connection rule of FIG. 9, if any one of the conditions of STEPS S2310, S2312, S2314 is satisfied, the j-th note connection rule which is the current target is not appropriate for the input motif 108. Therefore, the CPU proceeds to STEPS S2319 in which the CPU increments the value of the variable data item "j", whereby the process transitions to suitability evaluation on the next note connection rule.

Specifically, in STEP S2310, the CPU 1401 determines whether the note type incon[i×2+k×2] of the (i+k)-th note of the input motif 108 is different from the k-th note type ci_NoteConnect[j][k×2] of the j-th note connection rule. If the result of the determination of STEP S2310 is "YES", since at least one note type of the corresponding note connection rule does not coincide with at least one of the note types of the four notes starting with the i-th note (the current process target) of the input motif 108, the CPU 1401 proceeds to STEP S2319.

If the result of the determination of STEP S2310 is "NO", STEPS S2311 and S2312 (to be described below) are performed. When both of the determination results of STEPS S2311 and S2312 are "NO", if the value of the variable data item "k" is smaller than 3, the result of the determination of STEP S2313 becomes "YES", and thus the CPU 1401 performs an adjacent tone determining process in STEP S2314. The determination of STEP S2313 is performed for performing the adjacent tone determining process only in a range in which the value of the variable data item "k" is any one of 0 to 2 since there is no adjacent tone from the fourth note (wherein k=3) of the input motif 108. In STEP S2314, the CPU 1401 determines whether an adjacent tone incon[i×2+k×2+1] between the (i+k)-th note and (i+k+1)-th note of the input motif 108 is different from an adjacent tone ci_NoteConnect[j][k×2+1] between the k-th note type and (k+1)-th note type of the j-th note connection rule, and the value of the adjacent tone ci_NoteConnect[j][k×2+1] is different from "99". The adjacent tone value "99" represents that the corresponding adjacent tone can have any value. If the result of the determination of STEP S2314 is "YES", since at least one adjacent tone of the corresponding note connection rule does not coincide with at least one of adjacent tones of four notes starting with the i-th note (the current process target) of the input motif 108, and thus the CPU 1401 proceeds to STEP S2319.

In the above described series of processes, if coincidence of the note type incon[i×2+k×2] of the (i+k)-th note of the input motif 108 and the k-th note type ci_NoteConnect[j][k×2] of the j-th note connection rule is detected in STEP S2310, whereby the result of the determination of STEP S2310 becomes "NO", in STEP S2311, the CPU 1401 determines whether the (k+1)-th note type ci_NoteConnect[j][k×2+2] next to the k-th note type of the j-th note connection rule is "ci_NullNoteType".

The value "ci_NullNoteType" is set as the note type ci_NoteConnect[j][6] in a case of k=3 in the note connection rules from j=0 to j=8 shown in FIG. 9. Therefore, the case where the result of the determination of STEP S2311 becomes "YES" is a case where the range of the value of the variable data item "j" is from 0 to 8 and coincidence of note types and adjacent tones is determined with respect to three notes in which the value of the variable data item "k" is 0, 1, or 2, whereby k is 2. As described above, since the note connection rules of the range where the variable data item "j" is any one of 0 to 8 are three-note rules, the fourth note becomes "ci_NullNoteType" and thus does not need to be evaluated. Therefore, in the case where the result of the determination of STEP S2311 becomes "YES", the note connection rule at that moment is suitable for three notes starting with the i-th note of the input motif 108. Therefore, if the result of the determination of STEP S2311 becomes "YES", the CPU 1401 proceeds to STEP S2316 in which the CPU accumulates the evaluation points ci_NoteConnect[j][7] (see FIG. 9) of the corresponding note connection rule in the variable data item iValue.

Meanwhile, in a case where the result of the determination of STEP S2311 becomes "NO", the CPU proceeds to the adjacent tone evaluating process of STEP S2314 through STEPS S2312 and S2313. Here, immediately after the result of the determination of STEP S2311 becomes "NO", in STEP S2312, the CPU 1401 determines whether the value of the variable data item "i" is equal to a value obtained by subtracting 3 from the value of the variable data item iNoteCnt representing the number of notes of the input motif 108, and the value of the variable data item "k" is equal to 2. In this case, a note of the input motif 108 to be a process target becomes the (i+k)-th note, that is, the (iNoteCnt-3+2=iNoteCnt-1)-th note, that is, the final note of the input motif 108. In this state, in STEP S2311, in a case where the value of the (k+1)-th note type ci_NoteConnect[j][k×2+2], that is, the note type ci_NoteConnect[j][6] does not become ci_NullNoteType is a case where a note connection rule of FIG. 9 having a j value equal to or larger than 9 is being processed. That is, the note connection rule is a rule relative to four notes. Meanwhile, in this case, notes of the input motif 108 which are process targets are three notes from the (iNoteCnt-3)-th note to the (iNoteCnt-1)-th note which is the final note. Therefore, in this case, since the number of the notes of the input motif 108 which are process targets does not coincide with the number of notes of the note connection rule, the corresponding note connection rule is not suitable for the input motif 108. Therefore, in the case where the result of the determination of STEP S2312 becomes "YES", the CPU 1401 proceeds to STEP S2319 without performing suitability evaluation on the corresponding note connection rule.

If the series of processes of STEPS S2309 to S2315 is repeatedly performed four times without satisfying any one of the conditions of STEPS S2310, S2311, S2312, and S2314 described above, whereby the result of the determination STEP S2309 becomes "NO", with respect to four consecutive notes from the i-th note of the input motif 108, all of the note types and the adjacent tones are suitable for the note types and adjacent tones of the j-th note connection rule which is the current evaluation target. In this case, the CPU 1401 proceeds to STEP S2316 in which the CPU accumulates the evaluation points ci_NoteConnect[j][7] (see FIG. 9) of the j-th note connection rule which is the current evaluation target, in the variable data item iValue.

Also, the number of note connection rules which are suitable for the input motif 108 is not always one. For example, the input motif may be suitable not only for a note connection rule for three notes but also for a note connection rule for four notes. Therefore, while the CPU 1401 increments the value of the variable data item "j" in STEP S2319, whenever the result of the determination of STEP S2309 becomes "NO" or the result of the determination of STEP S2311 becomes "YES", whereby it is determined that a corresponding note connection rule is suitable, the evaluation points ci_NoteConnect[j][7] of the new suitable note connection rule is accumulated in the variable data item iValue, until evaluation on every note connection rule in STEP S2307 is completed.

Thereafter, the CPU 1401 increments the value of the variable data item "j" by +1 in STEP S2319, thereby proceeding to evaluation on the next note connection rule, and returns to the determining process of STEP S2307.

If evaluation on every note connection rule is completed, whereby the result of the determination of STEP S2307 becomes "YES", in STEP S2320, the CPU 1401 accumulates the evaluation points accumulated in the variable data item iValue, in a variable data item iTotalValue corresponding to No. n chord progression data item which is the current process target.

Thereafter, the CPU 1401 increments the value of the variable data item "i" by +1 in STEP S2321, and returns to the determining process of STEP S2303, thereby proceeding to the process on the next note of the input motif 108 (see FIG. 10B).

If the suitability evaluation process on every note connection rule relative to every note of the input motif 108 finishes, the result of the determination STEP S2303 becomes "NO". Here, the end location of the process target notes of the input motif 108 is originally the third note from the final note of the input motif 108, and the value of the variable data item "i" corresponding thereto is "(iNoteCnt-1)-3", that is, "iNoteCnt-4". However, as shown by i=7 in FIG. 10B, since the final process is performed with three notes, the value of the variable data item "i" corresponding to the end location becomes "iNoteCnt-3". Therefore, the finish determination of STEP S2303 becomes a case where the value of the variable data item "i" is not smaller than iNoteCnt-2.

If the result of the determination of STEP S2303 becomes "NO", in STEP S2322, the CPU 1401 divides the value of the variable data item iTotalValue by the number (iNoteCnt-2) of processed notes of the input motif 108, thereby performing normalization, and stores the division result, as the matching level of No. n chord progression for the input motif 108, in the variable data item doValue. Thereafter, the CPU 1401 finishes the note-connectivity checking process of the flow chart of FIG. 23, that is, STEP S2009 of FIG. 20.

Figure 24:
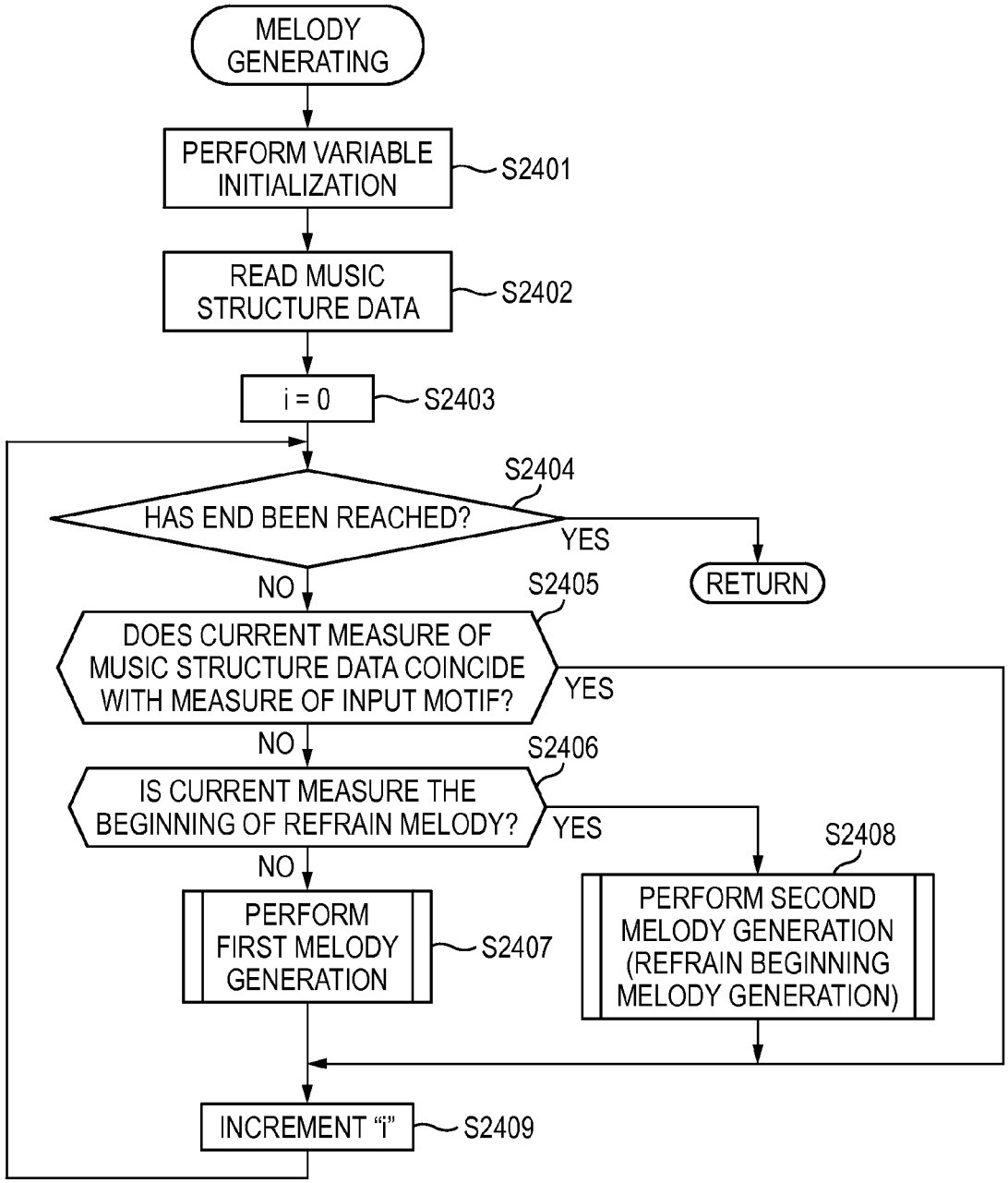
FIG. 24 is a view illustrating a detailed example of a melody generating process.

FIG. 24 is a flow chart illustrating a detailed example of the melody generating process of STEP S1608 which is performed next to the chord-progression selecting process of STEP S1607 in the automatic composition process of FIG. 16.

First, in STEP 52401, the CPU 1401 initializes a variable area of the RAM 1403.

Subsequently, in STEP 52402, the CPU 1401 reads a music structure data item (see FIG. 6) corresponding to the chord progression candidate selected by the chord-progression selecting process of STEP S1607 of FIG. 16, for example, designated by the user, from the accompaniment/chord-progression DB 103.

Subsequently, in STEP 52403, the CPU 1401 sets the value of the variable data item "i" to an initial value "0". Thereafter, while the CPU increments the value of the variable data item "i" in STEP 52409, with respect to the phrase of each measure of the music structure data item indicated by the variable data item "i", the CPU automatically generates a melody for the corresponding phrase with reference to the input motif 108, the phrase sets (see FIG. 11) registered in the phrase set DB 106 retained in the ROM 1402, and the rule DB 104 (see FIG. 9) retained in the ROM 1402, until it is determined in STEP S2404 that the end of the music structure data item has been reached. The value of the variable data item "i" is incremented from 0, +1 by +1, in STEP 5240, whereby the values of "Measure" items of the music structure data item exemplified in FIG. 6 are sequentially designated, and the individual records on the music structure data item are sequentially designated.

Specifically, first, in STEP S2404, the CPU 1401 determines whether the end of the music structure data item has been reached.

If the result of the determination of STEP S2404 is "NO", in STEP 52405, the CPU 1401 determines whether the current measure of the music structure data item designated by the variable data item "i" coincides with a measure of the input motif 108.

If the result of the determination of STEP 52405 is "YES", the CPU 1401 intactly outputs the input motif 108 as a part of the melody data 110 (see FIG. 1), for example, to an output melody area on the RAM 1403.

If the result of the determination of STEP 52405 is "NO", in STEP 52406, the CPU 1401 determines whether the current measure is the beginning measure of a refrain melody.

If the result of the determination of STEP 52406 is "NO", in STEP 52407, the CPU 1401 performs a first melody generating process.

Meanwhile, if the result of the determination of STEP 52406 is "YES", in STEP S2408, the CPU 1401 performs a second melody generating process.

After the process of STEP 52407 or S2408, in STEP 52409, the CPU 1401 increments the variable data item "i" by +1. Thereafter, the CPU 1401 returns to the determining process of STEP S2404.

Figure 25:
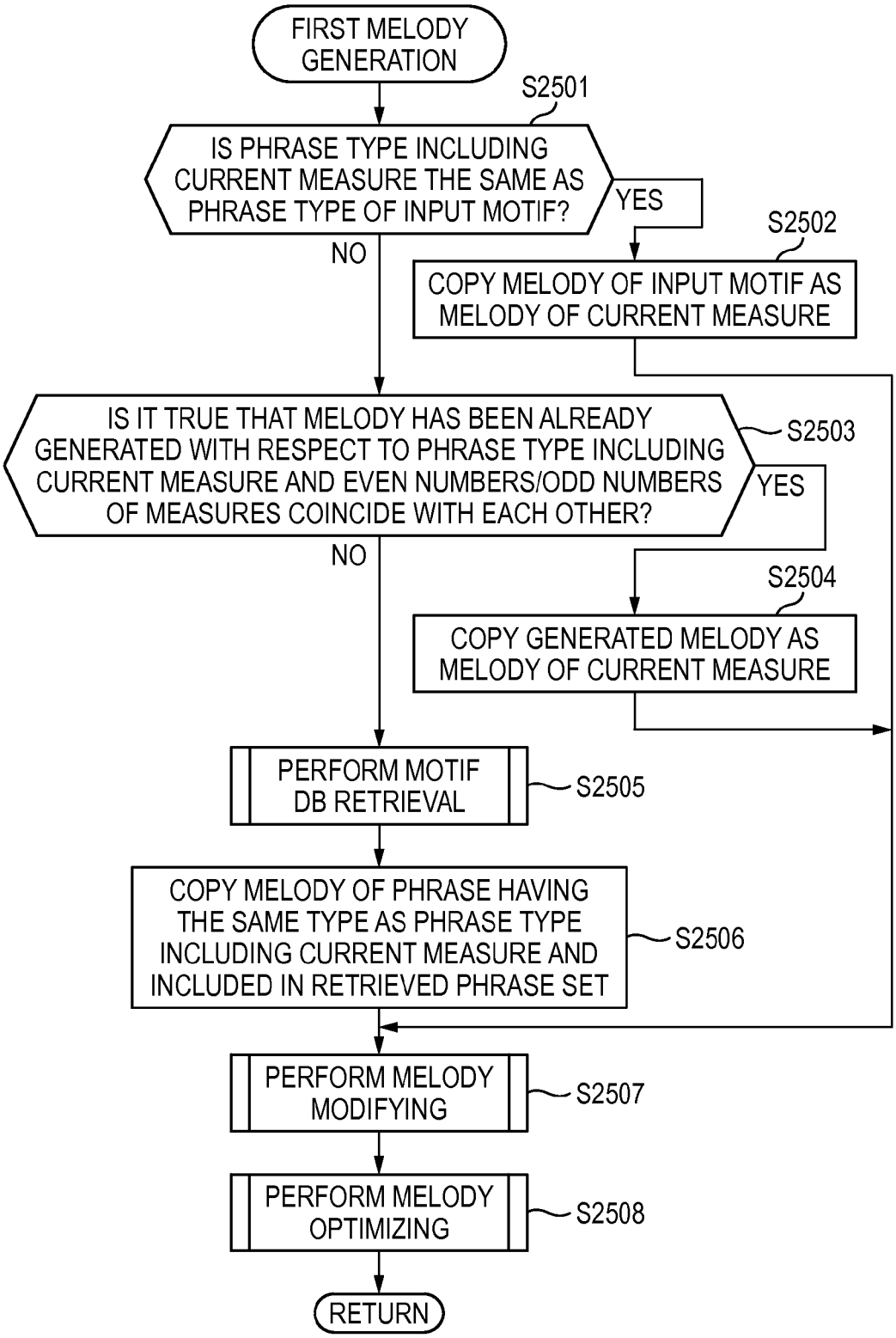
FIG. 25 is a view illustrating a detailed example of a first melody generating process.

FIG. 25 is a flow chart illustrating a detailed example of the first melody generating process of STEP 52407 of FIG. 24.

In STEP 52501, the CPU 1401 determines whether a phrase type including the current measure is the same as the phrase type of the input motif 108. A phrase type including the current measure can be determined by referring to a "PartName[M]" item and a "iPartID[M]" item of a record having a "Measure" item corresponding to the value of the variable data item "i" and included in the music structure data item exemplified in FIG. 6. The phrase type of the input motif 108 is designated when the user inputs the input motif 108.

If the result of the determination of STEP 52501 is "YES", the CPU 1401 copies the melody of the input motif 108, as the melody of the current measure, in a predetermined area of the RAM 1403. Thereafter, the CPU 1401 proceeds to a melody modifying process of STEP S2507.

If the result of the determination of STEP 52501 is "NO", in STEP 52503, with respect to the phrase type including the current measure, the CPU 1401 determines whether a melody has been already generated and the even numbers/odd numbers of the measures coincide with each other.

If the result of the determination of STEP 52503 is "YES", in STEP S2504, the CPU 1401 copies the generated melody as the melody of the current measure in a predetermined area of the RAM 1403. Thereafter, the CPU 1401 proceeds to the melody modifying process of STEP S2507.

If a melody for the corresponding phrase has not been generated yet (the result of the determination of STEP 52503 is "NO"), in STEP S2505, the CPU 1401 performs a phrase-set-DB retrieval process. In the phrase-set-DB retrieval process, the CPU 1401 extracts a phrase set corresponding to the input motif 108, from the phrase set DB 106.

Subsequently, in STEP S2506, the CPU 1401 copies the melody of a phrase having the same type as the phrase type including the current measure and included in the phrase set retrieved in STEP S2505, in a predetermined area of RAM 1403. Thereafter, the CPU 1401 proceeds to the melody modifying process of STEP S2507.

After the process of STEP S2502, S2504, or S2506, in STEP S2507, the CPU 1401 performs the melody modifying process of modifying the copied melody.

Thereafter, in STEP S2508, the CPU 1401 performs a melody optimizing process of optimizing the pitch of each note constituting the melody modified in STEP S2507. As a result, the CPU 1401 automatically generates a melody of the phrase of each measure represented by the music structure data item, and outputs the generated melody to the output melody area of the RAM 1403.

Figure 26:
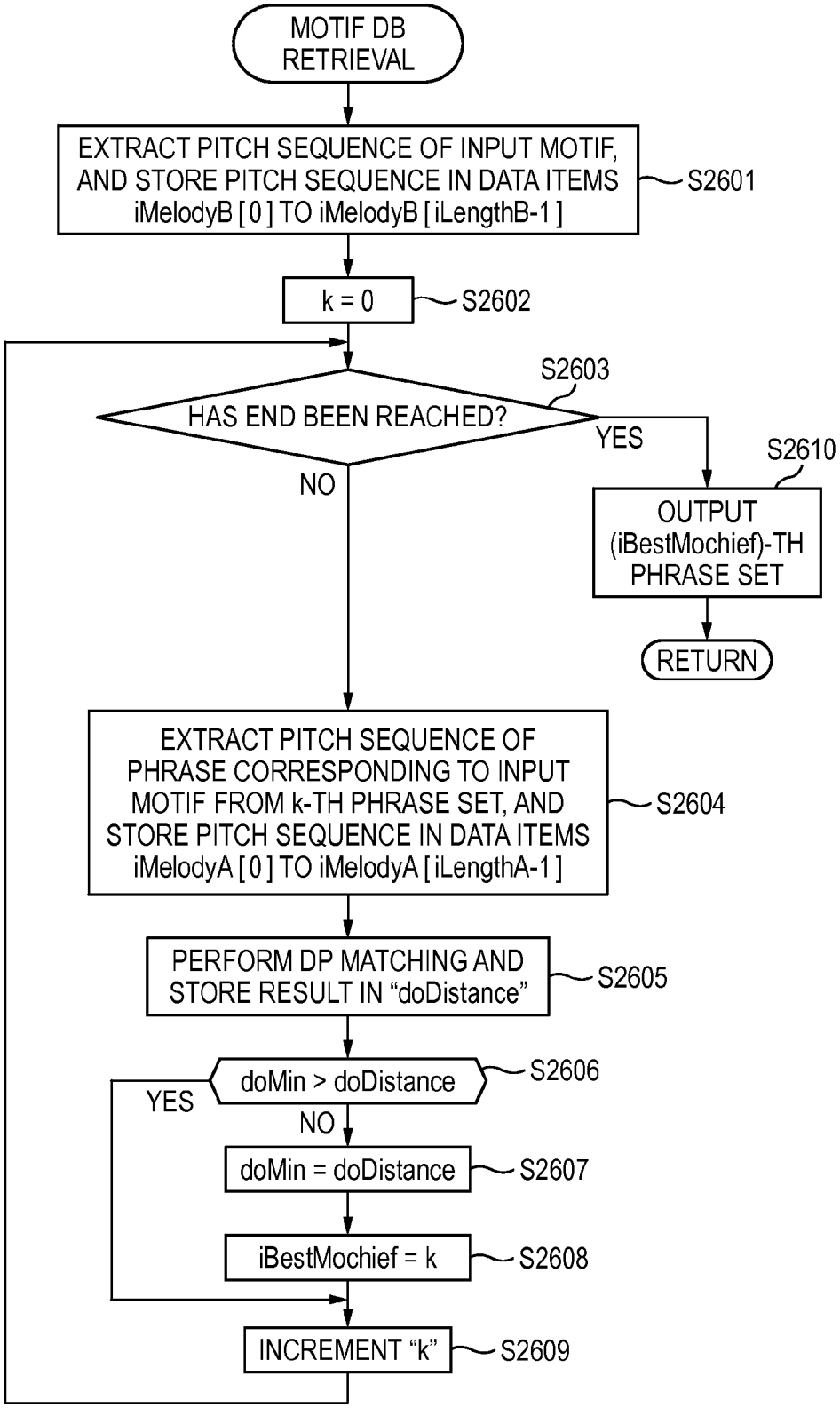
FIG. 26 is a view illustrating a detailed example of a phrase-set-DB retrieval process.

FIG. 26 is a flow chart illustrating a detailed example of the phrase-set-DB retrieval process of STEP S2505 of FIG. 25.

First, the CPU 1401 extracts the pitch sequence of the input motif 108, and stores the pitch sequence in array variable data items iMelodyB[0] to iMelodyB[iLengthB-1] retained in the RAM 1403. Here, in a variable data item iLengthB, the length of the pitch sequence of the input motif 108 is stored.

Subsequently, in STEP S2602, the CPU 1401 sets the value of the variable data item "k" to an initial value "0". Thereafter, while incrementing the value of the variable data item "k" in STEP S2609, the CPU 1401 repeatedly performs a series of STEPS S2603 to S2609 on a phrase set (see FIG. 11A) designated by the variable data item "k", until it is determined in STEP S2603 that the end of the phrase set DB 106 (see FIG. 11A) has been reached.

In this series of processes, first, in STEP S2604, the CPU 1401 extracts the pitch sequence of a phrase corresponding to the input motif 108, from the k-th phrase set represented by the variable data item "k", and stores the pitch sequence in array variable data items iMelodyA[0] to iMelodyA [iLengthA-1] retained in the RAM 1403. Here, a variable data item iLengthA, the length of the pitch sequence of the phase retained in the phrase set DB 106 is stored.

Subsequently, the CPU 1401 performs a DP (Dynamic Programming) matching process between the array variable data items iMelodyB[0] to iMelodyB[iLengthB-1] regarding to the pitch sequence of the input motif 108 and set in STEP S2601 and the array variable data items iMelodyA[0] to iMelodyA[iLengthA-1] regarding to the pitch sequence of the corresponding phrase included in the k-th phrase set retained in the phrase set DB 106 and set in STEP S2604, thereby calculating a distance evaluation value between them, and stores the distance evaluation value in a variable data item doDistance retained in the RAM 1403.

Subsequently, in STEP S2606, the CPU 1401 determines whether a minimum distance evaluation value represented by the variable data item doMin retained in the RAM 1403 is larger than the distance evaluation value doDistance newly calculated by the DP matching process of STEP S2605.

If the result of the determination STEP S2606 is "NO", in STEP S2607, the CPU 1401 stores the new distance evaluation value stored in the variable data item doDistance, in a variable data item doMin.

Subsequently, in STEP S2608, the CPU 1401 stores the value of the variable data item "k" in a variable data item iBestMochief retained in the RAM 1403.

If the result of the determination of STEP S2606 is "YES", the CPU 1401 skips the processes of STEPS S2607 and S2608.

Thereafter, the CPU 1401 increments the value of the variable data item "k" by +1, thereby proceeding to the process on the next phrase set (see FIG. 11A) included in the phrase set DB 106.

If the DP matching process between every phrase set retained in the phrase set DB 106 and the input motif 108 finishes, whereby the result of the determination of the STEP S2603 becomes "YES", in STEP S2610, the CPU 1401 outputs a phrase set having a number represented by the variable data item iBestMochief and retained in the phrase set DB 106, to a predetermined area of the RAM 1403. Thereafter, the CPU 1401 finishes the process of the flow chart exemplified in FIG. 26, that is, the phrase-set-DB retrieval process of STEP S2505 of FIG. 25.

Figure 27:
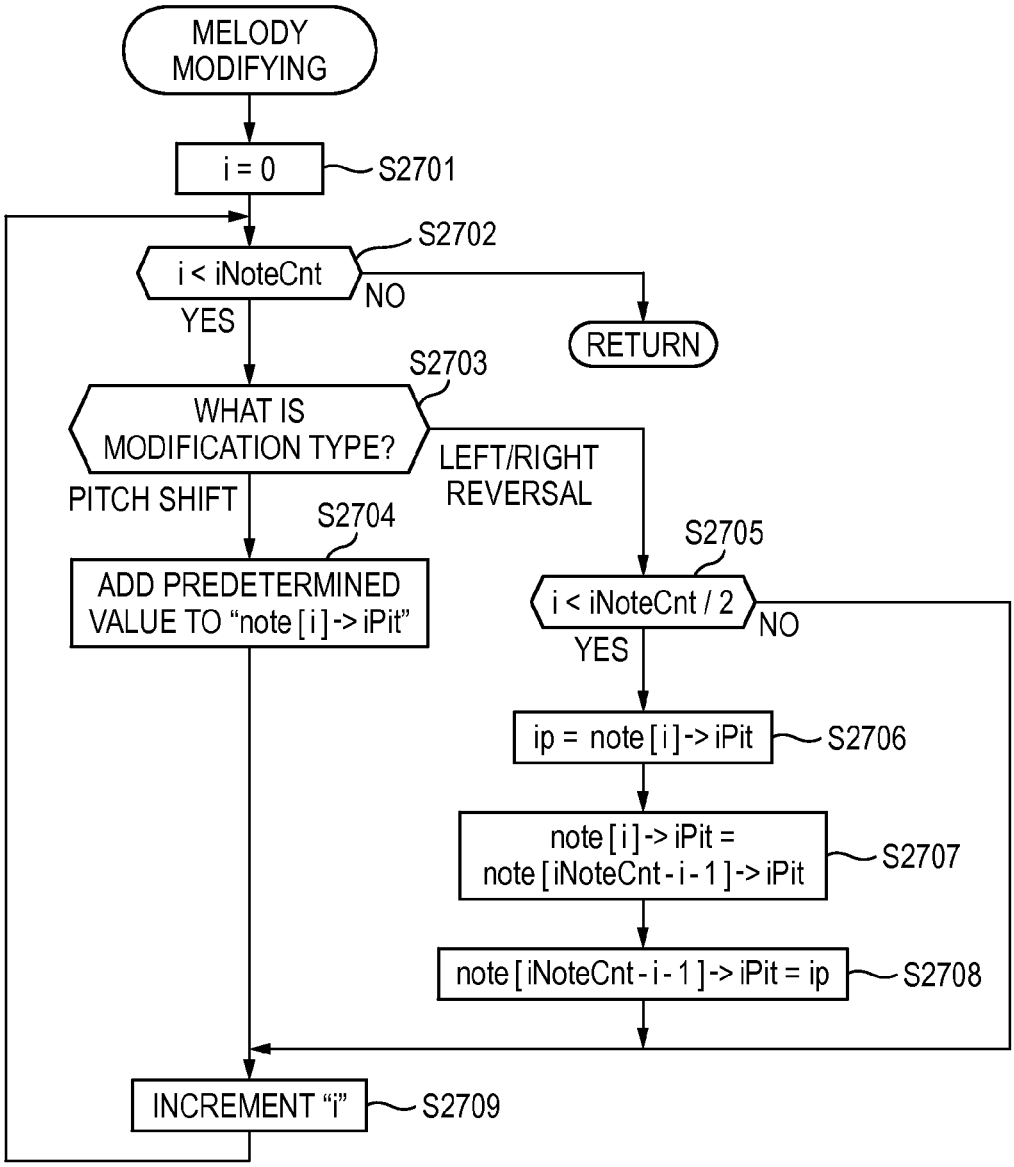
FIG. 27 is a view illustrating a detailed example of the melody modifying process.

FIG. 27 is a flow chart illustrating a detailed example of the melody modifying process of STEP S2507 of FIG. 25. This melody modifying process is performed based on pitch shift or left/right reversing described above with reference to FIGS. 12A and 12B.

First, in STEP S2701, the CPU 1401 stores an initial value "0" in the variable "i" which is retained in the RAM 1403 and is for counting the number of notes of the melody obtained by the copying process of FIG. 25. Thereafter, while incrementing the value of the variable "i", +1 by +1, in STEP S2709, the CPU 1401 repeatedly performs a series of STEPS S2702 to S2709 as long as it is determined in STEP S2702 that the value of the variable "i" is smaller than the value of the variable data item iNoteCnt representing the number of notes of the melody.

In the repetitive process of STEPS S2702 to S2709, first, in STEP S2702, the CPU 1401 acquires a modification type. The modification type is "PITCH SHIFT" or "LEFT/RIGHT REVERSING", and the user can designate the modification type by a switch (not specifically shown).

In a case where the modification type is "PITCH SHIFT", in STEP S2704, the CPU 1401 adds a predetermined value to pitch data "note[i]→iPit" retained in an iPit item of the array variable data item note[i], thereby performing pitch shift to raise pitches, for example, by two semitones as described with respect to the reference symbol "1201" of FIG. 12.

In a case where the modification type is "LEFT/RIGHT REVERSING", in STEP S2705, the CPU 1401 determines whether the value of the variable data item "i" is smaller than a value obtained by dividing the value the variable data item iNoteCnt by 2.

In a case where the result of the determination of STEP S2705 is "YES", first, in STEP S2706, the CPU 1401 saves the pitch data "note[i]→iPit" retained in the iPit item of the array variable data item note[i], in a variable "ip" retained in the RAM 1403.

Subsequently, in STEP S2707, the CPU 1401 stores the value of a pitch item "note[iNoteCnt-i−1]→iPit" which is the (iNoteCnt-i−1)-th array element, in the pitch item "note [i]→iPit" which is the i-th array element.

Subsequently, in STEP S2708, the CPU 1401 loads the original pitch item value saved in the variable data item "ip" into the pitch item "note[iNoteCnt-i−1]→iPit" which is the (iNoteCnt-i−1)-th array element.

In a case where the result of the determination of STEP S2705 is "NO", the CPU 1401 skips the processes of STEPS S2706, S2707, and S2708.

After the process of STEP S2704 or S2708, or after the result of the determination of STEP S2705 becomes "NO", in STEP S2709, the CPU 1401 increments the value of the variable data item "i" by +1, thereby proceeding to the process on the next note, and returns to the determining process of STEP S2702.

Figures 12A, 12B:
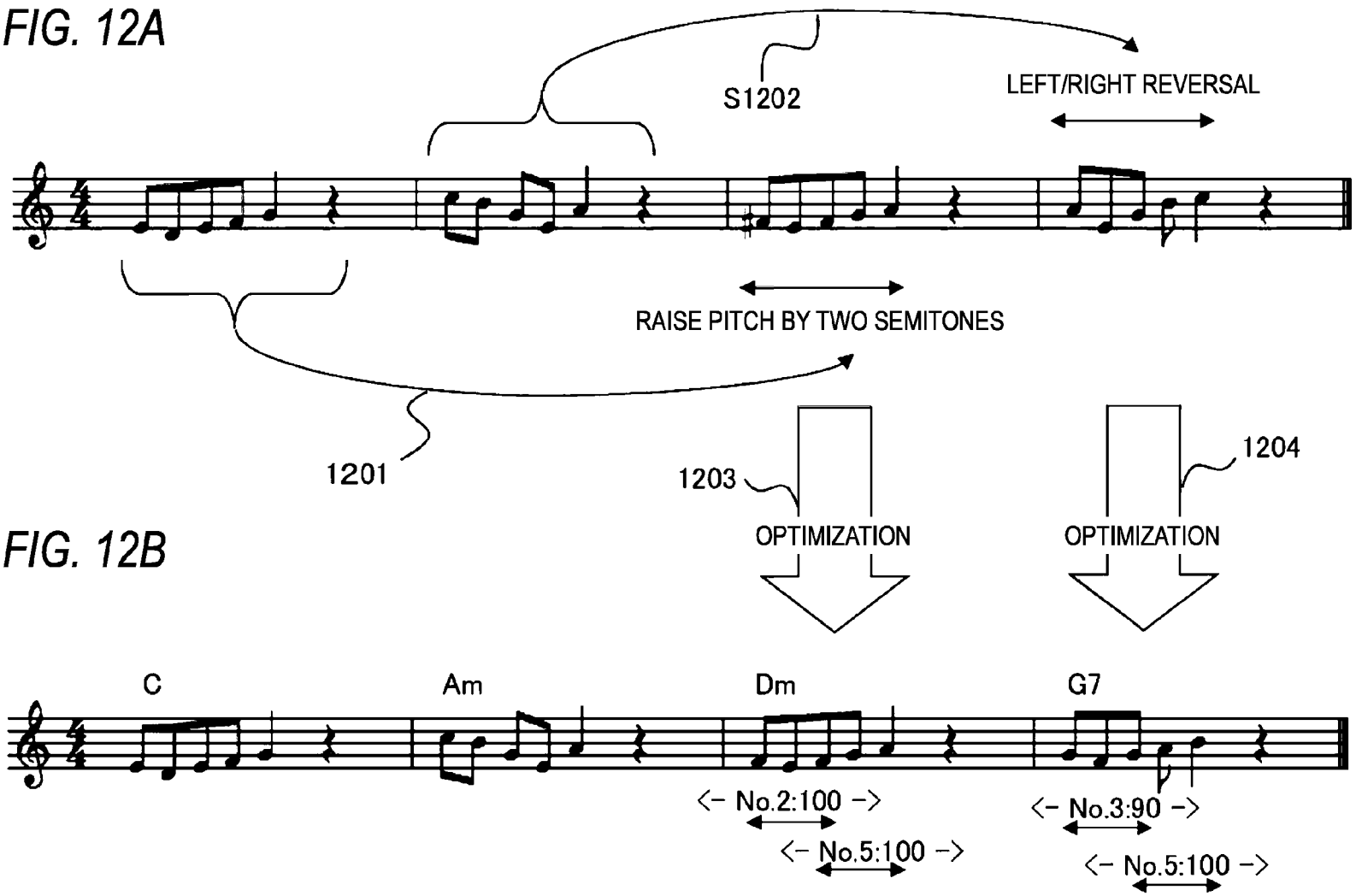
FIGS. 12A and 12B are explanatory views illustrating flows of a melody modifying process and a melody optimizing process.

By the above described process, the left/right reversing process described with respect to the reference symbol "1202" of FIG. 12A is implemented.

Figure 28:
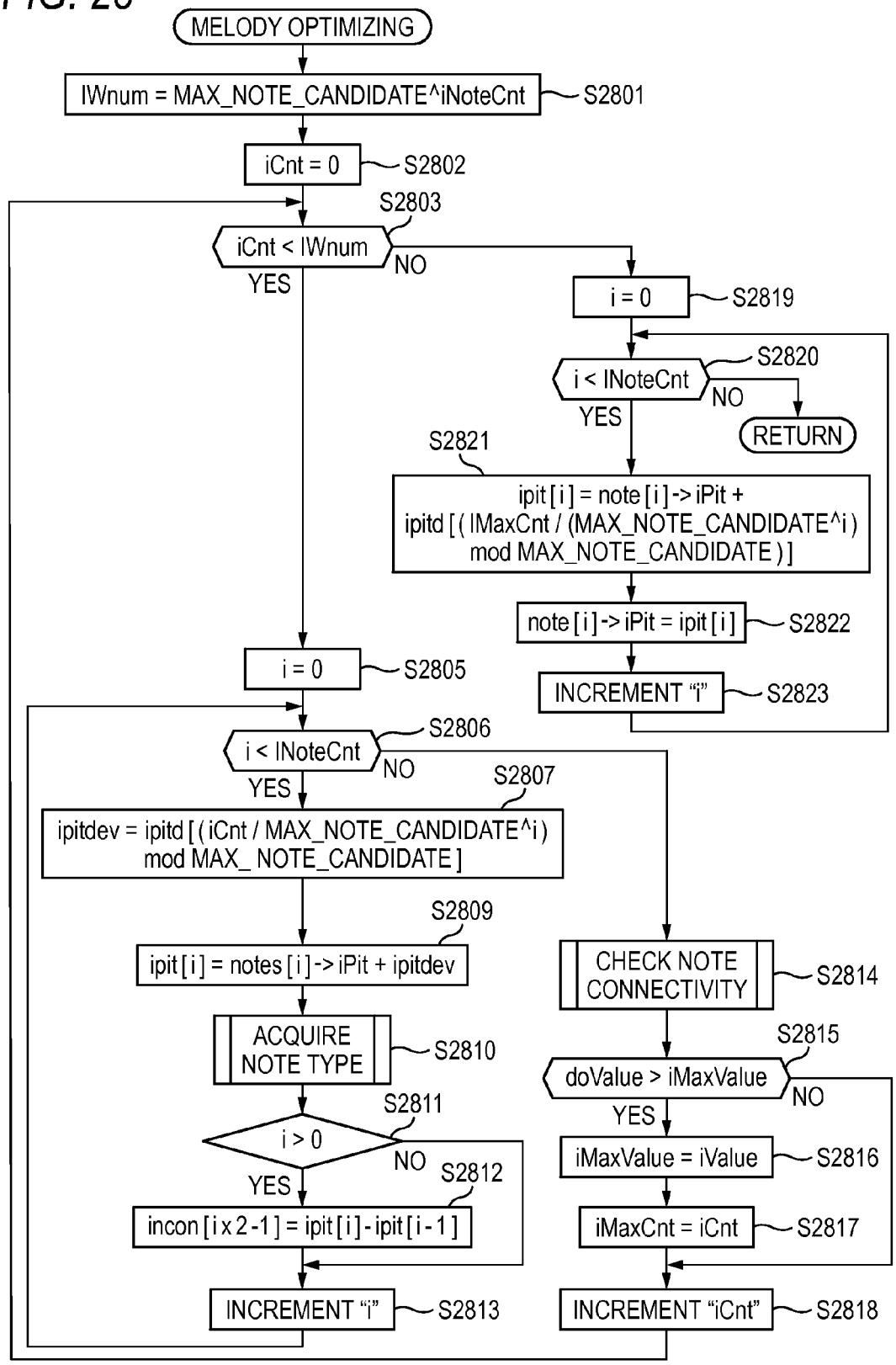
FIG. 28 is a view illustrating a detailed example of the melody optimizing process.

FIG. 28 is a flow chart illustrating a detailed example of the melody optimizing process of STEP S2508 of FIG. 25. This process implements the pitch optimizing process described with reference to FIG. 13.

First, in STEP S2801, the CPU 1401 calculates the total number of combinations of different pitch candidates by the following expression.

$$IWnum=MAX_NOTE_CANDIDATE\hat{}iNoteCnt$$

Here, the operator "^" represents a power operator. Also, a constant data item MAX_NOTE_CANDIDATE retained in the ROM 1402 represents the number of different pitch candidates ipitd[0] to ipitd[4] relative to one note shown in FIG. 13, and is 5 in this example.

Subsequently, in STEP S2802, the CPU 1401 sets a variable data item iCnt for counting different pitch candidates, to an initial value "0". Thereafter, while incrementing the variable data item iCnt, +1 by +1, in STEP S2818, the CPU 1401 evaluates the validity of an input melody while changing the pitches of the corresponding melody, as long as it is determined in STEP S2803 that the value of the variable data item iCnt is smaller than the total number of combinations of different pitch candidates calculated in STEP S2801.

Whenever the value of the variable data item iCnt is incremented, the CPU 1401 performs a series of processes of STEPS S2805 to S2817.

First, in STEP S2805, the CPU 1401 stores an initial value "0" in the variable "i" which is retained in the RAM 1403 and is for counting the number of notes of the melody obtained by the copying process of FIG. 25. Thereafter, while incrementing the value of the variable "i", +1 by +1, in STEP S2813, the CPU 1401 repeatedly performs a series of STEPS S2806 to S2813 as long as it is determined in STEP S2806 that the value of the variable "i" is smaller than the value of the variable data item iNoteCnt representing the number of notes of the melody. In this repetitive process, pitch correction is performed on every note of the melody by STEPS S2807, 52808, and S2809.

First, in STEP S2807, the CPU 1401 obtains a pitch correction value in a variable data item ipitdev retained in the RAM 1403 by calculating the following expression.

$$ipitdev=ipitd[(iCnt/MAX_NOTE_CANDIDATE\hat{}i) \bmod MAX_NOTE_CANDIDATE]$$

Here, "mod" represents remainder calculation.

Subsequently, in STEP S2809, the CPU 1401 adds the value of the variable data item ipitdev calculated in STEP S2807, to the pitch item value "note[i]→iPit" of the input melody, and stores the obtained result in the array variable data item ipit[i] representing the pitch information sequence.

Subsequently, in the same way as that of STEPS S2005 to S2007 of FIG. 20 described above, the CPU performs a note-type acquiring process of STEP S2810 and an adjacent tone calculating process of STEPS S2811 and S2812 on the array variable data item ipit[i] representing the pitch information sequence.

If the CPU 1401 completes pitch correction corresponding to the current value of the variable data item iCnt, on every note constituting the input melody, the result of the determination STEP S2806 becomes "NO". As a result, in STEP S2814, the CPU 1401 performs the same note-connectivity checking process as the process of FIG. 23 described above, on the note type and adjacent tone of each note constituting the melody and calculated in STEPS S2810 to S2812. At this time, the chord information of a chord progression data item corresponding to each measure of the input melody is extracted and used.

Subsequently, in STEP S2815, the CPU 1401 determines whether the value of the matching level newly obtained in the variable data item doValue in the note-connectivity checking process of STEP S2814 is larger than the value of the best matching level held in a variable data item iMaxValue.

If the result of the determination of STEP S2815 is "YES", the CPU 1401 replaces the value of the variable data item iMaxValue with the value of the variable data item doValue in STEP S2816, and replaces the value of the variable data item iMaxCnt with the value of the variable data item iCnt in STEP S2817.

Thereafter, the CPU 1401 increments the value of the variable data item iCnt by +1 in STEP S2818, and returns to the determining process of STEP S2803.

If the above described operation is repeatedly performed on the variable data item iCnt which is sequentially incremented, and as a result, the note-connectivity checking process on every combination of different pitch candidates is completed, the result of the determination of STEP S2803 becomes "NO".

As a result, in STEP S2819, the CPU 1401 stores an initial value "0" in the variable "i". Thereafter, while incrementing the value of the variable "i", +1 by +1, in STEP S2823, the CPU repeatedly performs a series of processes of STEPS S2820 to S2823, as long as it is determined in STEP S2820 that the value of the variable "i" is smaller than the value of the variable data item iNoteCnt representing the number of notes of the melody. In this repetitive process, pitch correction, that is, optimization using the best value obtained in the variable data item iMaxCnt is performed on every note of the melody.

Specifically, after the finish determination of STEP S2820 is performed, in STEP S2821, the CPU 1401 obtains an optimal pitch correction value in the array variable data item ipit[i] of the pitch information sequence by calculating the following expression.

$$ipit[i]=note[i]\rightarrow iPit+ipitd[(iMaxCnt/(MAX_NOTE_CANDIDATE\hat{}i) \bmod MAX_NOTE_CANDIDATE)]$$

Subsequently, in STEP S2822, the CPU 1401 overwrites the pitch item value "note[i]→iPit" of the note data of the input melody with the value of the array variable data item ipit[i] of the pitch information sequence.

Finally, the CPU 1401 increments the value of the variable "i" in STEP S2823, and then returns to the determining process of STEP S2820.

If the above described process on every note data item constituting the input melody is completed, the result of the determination STEP S2820 becomes "NO". Therefore, the CPU 1401 finishes the process exemplified in the flow chart of FIG. 28, that is, the melody optimizing process of STEP S2508 of FIG. 25.

Figure 29:
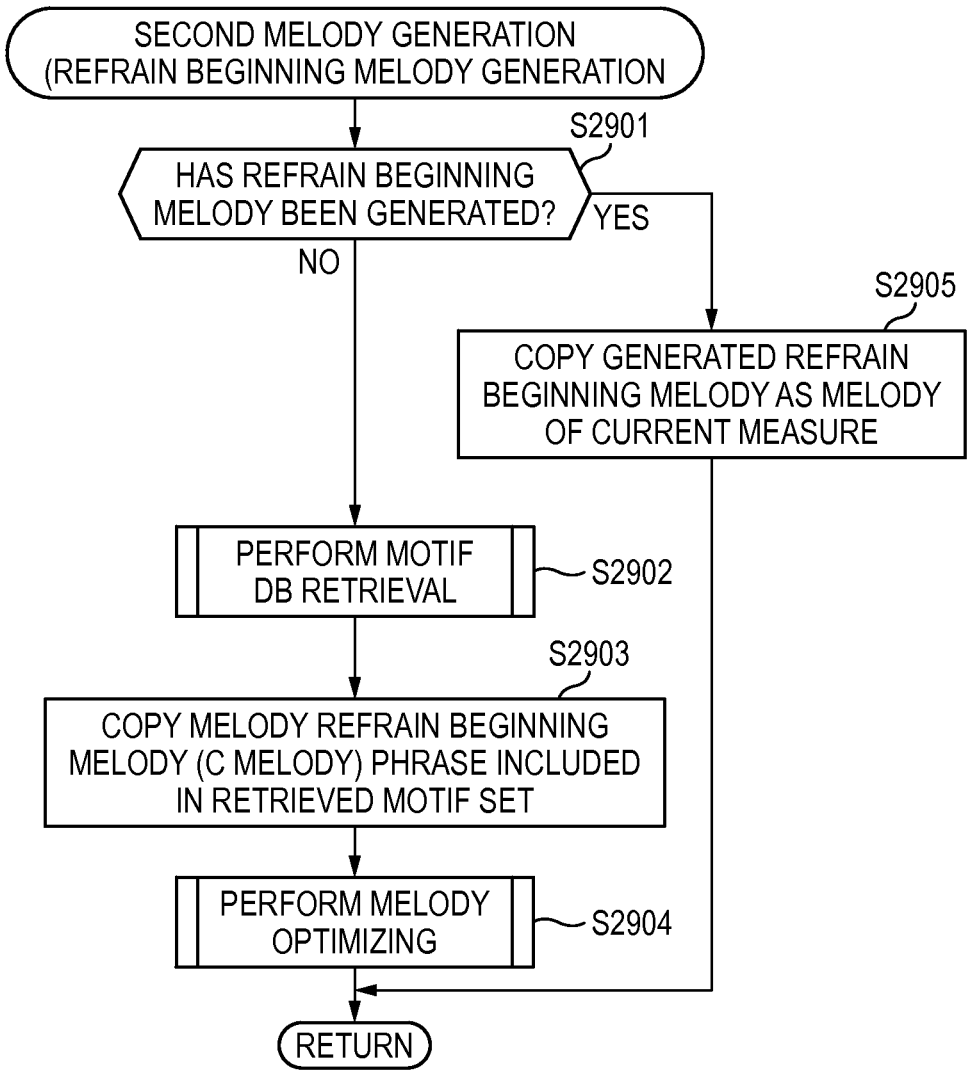
FIG. 29 is a view illustrating a detailed example of a second melody generating process.

FIG. 29 is a flow chart illustrating a detailed example of the second melody generating process (refrain beginning melody generating process) of FIG. 24.

First, in STEP 52901, the CPU 1401 determines whether a refrain beginning melody has been generated.

If a refrain beginning melody has not been generated yet, and thus the result of the determination of STEP 52901 becomes "NO", in STEP 52902, the CPU 1401 performs a phrase-set-DB retrieval process. This process is the same as the process of FIG. 26 corresponding to STEP S2505 of FIG. 5. By this phrase-set-DB retrieval process, the CPU 1401 extracts a phrase set corresponding to the input motif 108, from the phrase set DB 106.

Subsequently, in STEP 52903, the CPU 1401 copies the melody of a refrain beginning (C melody) phrase included in the phrase set retrieved in STEP 52902, in a predetermined area of the RAM 1403.

Subsequently, in STEP 52904, the CPU 1401 performs the same melody optimizing process of FIG. 28 as that of the STEP S2508 of FIG. 25, on the melody obtained in STEP 52903.

The CPU 1401 stores the melody data obtained in STEP 52904 and having optimal pitches, as a part of the melody data 110, in the output melody area of the RAM 1403. Thereafter, the CPU 1401 finishes the process exemplified in the flow chart of FIG. 29, that is, the second melody generating process (refrain beginning melody generating process) of FIG. 24.

If a refrain beginning melody has been generated, and thus the result of the determination of STEP 52901 becomes "YES", in STEP 52905, the CPU 1401 copies the generated refrain beginning melody, as the melody of the current measure, in the output melody area of the RAM 1403. Thereafter, the CPU 1401 finishes the process exemplified in the flow chart of FIG. 29, that is, the second melody generating process (refrain beginning melody generating process) of FIG. 24.

According to the above described embodiment, it becomes possible to quantify the correspondence relation between the input motif 108 and each chord progression data item, as the matching level, such that it is possible to appropriately select chord progression data items suitable for the input motif 108 based on the matching level. Therefore, it becomes possible to generate natural music.

What is claimed is:

1. An automatic composition apparatus comprising:

a processing unit that performs (i) a receiving process of receiving a phrase including a plurality of note data items as a received motif and receiving a type of the phrase, (ii) a retrieving process of retrieving a phrase set from a phrase set database and (iii) a melody generating process of generating a melody based on the retrieved phrase set, wherein:

the phrase set includes phrases having the same type as the received type and having relatively high matching levels for the received motif, and the phrase set database stores a plurality of phrase sets each of which is a combination of a plurality of phrases of different types.

2. The automatic composition apparatus according to claim 1, further comprising:

a memory that stores music structure data items each of which represents an order of a combination of phrases of different types, wherein the processing unit performs, as the retrieving process, a process of designating phrase types based on the order of the music structure data item stored in the memory.

3. The automatic composition apparatus according to claim 1, wherein:

each of the phrase sets includes phrases including any one of a first melody, a second melody following the first melody, and a refrain melody, as different types of phrases.

4. The automatic composition apparatus according to claim 1, wherein:

in a case where the processing unit designates a phrase of the same type as the type of the phrase received as the received motif as the retrieving process, the processing unit performs, as the melody generating process, a process of generating a new melody based on the phrase received as the received motif, instead of phrases included in the retrieved phrase set.

5. The automatic composition apparatus according to claim 1, wherein:

the processing unit performs, as the retrieving process, a process of comparing pitch sequences of phases of the same type as the type of the phrase received as the received motif, with a pitch sequence of the phrase received as the received motif, by using a dynamic programming matching process, and a process of retrieving a phrase set including a phrase most similar to the pitch sequence of the phrase received as the received motif, from the phrase set database.

6. The automatic composition apparatus according to claim 1, wherein:

the processing unit performs, as the melody generating process, a modifying process of modifying phrases included in the retrieved phrase set.

7. The automatic composition apparatus according to claim 6, wherein:

the processing unit performs, as the modifying process, a process of shifting pitches included in the individual note data items constituting the phrases, by a predetermined value.

8. The automatic composition apparatus according to claim 6, wherein:

the processing unit performs, as the modifying process, a process of changing orders of the note data items constituting the phrases.

9. The automatic composition apparatus according to claim 1, further comprising:

at least one of a reproducing unit that reproduces a piece of music based on the melody generated by the processing unit and a score display unit that displays a score representing the piece of music based on the melody generated by the processing unit.

10. An automatic composition method of an automatic composition apparatus including a processing unit, the automatic composition method being performed by the processing unit and comprising:

receiving a phrase including a plurality of note data items as a received motif and receiving a type of the phrase;

retrieving a phrase set from a phrase set database; and generating a melody based on the retrieved phrase set, wherein:

the phrase set includes phrases having the same type as the received type and having relatively high matching levels for the received motif, and the phrase set database stores a plurality of phrase sets each of which is a combination of a plurality of phrases of different types.

11. A non-transitory storage medium storing a program which causes an automatic composition apparatus, which includes a processing unit, to perform processes comprising:

receiving a phrase including a plurality of note data items as a received motif, and receiving a type of the phrase;

retrieving a phrase set from a phrase set database; and generating a melody based on the retrieved phrase set, wherein:

the phrase set includes phrases having the same type as the received type and having relatively high matching levels for the received motif, and the phrase set database stores a plurality of phrase sets each of which is a combination of a plurality of phrases of different types.

* * * * *